US006641419B1

(12) United States Patent
Richardson

(10) Patent No.: US 6,641,419 B1
(45) Date of Patent: Nov. 4, 2003

(54) LIGHTING CIRCUIT, LIGHTING SYSTEM METHOD AND APPARATUS, SOCKET ASSEMBLY, LAMP INSULATOR ASSEMBLY AND COMPONENTS THEREOF

(75) Inventor: Richard J. Richardson, Simi Valley, CA (US)

(73) Assignee: Anthony, Inc., San Fernando, CA (US)

( * ) Notice: Subject to any disclaimer, the term of this patent is extended or adjusted under 35 U.S.C. 154(b) by 0 days.

(21) Appl. No.: 09/341,654

(22) PCT Filed: Aug. 31, 1998

(86) PCT No.: PCT/US98/18121

§ 371 (c)(1),
(2), (4) Date: May 19, 1999

(87) PCT Pub. No.: WO99/10955

PCT Pub. Date: Mar. 4, 1999

Related U.S. Application Data

(63) Continuation-in-part of application No. 09/069,457, filed on Apr. 28, 1998, which is a continuation-in-part of application No. 08/919,947, filed on Aug. 29, 1997.

(51) Int. Cl.[7] ..... H01R 33/02
(52) U.S. Cl. ..... 439/230
(58) Field of Search ..... 439/230, 271, 439/242, 280, 617, 682; 362/396

(56) References Cited

U.S. PATENT DOCUMENTS 1,872,593 A 8/1932 Hough (List continued on next page.)

FOREIGN PATENT DOCUMENTS

| | | |
|---|---|---|
| AU | 56486/94 | 1/1995 |
| DE | 830 221 | 2/1952 |
| DE | 1020733 A | 5/1954 |
| DE | 2644664 A | 6/1978 |
| DE | 3638507 A | 5/1988 |
| DE | 4013271 A | 10/1991 |
| FR | 2611319 A | 8/1988 |
| JP | 05205837 | 8/1993 |
| JP | 05343035 | 12/1993 |
| RU | 1120435 | 10/1984 |

OTHER PUBLICATIONS

U.S. patent application Ser. No. 08/839,125, filed Apr. 23, pending.

U.S. patent application Ser. No. 08/919,947, filed Aug. 29, pending.

U.S. patent application Ser. No. 09/069457, filed Apr. 28, pending.

U.S. patent application Ser. No. 09/604,780, filed Jun. 26, pending.

*Primary Examiner*—Lynn Field
*Assistant Examiner*—Thanh-Tam Le
(74) *Attorney, Agent, or Firm*—Jeffer, Mangels, Butler & Marmaro LLP

(57) ABSTRACT

A socket for a lighting assembly includes a socket body defining an enclosure such that a lamp with a pin contact can extend into the enclosure. Electrical connectors extend away from the enclosure in a second direction. The body includes a wall extending away from the enclosure past the electrical connectors and is spaced from the connectors to allow access to the connectors, and a further wall between the electrical connectors. The further wall can provide an insulating barrier between the connectors. The connectors may be cylindrical. The wall extending away from the enclosure may include a cap covering the wall, and one or more conductors can pass underneath the cap to connect to the electrical connectors for powering the lamp.

47 Claims, 16 Drawing Sheets

U.S. PATENT DOCUMENTS 1,878,229 A 9/1932 Beck
2,295,883 A 9/1942 Williams
2,319,736 A 5/1943 Jarmolowsky
2,356,601 A 8/1944 MacCarthy
2,369,123 A 2/1945 Abshire
2,399,531 A 4/1946 Young
2,447,676 A 8/1948 Webster
2,476,856 A 7/1949 Geenens
2,483,165 A 9/1949 Young
2,495,196 A 1/1950 KulKa
2,522,044 A 9/1950 Kelman
2,626,976 A 1/1953 Howenstine
2,709,792 A 5/1955 Peters
2,715,216 A 8/1955 Howenstine
2,716,738 A 8/1955 Pistey
2,716,739 A 8/1955 Lemmers
2,733,420 A 1/1956 Marz
2,742,621 A 4/1956 Pistey
2,760,053 A 8/1956 Choisser
2,774,947 A 12/1956 Frensch
2,857,578 A 10/1958 Thomas
2,922,137 A 1/1960 Krupp et al.
2,983,838 A 5/1961 Pechy
2,984,812 A 5/1961 Caferro
2,995,723 A 8/1961 Shappell et al.
3,005,971 A 10/1961 Lennox
3,026,496 A 3/1962 Gluck
3,111,353 A 11/1963 Nelson
3,116,098 A 12/1963 Kulka
3,181,103 A 4/1965 Fedorick
3,287,688 A 11/1966 Laurenzo
3,327,281 A 6/1967 Johnson
3,353,140 A 11/1967 Johnson
3,384,858 A 5/1968 Johnson
3,398,391 A * 8/1968 Brishka ..... 439/559
3,426,234 A 2/1969 Hayasaka et al.
3,430,189 A 2/1969 Landgraf
3,660,800 A 5/1972 Detch
3,685,003 A 8/1972 Watt
3,771,106 A 11/1973 Matsumoto et al.
4,039,886 A 8/1977 Scherzer
4,080,030 A 3/1978 Ustin
4,084,873 A 4/1978 Grate
4,102,558 A 7/1978 Krachman
4,198,108 A 4/1980 Bassetto
4,198,109 A 4/1980 Ustin
4,238,815 A 12/1980 Price
4,280,169 A 7/1981 Allen
4,350,400 A 9/1982 Gaynor
4,383,288 A * 5/1983 Hess, II et al. ..... 362/32
4,565,415 A 1/1986 Feinberg
4,573,754 A 3/1986 Hill
4,660,916 A 4/1987 Williams, Jr.
4,758,173 A 7/1988 Northrop
4,772,216 A 9/1988 Szymanek
4,814,954 A 3/1989 Spitz
4,854,888 A 8/1989 Cannon
4,863,394 A 9/1989 Henshaw, Jr.
4,878,854 A 11/1989 Cannon
4,904,903 A 2/1990 Pacholok
4,928,209 A 5/1990 Rodin
4,955,044 A 9/1990 Amstutz et al.
4,992,915 A 2/1991 Meister
4,994,710 A 2/1991 Roelevink et al.
5,006,970 A 4/1991 Mackiewicz
5,009,617 A 4/1991 Thomas
5,069,633 A 12/1991 Straka et al.
5,122,074 A 6/1992 Maag et al.
5,132,885 A 7/1992 Hocheim et al.
5,154,638 A 10/1992 Sireul et al.
5,169,331 A 12/1992 Caldwell et al.
5,188,451 A 2/1993 Shanks
5,192,218 A 3/1993 Kuiper
5,311,097 A 5/1994 Mepham et al.
5,320,547 A 6/1994 Mews et al.
5,354,208 A 10/1994 Salaski et al.
5,368,495 A 11/1994 Raby, Sr.
5,381,321 A 1/1995 Fearing, Jr. et al.
5,448,460 A 9/1995 Belfer et al.
5,452,187 A 9/1995 Belfer et al.
5,469,348 A 11/1995 Wong
5,521,804 A 5/1996 Degelmann et al.
5,616,042 A 4/1997 Raby, Sr. et al.
5,636,919 A 6/1997 Walker
5,688,139 A 11/1997 Gust et al.
5,700,082 A 12/1997 Peng
5,720,546 A 2/1998 Correll, Jr. et al.
5,727,869 A 3/1998 Crosby et al.
5,768,898 A 6/1998 Seok et al.
5,797,675 A 8/1998 Tanner, Jr.
5,800,212 A 9/1998 Hsu
5,855,487 A 1/1999 Kunishi
5,904,415 A 5/1999 Robertson et al.
6,007,362 A 12/1999 Davis et al.
6,193,534 B1 2/2001 Burwell et al.

* cited by examiner

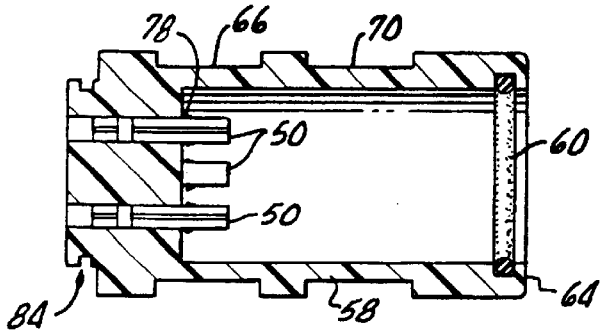
FIG. 2.
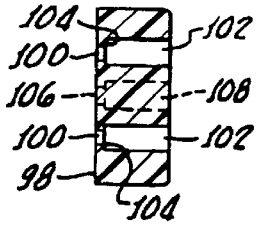
FIG. 3.
FIG. 6.
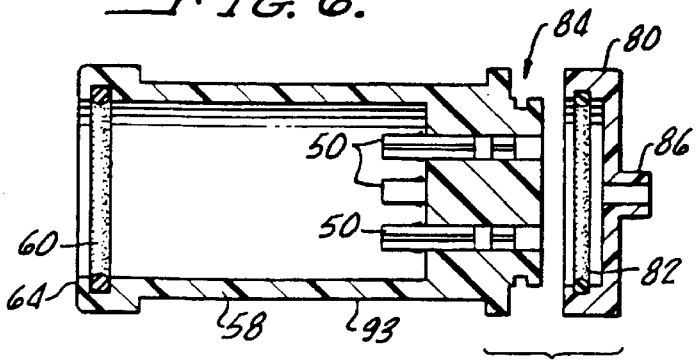
FIG. 7.
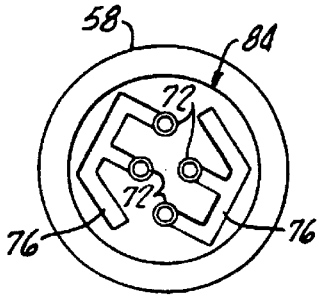
FIG. 12.
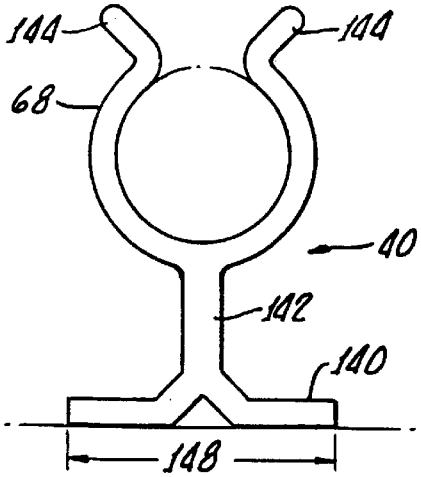
FIG. 13.
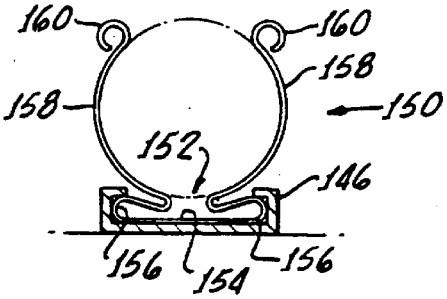

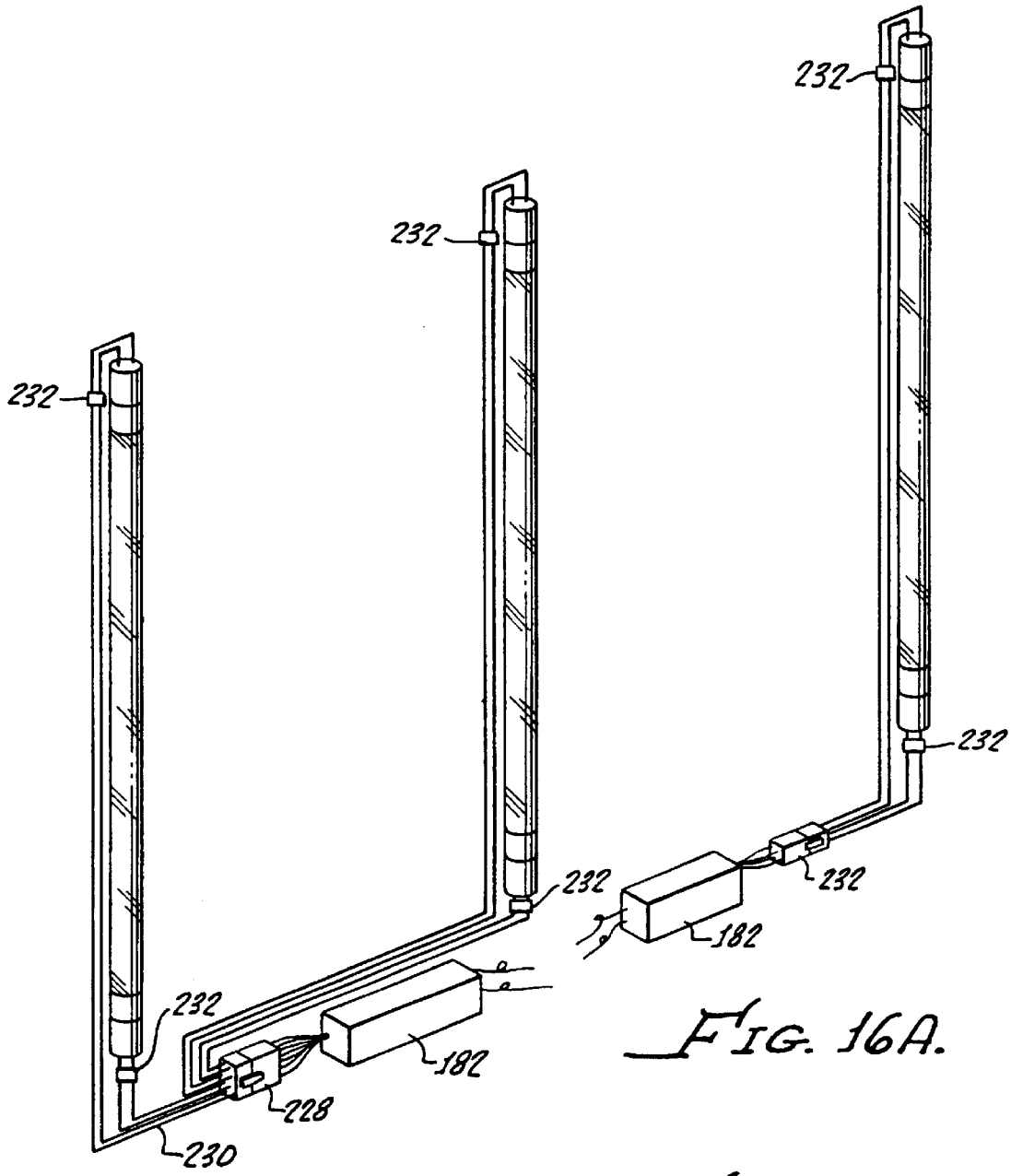
FIG. 16A.
FIG. 16B.
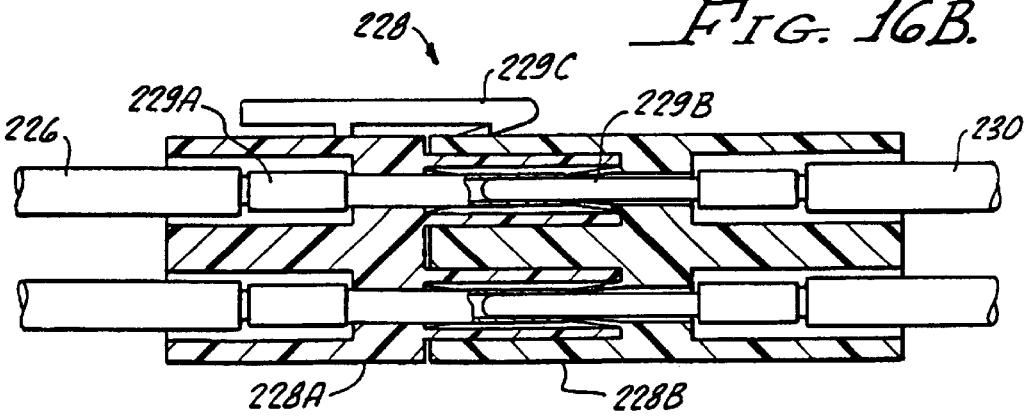

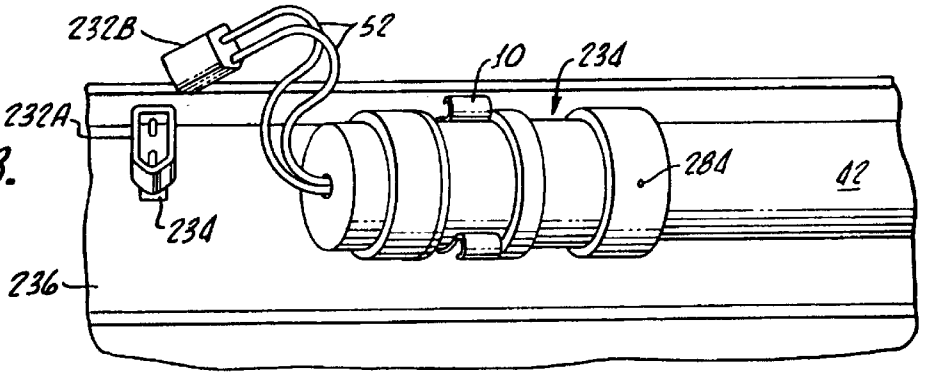
FIG. 18.
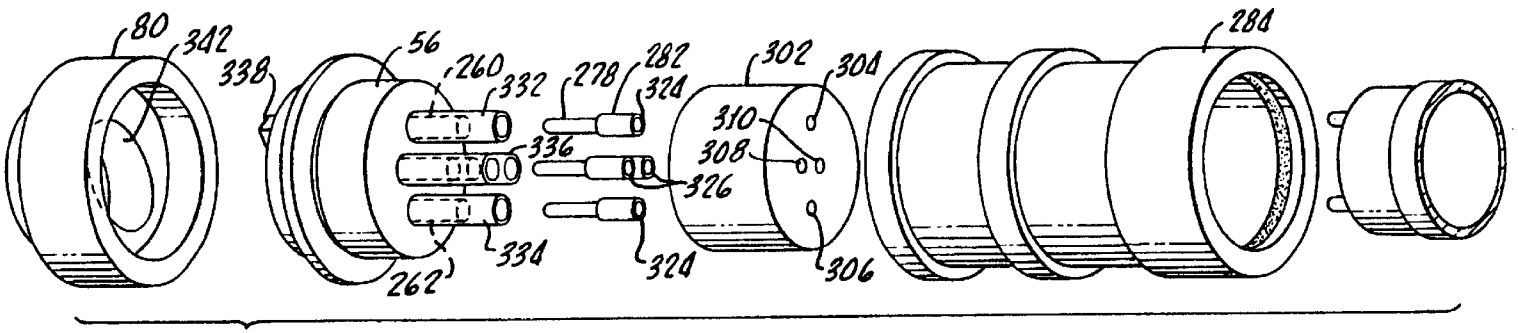
FIG. 19.
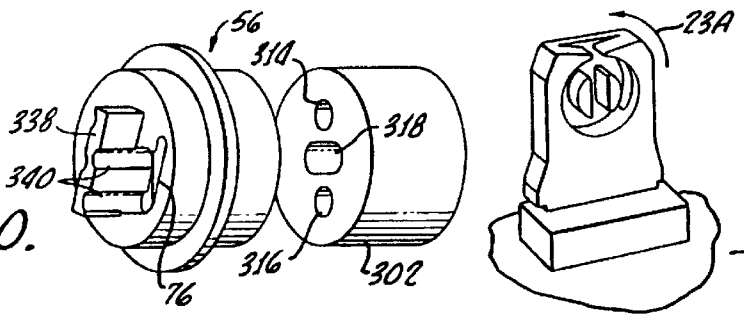
FIG. 20.
FIG. 23. (PRIOR ART)

FIG. 28.
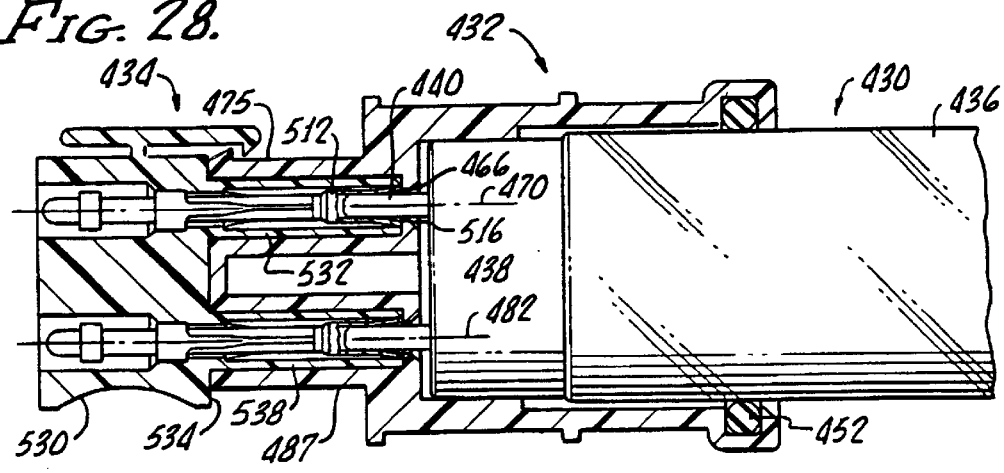
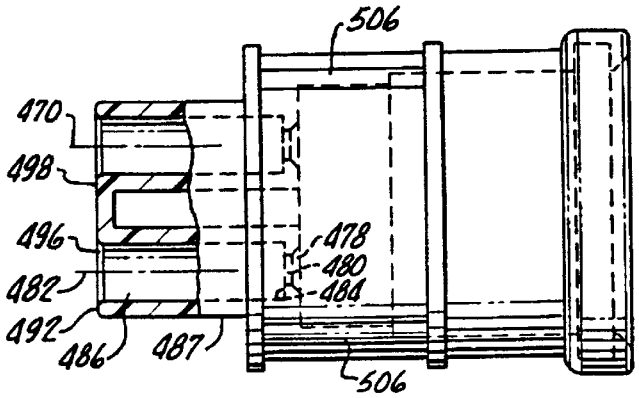
FIG. 29.
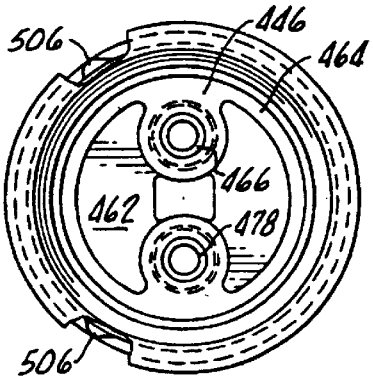
FIG. 32.
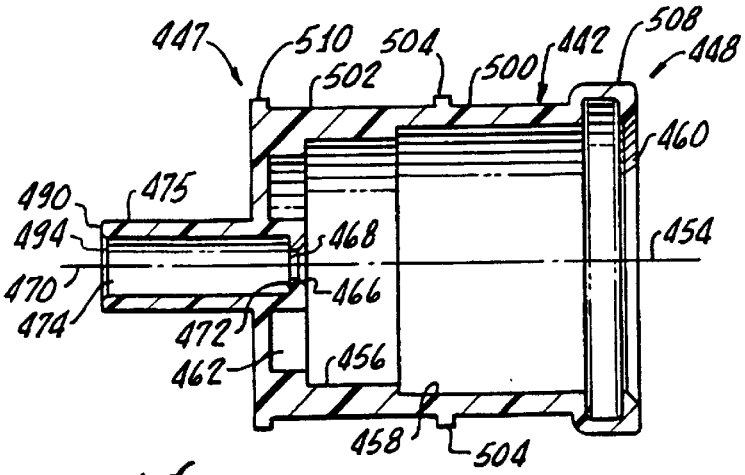
FIG. 30.
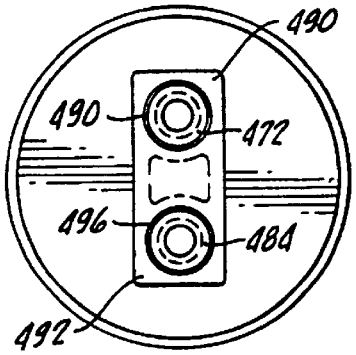
FIG. 31.

LIGHTING CIRCUIT, LIGHTING SYSTEM METHOD AND APPARATUS, SOCKET ASSEMBLY, LAMP INSULATOR ASSEMBLY AND COMPONENTS THEREOF

CROSS REFERENCE TO RELATED APPLICATIONS

This is a Continuation-In-Part of Ser. No. 09/069,457, filed Apr. 28, 1998, which is a Continuation-In-Part of Ser. No. 08/919,947, filed Aug. 29, 1997.

I. BACKGROUND OF THE INVENTION

A. Field of the Invention

This invention relates to lighting systems, and components and assemblies for lighting systems, such as socket assemblies and lamp insulator assemblies, used in lighting systems. One aspect of an embodiment of the invention relates to fluorescent lamp sockets and mounting arrangements for such sockets, while another aspect relates to fluorescent lamp insulators and other aspects relate to lighting systems for refrigeration systems.

B. Related Art

The use and operation of fluorescent lighting systems are affected by a number of factors. One factor is safety, with one purpose being to minimize the possibility of electrical shock to personnel, including customers, maintenance personnel and the like. Another factor is the lighting system dimensions, including the lamp size, size of electrical contacts, and the positioning of electrical contacts. A further factor includes environmental considerations, such as the operating temperature, and the surrounding temperature. Environmental considerations also include humidity, especially where the surrounding temperature may result in moisture condensation or icing. Another consideration under the category of environment includes operating conditions such as vibration, impact, and protection from other mechanical factors. Another factor includes ease of installation, repair and replacement, including interchangeability or variability of parts and lamps in the lighting system. A further consideration is how the lighting system is electrically driven. Each of these factors will be discussed more fully below.

The majority of present lighting systems are electrically driven. Standards have been established for design, certification and approval of most lighting systems for the protection of personnel, such as building occupants, customers, installation and repair personnel, as well as others. Such standards include insuring that personnel are not exposed to high voltage or electric shock during installation or replacement of lighting elements such as lamps and bulbs. For example, most household incandescent bulbs have the hot and neutral contacts positioned relatively close to each other and installation of the bulb does not produce an exposed live contact. The risk of shock is minimized for the user by grasping the relatively low conductive glass portion of the bulb, and the contacts become live only after the bulb is substantially threaded into the socket. A common design for fluorescent sockets minimizes the possibility of electrical shock by having each end of the lamp inserted into respective sockets and seated or rotated a given amount before electrical contact occurs. This minimizes the possibility of having an exposed live contact. Another design of fluorescent sockets has one socket spring loaded so that the socket can be depressed with one end of the linear lamp inserted into the socket to permit enough spacing for the opposite end to be inserted into its respective socket. However, there is still a possibility that the opposite end of the lamp could be live before it is inserted into its corresponding socket. U-shaped fluorescent lamps and lamps having other shapes significantly different from the traditional linear shapes are comparable in some ways to traditional incandescent household bulbs in that the electrode contacts are closer together. As a result, the likelihood that shock may occur is somewhat reduced.

While incandescent lamps are generally driven off line voltage, fluorescent lamps typically require a ballast to start the lamp and regulate the power applied to the lamp. The voltage required to start the lamps depends on the lamp length and its diameter, with larger lamps requiring higher voltages. The ballast is designed to provide the proper starting and operating voltage required by the particular lamp. The ballast provides the proper voltage to fire the lamp and regulates the electric current flowing through the lamp to ensure stable light output. The ballast also supplies a correct voltage for the desired lamp operation and adjusts for voltage variations.

Traditionally, ballasts were of the electromagnetic, solid core type having a large transformer for providing the desired voltage and current. The voltage was typically provided to the lamp at or near the operating line voltage of 120 volts or 240 volts and frequency of 60 Hz or 50 Hz, respectively. Occasionally, the lamp is driven at a higher current in order to enhance the light output, but such overdriving of the lamp typically results in a shorter lamp lifetime.

Electronic or solid state ballasts provide greater energy efficiency by converting the power to light more efficiently than electromagnetic ballasts. Therefore, it is possible that an electronic ballast can provide a greater light output than an electromagnetic ballast with the same power consumption. The higher efficiency and light output is achieved by operating at a higher frequency than line frequency, and sometimes by operating at a higher voltage. As a result, it is possible that a ballast could acquire a relatively high open circuit voltage, as high as 750 volts, such as after lamp, ballast or other component failure, or some other electrical failure in the lighting system, which could consequently lead to injury or damage. For example, an improperly connected lamp in its respective sockets could lead to a high open circuit voltage, which in turn could cause arcing, overheating, possible lamp failure and possible ballast failure.

Because of the higher driving voltages, the connection between the ballast and the lamp or bulb is important. Typically, fluorescent lamps have bi-pin contacts or double recessed contacts at each end of the fluorescent tube. The pins are separated by a predetermined center-to-center pin separation distance, which may vary according to the size of the lamp. For larger diameter lamps, the spacing can be larger for recessed double contact lamps such as some T10 and T12 lamps, but otherwise will be the same for bi-pin T8, T10 and T12 lamps. For example, a T12 double recessed contact lamp will have a larger center-to-center contact spacing than a T8 bi-pin lamp. The number 12 and the number 10 refer to the size, in eighths of an inch, of the lamp diameter.

Much of the hardware used with the T12 and T10 lamps have been relatively standardized. In one form of socket, commonly referred to as a tombstone socket (FIG. 23), the pins of each end of the lamp are inserted sideways into the socket until the lamp is centered in each socket. After being centered, the lamp is rotated about its longitudinal axis, allowing the pins to come into contact after rotation with the contacts in each socket. This socket minimizes the possibility of one end of the lamp being inserted into one socket with subsequent energization of the lamp and the opposite free end being live. A shock could result from a live free lamp end.

In the tombstone style of socket, contact and illumination of the lamp is achieved by electrical contact between part of the outer surface of each pin and a portion of the surface of the contact. However, the electrical contact for each pin occurs only over a relatively small surface area, estimated to be in some circumstances about around 0.00360 to 0.00370 square inches. As a result, any high current through the lamp results in a relatively higher current density at the pins, that the socket may not have been designed for.

Another conventional socket for T10 and T12 lamps is a spring-biased recessed double contact socket, whereby one end of a lamp is inserted into the spring-biased socket, depressing the biased portion of the socket. Depressing the socket permits insertion of the opposite end of the lamp into the stationary socket on the fixture. However, nothing prevents the free end of the lamp from being live and a potential for electric shock. While this socket configuration may account for expansion and contraction due to thermal cycling and extreme environmental conditions, the potential for electric shock remains.

Bulb size also affects the safety and efficacy of lighting systems. The longer the fluorescent lamp, for example, the greater the current required to fire and maintain the lamp at the desired output. That greater current must be passed through the socket, across the socket conductors and to the pins of the lamp. With some socket designs, the current density may be relatively high between the socket and the pins for longer lamps. Consequently, overheating or other effects may occur.

Longer lamps also require a greater center-to-center distance between sockets. In conventional fixtures, the sockets are rigidly mounted to a fixed substrate that may contract or expand with changing environmental conditions. For example, in very low temperature situations such as out of doors or in freezer environments, the contraction could be a matter of sixteenths or eighths of an inch. For fixed sockets, such as tombstone-style sockets, the contraction over a large center-to-center distance between the sockets could force the sockets to bend away from the lamp (shown by the arrow 23A in FIG. 23), reducing the contact surface area between the socket and the lamp pins, as well as possibly disconnecting the lamp from the socket. In other fixtures where the sockets are mounted to a plastic substrate, portions of the plastic may flex or bend, permitting the socket to bend toward or away from the lamp, also possibly reducing the contact surface area between the socket and the lamp pins. Separation or disconnection of the lamp from the socket could cause arcing, overheating, or possible electric shock.

Conventional sockets leave portions of the lamp end exposed to environmental conditions. Such sockets generally engage the lamp pins through contacts recessed behind a flat face that butts against the flat end face of the bulb, from which the lamp pins extend. The abutting flat faces leave a gap, allowing contaminants, moisture, and cold air to enter the gap. Contaminants and moisture from cleaning or from use or maintenance may foul or corrode the connection and moisture may condense or freeze on the contacts of the connection. Additionally, cold air around the electrode area of the lamp will decrease the operating efficiency of the lamp, as well as possibly shorten the life of the lamp.

Environmental conditions affect the operation of lighting systems, for example, by decreasing operating efficiency, exposing the fixture to moisture, and extreme temperatures. Such conditions exist in outdoor illuminated signs, outdoor fixtures, unheated storage areas, refrigeration freezer cases and boxes, and cold storage rooms. Some systems see temperatures as low as −40° F. and as high as 160° F. Therefore, expansion and contraction may cause lighting system failure in many applications. Fixed center socket systems or spring-loaded socket systems often do not accommodate such changes in socket center-to-center distances caused by expansion and contraction of the substrate to which they are mounted. Temperature extremes affect the operation of the lamp by decreasing the operating efficiency. For example, some fluorescent lamps have peak operating efficiency at about 104° F. Significant deviations from that temperature significantly decrease the efficiency of operation and output of the lamp. Higher temperatures may also contribute to overheating of the connection between the socket and the lamp. High humidity may subject the lamp-socket connection to condensation of moisture around the connection, and possibly icing about the lamp-socket connection. Consequently, the possibility of arcing or shorting may be increased. Increased moisture around the socket and lamp may also corrode the metal of the lamp-socket contacts, affecting the integrity of the connection between the lamp and the socket, for example by increasing the resistance in the connection, causing arcing which in turn may cause more corrosion or oxidation.

Additionally, operating conditions such as vibration and other physical forces, such as impact, affect lighting system operation. Vibration may cause the lamp and socket to disconnect, which also may cause premature lamp or ballast failure. Often, ballasts will fail immediately upon disconnection. Disconnection may also cause overheating, arcing, or more serious damage. Vibration is often caused by wind, nearby operation of motors or compressors, impact, such as by maintenance crews, earthquake and, in the case of refrigeration units, slamming doors, restocking of shelves, and heavy traffic. Vibration may cause vibration or rotation of the lamp in a socket, leading to disconnection, especially where there is nothing that inhibits disconnection.

During the manufacture of lighting fixtures, the sockets are not always accurately positioned to ensure optimum connection of the lamp pins and the sockets. For example, on tombstone-style sockets, fixedly mounting the socket on the substrate several sixteenths or an eighth of an inch too close together or too far apart could lead to an improper connection. If the sockets are too close together, installing the lamps between the sockets will force one or both sockets to bend away from the lamp. Bending could cause either a poor connection or an incomplete connection with the lamp, especially where there is nothing in the tombstone socket design that inhibits disconnection in a direction longitudinally of the lamp. If one socket has a good connection, but the other socket has a poor connection or no connection at all, the affected lamp end will be live and subject to arcing or overheating and possible damage or injury. Thereafter, replacement of lamps would result in further loosening of the sockets and possible failure of the fixture.

In addition to sockets not always being properly positioned or spaced, an inadequate or failed connection can result where lamp lengths vary from one lamp to the next, or between lots. The length of one lamp may vary by a sixteenth of an inch of more from the length of another lamp of the same type merely because of manufacturing tolerances that are too large. Variations in nominal lamp length could cause properly positioned sockets to bow outwardly upon installation of the lamp. Shorter lamps may lead to inadequate connection.

Poor socket-lamp connection can also result from poor contact alignment on lamps. For bi-pin fluorescent lamps, for example, a pair of spaced apart contact pins are positioned at each end of the lamp. For proper lamp connection, each pair of pins must properly engaged the associated sockets. Since the sockets are mounted to a substrate or support surface, the alignment of the contacts in each socket is relatively fixed. However, if the pin alignment of one pair is not identical to the pin alignment of the pair of pins on the opposite end of the lamp, an incomplete connection may result at one end or the other of the lamp. Failure to contact, or an incomplete contact may result in possible failure of the fixture.

Repair or replacement of lighting fixtures is often difficult in cases where the sockets are fixedly mounted to a substrate. Often, the substrate is not designed for easy removal and replacement of lighting sockets, further exacerbating any connection problems that might occur between lamps and sockets. Similar comments may apply in situations where lamps are first installed or are replaced, and where sockets are jammed or impacted during lamp removal or replacement. Loose or bent sockets increase the likelihood of connection failure. Similar problems could arise during cleaning or maintenance of the equipment surrounding the lighting fixture. For example, in refrigeration units, the lamp fixture could be jarred or jammed during cleaning, restocking of shelves or at other times. Additionally, sockets may be jarred or damaged when they are first installed in the support structure, when lamps are first installed in the fixture, or when lamps are removed and replaced. In these circumstances, it is possible that the connection between the socket and the lamp is no longer adequate, resulting in or leading to inadequate or incomplete connection or a failed connection.

It is also believed that inadequate connection and reduced conductivity in the lighting circuit may lead to lighting inefficiencies and possible ballast failure even before complete failure of an electrical connection, such as failure of the connection between the lamp and its socket. It is believed that the effect on the ballast of an inadequate connection results from a combination of the characteristics of the ballast and the characteristics of the lighting circuit. These characteristics will be discussed more fully below.

Electronic ballasts used to drive fluorescent lamps are constant current devices. The lamps they are intended to drive are designed to operate at a relatively constant current to ensure the desired electron and photon production in the lamp. If, for some reason, the impedance of the lamp increases, the current will decrease unless the ballast maintains the current constant. Any increased resistance or impedance in the lamp circuit as seen by the ballast will typically result in a higher voltage across the ballast output terminals. Therefore, differences (or variances)in the lighting circuit from the optimum design will also affect the ballast and ballast operation, in addition to affecting the other components of the circuit. These changes may occur over time, such as by lamp aging, by changes in the socket-lamp connection, such as corrosion, by contact separation, by contact icing or corrosion and the like. These differences may also be inadvertently incorporated in the lighting circuit from the beginning. For example, differences may arise such as through an inadequate lamp connection resulting from an oversized lamp, improper socket placement, socket damage during installation, as well as other reasons. For example, if a high voltage is applied across an inadequate connection arcing may occur, resulting in oxidation and higher contact resistance and lower conductivity. The higher resistance produces a larger impedance in the circuit as seen by the ballast, which would then cause the ballast to adjust accordingly.

Lower conductivity, as well as other differences or changes in the circuit from the optimum design, may lead to ballast overheating, as well as overheating of other circuit components, and possibly ballast or other circuit failure.

Many conventional lamp fixtures use sockets dimensioned for only T10 and T12 sized lamps. However, newer T8 and T5 lamps are not interchangeable with T10 and T12 lamps, nor with each other. Therefore, interchangeability of sockets is made more difficult and interchangeability of lamp sizes for a given socket arrangement is not available. Consequently, the drawbacks discussed previously relating to replacement of sockets apply equally to interchanging one socket size or type for another.

For example, T8 and T5 fluorescent lamps would use different lighting fixtures under conventional designs. Some of those fixtures may have marginal lamp pin-to-pin socket terminal connections that may cause premature lamp failure, ballast burnout, and the like. Additionally, differences in lamp length between T8 and T5 lamps make conventional fixtures difficult to use and precluding interchangeability of lamps with having to replace fixtures. The nominal lengths for T8 lamps are 72 inches, 60 inches, 48 inches, 36 inches and 24 inches. The nominal lengths for T5 lamps are in standard metric lengths, corresponding to 57.05 inches, 45.24 inches, 33.43 inches, and 21.61 inches. Therefore, changing from T8 to T5 lamps requires a change of fixtures. Additionally, the lamp pin center-to-center spacing is different, being 0.490 for the T8 lamp and 0.185 for the T5 lamps.

II. SUMMARY OF THE INVENTIONS

Embodiments of a lighting system and components are described which minimize the possibility of electric shock due to incomplete lamp and socket connection, or due to complete electrical disconnect between a lamp and a socket connection, possibly causing a high open circuit voltage and/or ballast and component overheating or failure. Embodiments are also described which minimize the possibility of contamination due to cleaning procedures in equipment surrounding lighting fixtures, maintenance procedures, repair and replacement procedures, and the like. Elements are also described which provide enhanced thermal protection for more efficient lamp operation and regulation, and protect the lamp and socket connection from environmental factors, such as temperature extremes, humidity, condensation, icing and vibration. A further aspect of a lighting system and components described herein improves the construction and the procedures used in the installation, repair and replacement of lighting fixtures, and provides for a greater flexibility in, and interchangeability of, lighting elements. A further aspect of a lighting system described herein improves the operating characteristics of the lighting system, for example by decreasing the operating temperature of the ballast and/or associated components in some instances, by reducing the occurrence of ballast failure, lamp failure, component failure or of other problems in those components or by improving the light output. Elements are also described which provide a better matched lighting circuit which is less likely to lead to circuit breakdown or failure. These benefits can be achieved even at higher voltages provided by some ballasts.

In one embodiment of the invention described, a socket is provided which permits connection between the socket and the lamp that is less dependent on the specific mounting arrangement or holder, or on its positioning. Preferably, the socket and its connection to the lighting element are moveable relative to the particular mounting arrangement. The sockets described herein can be positioned at one or both ends of the lighting element, such as a fluorescent lamp. In one aspect, they are intended to be considered more a part of the lamp than of the substrate from which the socket is supported, because the socket-lamp configuration is believed to be more significant than the particular form of the socket-substrate connection. Embodiments of the disclosed lighting system permit variants of pin alignments and lamp lengths, lamp interchangeability and provide for better support of the lamp. Several embodiments of the design also permit installation of at least two different sizes of lamps, both in terms of diameter and lamp length. Embodiments of the described invention are also particularly suited for use with solid state ballasts.

For example in one preferred aspect of the present invention, a socket includes a housing with at least one cylindrical, slotted or female-type connector and a cavity or enclosure for accepting a lamp into the socket. This configuration can be used with present bi-pin lamps where the lamp is inserted into the socket, and permits various other benefits, such as being able to protect the lamp, provide support for the lamp and to have a more stable electrical lamp connection. Preferably, the connector extends into the cavity or enclosure a distance less than the full length of the enclosure and may even be flush with the bottom of the enclosure, for example to permit greater insertion of the lamp in the socket if desired on the one hand, or to reduce the size of the enclosure on the other hand. Preferably the connector is one that engages, surrounds and contacts all or a significant portion of the pin that it connects to for ensuring the maximum connection surface area possible and improving conductivity.

In accordance with another aspect of the present invention, a socket is described for a lighting system wherein the socket has a socket body and an electrical connector, and further includes protection for the lighting element such as a lamp. The protection may take the form of electrical insulation, thermal insulation, protection from vibration, contamination, and the like. In one form of the invention, the protection is provided by a cover for the conductor portion of the lamp. In another form of the invention, the protection is provided by a cover that extends over the conductive end of the lamp, and in still another form, the protection is provided by a seal between the socket and the lamp.

For example, in accordance with one preferred aspect of the present inventions, a socket is described for a lighting system wherein the socket includes an element for forming a seal between the socket body and the lighting element. The seal can be formed from an O-ring or other suitable seal element. A seal can provide protection from the effects of the environment, including humidity, temperature extremes, as well as particulate and other contamination. A seal can also protect the lighting system from the effects of vibration, impact, and other external forces. In one preferred form of the invention, the socket covers and seals a portion of the lamp, for example to provide thermal insulation to the electrode area of the lamp.

In another form of the invention, the contact includes a plurality of contacts in a base of the socket. For example, the contacts can be arranged in a diamond- or cross-configuration where two contacts accommodate the pins of one size of lamp, and wherein two other contacts accommodate the pins of a differently-sized lamp. Such an arrangement could accommodate a T8 sized lamp, as well as a T5 sized lamp, a T8 and a T10 or T12, or any combination of known lamp configurations. The particular contact arrangement provides for the optimum isolation between adjacent contacts and between neutral and hot contacts.

In another form of one aspect of the inventions, the socket, such as the external surface of the socket body, may include one or more grooves or other elements for accepting a removable clip or mounting attachment, to mount the socket to a substrate or other support. In one embodiment, the groove would be approximately the same size as the mounting element at one end of the lamp, and larger than the corresponding dimension of the mounting element at the other end of the lamp. This arrangement permits expansion and contraction of the fixture relative to the fixed length of the lamp. Alignment indicators may also be included to indicate the desired lamp pin alignment relative to the socket.

In an additional form of another aspect of the inventions, a socket includes an electrical connector and a body extending longer than the contact length of the connector and wherein the connector or other portion of the socket includes a structure for engaging an insulator or protector on the lamp. The structure may include barbs, points, or other elements for establishing an interference contact with the insulator. For example, connection between the lamp pins and socket can be achieved by a split sleeve slotted terminal made from spring material in the socket. The slotted terminal has an I.D. that is smaller than the O.D. of the male lamp pin, providing a pressure fit, which pressure fit provides a safeguard against accidental disconnection caused by vibration and the like. To further safeguard against such disconnection, two pointed barbs preferably extend outwardly from the external surface of the slotted terminal and engage the inner surface of counterbores of the lamp insulators. In addition, the socket's O-ring seal provides for a gripping of the exterior surface of the lamp which serves as added protection against disconnection.

In a further form of the inventions, a socket is provided for a lighting assembly having a socket body and at least one electrical connector, and a holder for the socket body which is movable, at least rotatably or slidably, relative to the socket body, to permit expansion or contraction of the fixture assembly relative to the fixed lamp dimension. Preferably, the holder is removable from the socket. In another form of the invention, the holder is spring-biased and the mounting surface for mounting the holder to the substrate includes a track for adjusting the position of the holder relative to the socket.

In a further aspect of the inventions, a protector in the form of an insulator is provided for such lighting elements as fluorescent lamps, wherein the insulator protects at least one of the conductors on the lamp and engages the conductor in such a way that removal of the insulator is inhibited. For example, with a bi-pin fluorescent lamp, the insulator may include two openings corresponding to the pins and dimensioned in such a way as to provide an interference fit between each pin and the opening in the insulator. In one preferred form of the invention, the height of the insulator is greater than or equal to the length of the pins to protect the pins. In another form, the insulator also covers a portion of the lamp body in order to help protect or insulate the lamp end.

In another aspect of the invention, a lamp assembly is provided including a lamp with at least one contact extending from a surface of the lamp for receiving and supplying electrical energy to the lamp and a contact protector extending substantially around the contact in such a way that the contact is still accessible for electrical contact. In one form of the invention, the lamp is a bi-pin lamp wherein the two pin contacts are preferably cylindrical and the contact protector extends around both pins while leaving sufficient space to be accessible for electrical connection. The protector is preferably an insulator which extends beyond the ends of the pins so that the pins are recessed within the insulator.

In still another form of the invention, pin extenders are placed over respective pins on the lamp and hold the insulator in place. The pin extenders may also enhance the ability to make a reliable connection with a socket of the type disclosed herein. In a further form of the invention, the lamp and the conductive contacts are separated by an insulator between the contacts such that the shortest, unobstructed distance between the contacts is no less than 0.50 inch.

In another form of the invention, a connector is provided for connecting the contacts of a fluorescent light source to a source of electrical energy including an input conductor for receiving electrical energy from a ballast and an output conductor adapted to accept a contact of a fluorescent light source. An electrical circuit is provided between the input and the output conductors for passing current from the input conductor formed in such a way as to improve the conductivity in the circuit. It is preferred that the use of a connector having one or more of these characteristics can be used in a refrigeration system, such as a refrigerated display case wherein any contact resistance or contact surface area between the connector and the fluorescent light source remains substantially the same over a broad temperature range, for example from minus 20 degrees Fahrenheit to 70 or 100 degrees Fahrenheit and under the conditions encountered in refrigerated display cases. Such display cases encounter temperature and moisture extremes, and vibration, impact and other environmental conditions. They also experience a number of electrical influences, such as noise from other equipment such as compressors, and the like, line excursions and other variations. The lighting system of the present inventions and the components thereof can withstand many and preferably all of these conditions, and permits the lighting circuit to have a wider range of tolerance in the conditions within which it can operate.

In another form of the invention, a connector is provided having contacts for coupling to a fluorescent lamp where the contacts of the connector corresponding to the contacts on the lamp are separated from each other by an unobstructed surface path no less than 0.50 inch. Preferably, a substantially nonconductive barrier extends between the contacts on the connector to provide part of the separation. In one configuration, the contacts are cylindrical split contacts for accepting pins on a bi-pin lamp, and the contacts are enclosed by plastic sleeves to inhibit arcing between the contacts. Preferably, the contacts are recessed below the open ends of the respective sleeves.

In an additional form of the invention, a circuit for lighting a lamp is provided including an electronic ballast, a lamp socket for supplying electrical energy to a lamp through contacts in a socket and at least one electrical conductor for coupling the ballast to the socket. A junction between the conductor and the contact of the lamp has a contact surface area of at least 0.005 square inch and preferably at least 0.008 and 0.01 or 0.10 square inch or more, to ensure improved conductivity, both electrical and thermal, across the junction.

These and other aspects of the present invention will be understood more fully after consideration of the drawings, a brief description of which is provided below, and the detailed description of the preferred embodiments.

III. BRIEF DESCRIPTION OF THE DRAWINGS

FIG. 2 is a cross sectional view of a socket in accordance with several aspects of the present inventions.

FIG. 3 is a cross sectional view of an insulator taken through two of the bores of the insulator in accordance with a further aspect of the present inventions.

FIG. 6 is a cross sectional view of a socket in accordance with further aspects of the present inventions and including an end cap.

FIG. 7 is an end view of the sockets of the present inventions without an end cap.

FIG. 12 is a side elevational view of a clip in accordance with one aspect of the present inventions.

FIG. 13 is an end elevation view of a clip and mounting track in accordance with a further aspect of the present inventions.

FIG. 16A is a schematic of a lighting system including lamps, ballasts and electrical connectors.

FIG. 16B is a cross-sectional view of a connector used for connecting conductors between a ballast and a lamp.

FIG. 18 is a perspective view of a portion of a lighting circuit and lamp in accordance with another aspect of the present inventions.

FIG. 19 is an exploded perspective and partial cross-sectional view of a socket, insulator and lamp in accordance with several aspects of the present inventions.

FIG. 20 is a perspective view of a base of a socket for use with a lamp in accordance with a further aspect of one of the present inventions.

FIG. 23 is a perspective view of one type of conventional tombstone socket mounted to a substrate.

FIG. 28 is a cross-sectional view of a lamp, lamp adapter and connector assembly in accordance with a further aspect of the present inventions.

FIG. 29 is a side elevational and partial cut-away view of a lamp adapter in accordance with one aspect of the present inventions.

FIG. 30 is a cross-sectional view of the adapter of FIG. 29.

FIG. 31 is an end elevation view of the adapter of FIG. 29.

FIG. 32 is a right side elevation view of the adapter of FIG. 29.

IV. DETAILED DESCRIPTION OF PREFERRED EMBODIMENTS OF THE INVENTIONS

A lighting system and components are described which help to minimize the possibility of electric shock, protect the socket and lamp connection from the environment and from vibration and other external forces, improve conductivity in the connection, provide a more reliable connection between the socket and the lamp, and which are substantially independent of the particular lighting fixture mounting arrangement and allow for variances in lamp designs and dimensions. The lighting system and the components also accommodate such environmental elements as temperature extremes and moisture, and accommodate different lamp dimensions. The lighting system and components are also usable with current solid state ballasts. Components of the lighting system also contribute to an improved and better matched lighting circuit having better operating characteristics and reducing the possibility of overheating of the ballast and other components, ballast or other circuit failure, thereby providing a safer and more reliable lighting circuit.

Lighting systems and their components have numerous applications and the embodiments of the present inventions can be used advantageously in a variety of lighting systems. They find particular significance in the fluorescent lighting area, where there are particular needs met by the present inventions. The preferred embodiments described herein are intended to be illustrative of the inventions but the inventions are not limited to those embodiments. For example, some of the various embodiments are discussed with examples from the aspect of refrigeration units, especially as they relate to lighting systems in harsh environments. Refrigeration systems experience various extreme conditions such as very low temperatures, high humidity, significant vibration and high voltage and current conditions, and there are other situations where lighting systems are subject to such conditions as well. However, the present inventions are not limited to refrigeration applications. The inventions are discussed in more detail in their preferred embodiments below in conjunction with the drawings.

Figures 1, 5, 9, 10:
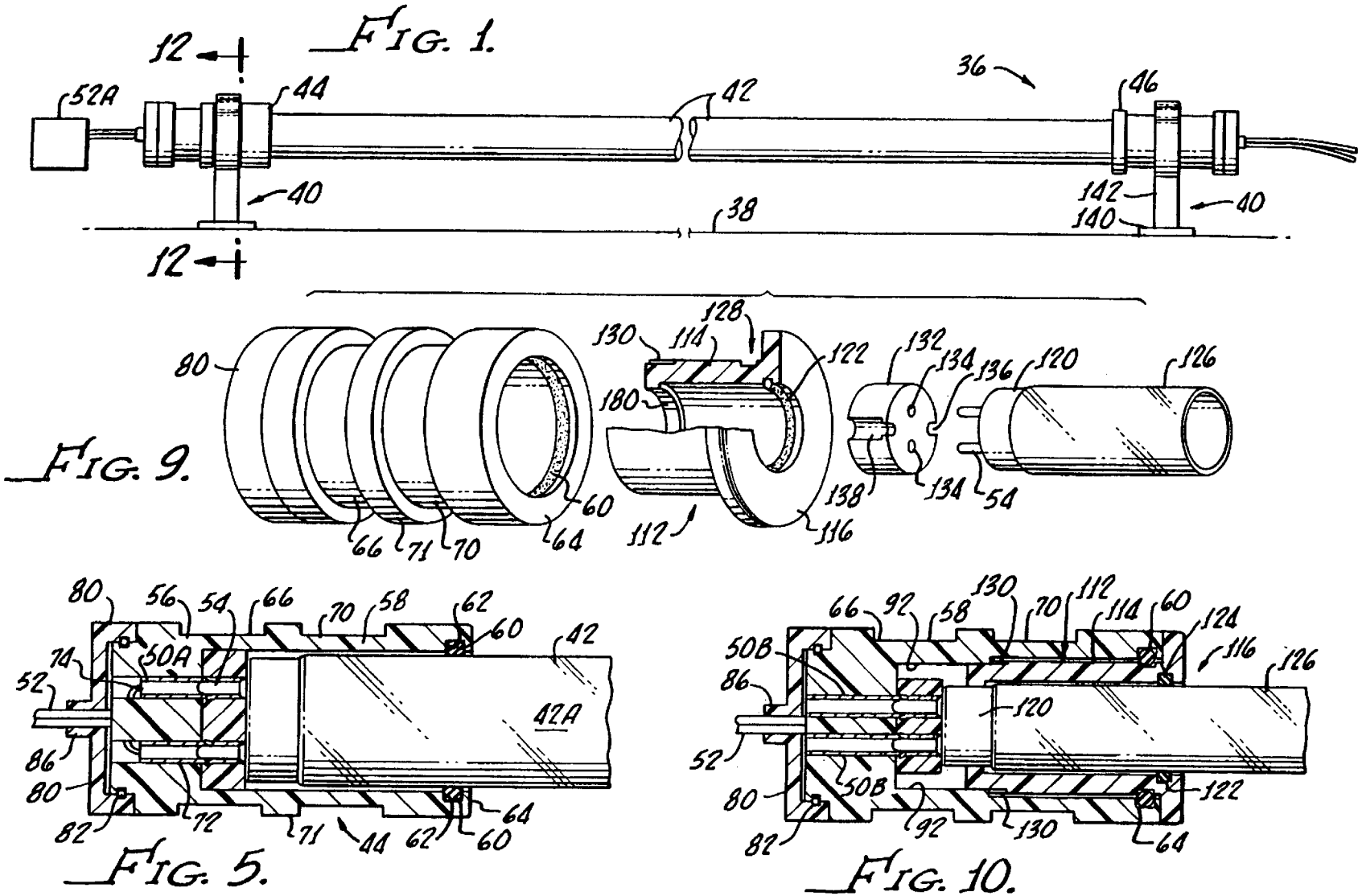
FIG. 1 is a side elevation view of a lighting assembly in accordance with one aspect of the present invention.
FIG. 5 is a longitudinal cross section of a socket and insulator in accordance with several aspects of the present inventions.
FIG. 9 is an exploded perspective and partial sectional view of the socket, insulator and lamp of FIG. 10 in accordance with further aspects of the present inventions.
FIG. 10 is a longitudinal cross sectional view of a socket in accordance with further aspects of the present inventions.

A lighting assembly 36 is shown generally in FIG. 1, mounted to a base or substrate 38. In the context of a refrigeration unit, the base 38 could be a mullion, frame element, wall or other structural support for supporting the lighting system. The lighting system can be mounted or supported at any orientation, including horizontally, vertically, or at an angle, and can be supported from any direction relative to the target of the illumination. The lighting system is mounted, attached, or otherwise supported by the base 38 through mounting clips 40, several of which are shown in more detail in FIGS. 12 and 13, for mounting the sockets and lamp to the base 38.

A lighting system typically includes a lighting element, which in the present preferred embodiment is a fluorescent lamp 42, and one or more connectors, which in the presently preferred embodiment includes a first socket 44 and a second socket 46. In the preferred embodiment, the first socket 44 is a fixed socket that would be placed on the bottom in a vertical lighting fixture arrangement, and the second socket 46 is an expansion socket mounted above the fixed socket 44. The term "fixed" is used here as a term relative to the other socket such that it is not as movable as the other socket. The first socket is not intended necessarily to be rigidly fixed, but not as freely movable as the second socket. This same arrangement would preferably apply where the expansion socket 46 is mounted at a higher level than the fixed socket 44, though not necessarily exactly vertical, so that the fixed socket can reliably support the lamp and socket combination as desired.

The particular configuration of the lighting system shown in FIG. 1 corresponds to a combination which would accept lamps of two different lengths, and the configuration in FIG. 1 accommodates the longer of the two lamps. The configuration is for the longer of two lamps because the mounting clip is mounted to the fixed socket 44 at a position closest to the lamp, as described more fully below.

Considering a preferred embodiment of the fixed socket in more detail relative to FIGS. 2, 4, 5, 9, and 10, the fixed socket 44 includes a rigid body 48, defining a bore, and further includes a plurality of conductive connectors 50 oriented preferably parallel to the central axis of the socket for making contact with complementary connectors on the lamp 42. In the case of lighting fixtures using fluorescent lamps, the socket serves to connect and supply current from the ballast over conductors 52 through particular electrical contacts 50 and through the two pins 54 of the lamp bulb to the lamp 42. The lamp typically includes the pins 54 mounted to but insulated from the end cap which in turn is mounted to the lamp body 42A. The socket is preferably substantially cylindrical in outside shape to minimize the space taken up by the socket in the lighting fixture. It is also substantially cylindrical in inside shape of the bore, except as noted below, to conform to the outer shape of the lamp 42. The cavity or enclosure defined by the body of the socket allows the necessary access by the lamp to the appropriate slotted contacts for energizing the lamp, and the body provides the desired protection for the socket and lamp connection. The body also protects users by minimizing the potential for shock from a failed or compromised socket connection.

The body of the socket is sized longitudinally so as to permit suitable mounting of the connectors 50 in the first wall or base 56 of the socket and to permit connection of the conductors 52 to the connectors 50 in the base of the socket. The body of the socket is preferably sized longitudinally so that the second or housing wall 58 defining the enclosure with the base 56 surrounds a portion of the lamp to provide preferably not only thermal insulation but also protection from other environmental effects such as moisture. Thermal insulation helps to maintain the lamp electrode temperature within a relatively limited range compared to the surrounding temperature. Moisture protection is preferred in order to protect the contacts and the other metallic portions of the lamp and its connection from corrosion and possible condensation or icing. The length of the wall 58 also helps to stabilize and support the lamp relative to the rest of the lighting assembly. The wall 58 of the socket also serves to cover not only the pins on the lamp, but also the base to which the pins are mounted. This protection helps to minimize the possibility of electrical shock due to open circuit voltage. Preferably, the housing wall is a unitary wall integral with the base 58 for providing structural integrity to the socket. The housing wall preferably is at least twice the length of the connectors 50 extending from the base wall 56 so that they are recessed from the rim and to provide sufficient space for the socket to support the lamp. More particularly, the housing preferably extends sufficiently past the connectors 50 to cover the metal end cap of the lamp as well as the electrode area of a T8 lamp, for example about one and five-eighths inches from the ends of the connectors 50 to the rim.

In one preferred embodiment of the invention, the socket includes a seal for forming a substantially closed environment around the socket and lamp connection. The closed environment helps to thermally insulate the contacts and the socket-lamp connection. The seal also provides the desired protection against other environmental factors such as humidity and consequent icing or condensation of water on contact surfaces or surfaces around the connection between the socket and the lamp. The seal also has additional benefits such as structural integrity and helping to inhibit removal of the lamp from the socket under normal operating conditions. Moreover, the seal may also help to maintain linear stability in the socket lamp connection, and to keep the components centered. The seal is formed on the lamp where there is a reliable sealing surface, such as at the smooth glass surface of conventional fluorescent lamps.

The seal is preferably provided in the form of an O-ring seal 60 for providing an air and moisture seal for the socket and lamp. The O-ring seal 60 is preferably placed in an O-ring groove 62 formed near the rim or open end 64 of the socket. The O-ring and groove are sized to provide a good friction fit between the O-ring and the glass or other surface of the lamp, thereby providing the desired seal at that location. The seal provides structural support and inhibits lateral or longitudinal as well as rotational movement of the lamp within the socket. The O-ring seal helps to dampen or eliminate the effects of any vibration, impact or other external forces, thereby providing additional protection to the electrical contact between the lamp and the socket. The O-ring seal further helps to keep the components centered, especially as they are being assembled. The O-ring seal also helps to minimize the possibility of the socket and lamp separating longitudinally, which helps to maintain the proper electrical connection between the socket and the lamp. Consequently, the O-ring seal also helps to minimize the possibility of arcing, exposure to open circuit voltages, and high potentials in the socket.

In the preferred embodiment, the O-ring is seated in its O-ring groove on the inside of the socket and extends sufficiently out into the bore to form the good mechanical seal. Alternatively, the O-ring seal may also be positioned intermediate or part way along the interior surface of the bore of the socket and still provide a moisture, thermal and environmental seal for the electrodes and the end face of the lamp. However, thermal insulation of the electrodes might be reduced and the potential for contamination by particles or other elements could occur between an intermediate O-ring seal and the end face 64 of the socket unless an additional O-ring were placed near the rim 64.

Figures 4, 8, 11:
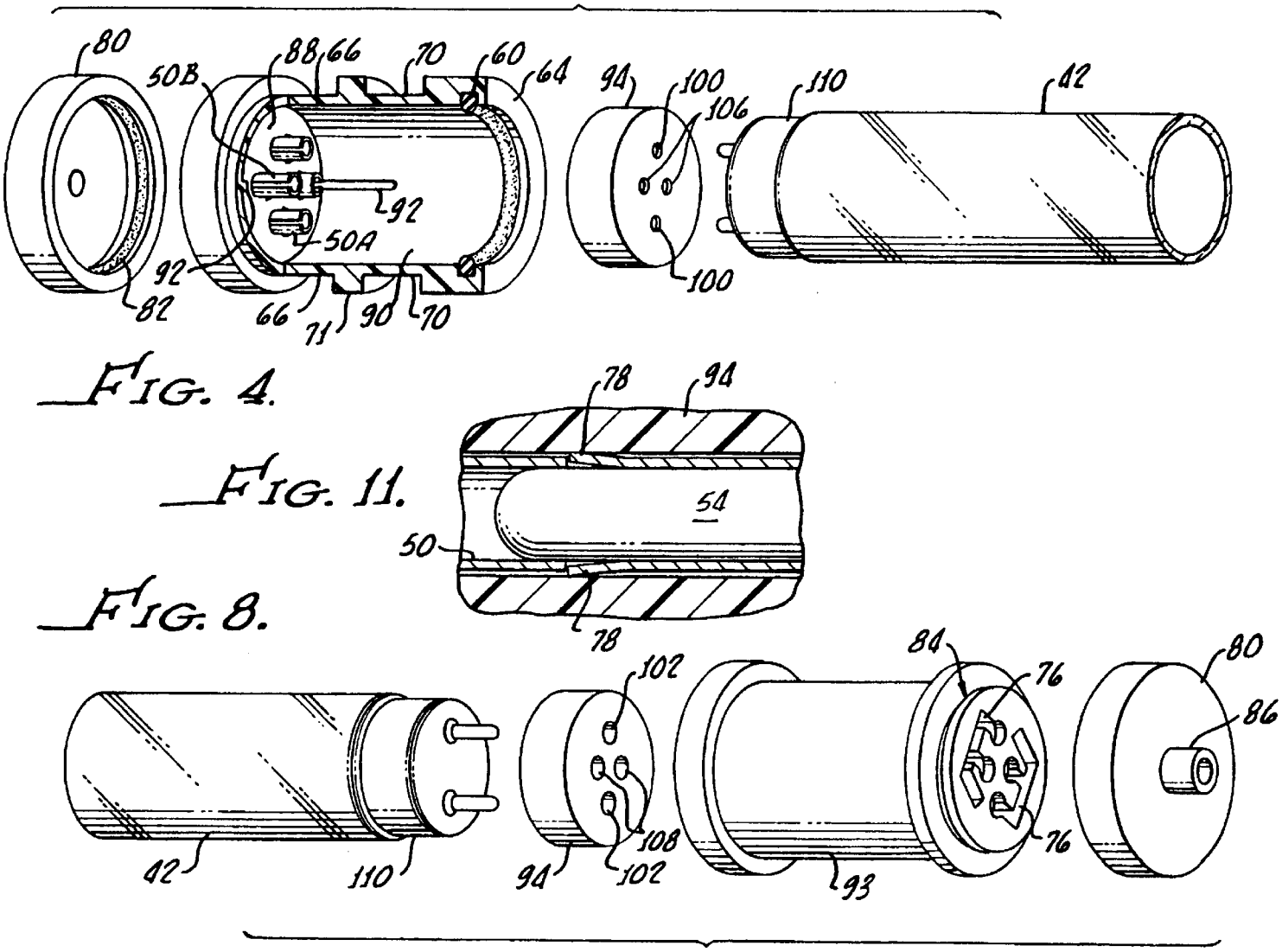
FIG. 4 is an exploded perspective and partial cross sectional view of a socket, insulator and lamp in accordance with several aspects of the present inventions.
FIG. 8 is an exploded perspective view of another form of socket with a lamp and insulator in accordance with several aspects of the present inventions.
FIG. 11 is a detailed cross sectional view of an electrical connection made with the socket and lamp and insulator in accordance with further aspects of the present inventions.

Considering the fixed socket 44 in more detail, particularly with respect to FIGS. 4 and 5, the socket includes a first mounting groove 66 for releasably accepting an engagement portion 68 of a holder, support or mounting device such as clip 40 (FIGS. 1 and 12). The first mounting groove 66 preferably extends around the entire perimeter of the fixed socket 44, and is preferably only slightly wider than the longitudinal length of the engagement portion 68 of the clip. This spacing permits suitable engagement of the clip with the fixed socket and permits rotation of the socket within the clip, but minimizes the amount of longitudinal motion of the socket relative to the clip. While longitudinal motion of the socket relative to the clip is possible, it is preferred that there be relatively little longitudinal motion so that the lamp can be reliably positioned relative to the base 38.

The fixed socket also preferably includes a second mounting groove 70 similar to the first mounting groove 66 but positioned between the first mounting groove 66 and the open end 64 of the socket. The second mounting groove 70 is separated from the first mounting groove 66 by a ridge 71. The second mounting groove 70 has the same structure and function as the first mounting groove 66, but gives more flexibility in positioning the lamp and socket assembly. The second groove is preferably used to suitably position the sockets with a longer lamp than is used in positioning a lamp using the first mounting groove 66. For a given clip spacing, mounting a lamp using the second mounting groove 70 places the electrical contacts 50 further away from the clip and contacts on the expansion socket 46 to accommodate a longer lamp. For example, the second mounting groove 70 can be used to position a T8 lamp while the first mounting groove 66 can be used to position the approximately two inch shorter T5 lamp. Because the T5 lamp is slightly shorter than a T8 lamp, the sockets are positioned closer together than the socket position for mounting a T8 lamp.

The base 56 of the socket includes bores 72 for accepting respective connectors 50. The connectors 50 are positioned spaced apart in the base at points of an elongated diamond, cross or "X" to accommodate the bi-pins of a T8 lamp in one configuration and the bi-pins of a T5 lamp in the other configuration. The pair of connectors 50 for a T8 lamp are designated 50A and are shown most clearly in FIG. 5 connecting to the pins 54 of a T8 lamp. The spacing about the center of the base between the connectors 50A represents the pin spacing found in a T8 lamp. The pair of connectors 50 for a T5 lamp are designated 50B, seen most clearly in FIG. 10, representing the pin spacing for a T5 lamp. The socket 44 of FIG. 4 is shown in one orientation in FIG. 5 and is shown rotated 90 degrees in FIG. 10. While the orientation is preferably 90 degrees, other relative orientations are possible, such as being 80 degrees apart but still preferably being on lines intersecting at the center of the base. Other pin orientations are especially possible with pin spacings that are significantly different. Opposite connectors in a pair are the neutral and hot connectors for a given lamp. As shown in FIG. 5, one connector in each pair is coupled to a conductor 74 in wire ways 76 (FIG. 7) for providing current from the conductors 52 to the connectors 50. Similar or related connector configurations can be used to accommodate other pin configurations for other lamp sizes and configurations. The socket could also be configured to accommodate only one pair of connectors if the flexibility of accommodating two different lamp pin spacing distances is not necessary.

The connectors are preferably hollow or cylindrical connectors, preferably compression type or slotted, and may have a cross section in the shape of a triangle, square, rectangle, oval, ellipse, or other suitable shape, and some are conventionally referred to as female connectors. The connectors are preferably circular cylindrical. While, other shapes and configurations are possible, complimentary mating shapes are preferred, especially curved shapes. The connectors will be referred to herein as cylindrical connectors, which term is intended to include these connectors as well as others having the characteristics described, such as enclosing a pin-type connector for producing a relatively high contact surface area. The cylindrical connectors are press fit into likesized bores in the base 56 in their appropriate positions with the conductors 74 soldered or otherwise coupled to the both (one conductor for the two hot connectors and one conductor for the two neutral connectors) of their respective connectors for passing current to the connectors. Alternatively, each connector 50 can be connected to a respective conductor 74, with the hot conductors 74 extending into the wireway for the hot conductor 52 and the neutral conductors 74 extending into their respective wireway for being electrically coupled to the neutral conductor 52. The respective conductors 52 can be soldered in the respective wireways 76 to achieve the desired connection having the desired conductivity and current density. It has been found that maximizing the conductivity in the connection and through the conductors 52, 74, connectors 50 and into the pins 54 provides a more optimally operating lighting circuit. It is believed that having a higher conductivity than has previously existed in the ballast circuit, especially in the socket, permits a cooler operating circuit and electronic ballast, a more uniform lamp wall temperature, is less likely to produce arcing with the attendant complications such as oxidation and increased resistance, enhances light output, and provides a more reliable and safe socket as a component of the lighting circuit. It is believed that by having a higher conductivity, such as by providing a high cross-sectional area of contact, the resistance of and the voltage drop across the socket is reduced, thereby reducing any impedance created by the socket, and the electrical and thermal conductivity are improved. The socket operates at a lower temperature and is less likely to fail. In the preferred embodiment, the surface area of actual contact, for improved conductivity, is about 0.05 square inch, and is preferably even higher at 0.07 square inch or more. Preferably, a junction between the conductor and the contact of the lamp has a contact surface area of at least 0.005 square inch and preferably at least 0.008 and in better cases 0.01 or 0.10 square inch or more, to ensure improved conductivity, both electrical and thermal, across the junction. It is believed that doubling the surface area of contact for a standard tombstone socket could have a noticeable improvement in conductivity. These are preferred characteristics, and may be varied while still taking advantage of various aspects of the present invention. They can be varied even to the extent of having a higher impedance, lower conductivity, or being less reliable, while still incorporating beneficial aspects of the present inventions. Some tombstone-style sockets may have a surface area of actual contact of around 0.003 to 0.004 square inches.

In addition to improving the conductivity characteristics of the socket in the initial design, the structural characteristics of the socket help to maintain those electrical characteristics over the life of the socket. For example, the protection provided by the body of the socket and the O-ring 60 reduces the possibility of fouling or contamination of the connection to the lamp, and reduces the possibility of adverse weather conditions affecting the electrical connection to the lamp. They also reduce the possibility of incomplete or failed connection due to vibration or other environmental forces, including impact.

The connectors 50 preferably include one or more barbs 78 to minimize the possibility of removal of the connectors from the base 56, and also to engage insulators on the lamps, as described more fully below with respect to FIG. 11. The connectors 50 have a length which will fully seat the pins 54 on the lamps sufficiently to provide the desired electrical connection. They have a diameter which will provide a good wiping electrical connection with the pins from the lamp when the socket is placed on the lamp. The combination of a split connector with a pin contact from the lamp enhances the surface area of electrical contact, possibly even by as much as twenty times or more, and increases the current density for a given current level, relative to other sockets. Enhancing the surface area of electrical contact between the connectors 50 and the lamp pins 54 also serves to reduce the impedance developed in the socket lamp connection, and reduces the voltage drop across the socket. Combined together, the higher current density permitted in the socket from the conductors 52 through the connectors 50 to the pins 54 reduces the impedance seen by the electronic ballast and provides a better and more reliable electrical connection between the ballast and the lamp.

The length of the housing beyond the connectors is preferably sufficient to provide protection for users and to provide protection to the lamp-socket connection. The connector ends should be sufficiently recessed in the housing from the rim to minimize the possibility of personnel touching a live contact. This added length on the socket should be balanced with the desire for maximum light exposure from the lamp, minimizing the amount of usable lamp space that is covered. Additionally, the socket housing is preferably long enough to firmly engage the lamp and form a reliable seal between the socket and the lamp with the O-ring. Therefore, the socket housing is preferably long enough for the O-ring seal to contact a portion of the lamp surface that is uniform, i.e. not transitioning from the body of the lamp to the metal end cap. The longer the housing, the more stable is the socket-lamp connection. Additionally, with a longer housing, additional O-ring seals may be provided if desired.

The end of the socket is preferably sealed with a socket end cap 80, which may include an O-ring seal 82 positioned in an O-ring groove in the end cap 80 to provide a suitable seal between the end cap 80 and a groove 84 in the end of the socket. The conductors 52 then pass through the end cap through a seal and strain relief 86. Preferably, a moisture and air-tight seal is provided by suitable means in the strain relief 86, such as by molding the cap and strain relief about the conductors. Alternatively to the O-ring 82, the end cap can be sealed and bonded to the body of the socket through ultrasonic welding or other suitable means. The wires may be attached to the socket at any desired entry point, from the end of the socket, the side, or the like.

The connectors 50 extend through and beyond the base surface 88 a distance sufficient to accommodate the insulator for the lamp bulbs, described more fully below. The base wall 88 forms the end or bottom of the cylindrical wall 58 of the socket, opposite the open end 64. The wall 58 preferably includes a relatively smooth interior surface wall 90 (except as noted below) between the O-ring groove 62 and the base wall 88 to minimize the possibility that insertion of the lamp into the bore of the socket causes any hang up or obstruction. In the preferred embodiment, key surfaces 92 (FIGS. 4 and 10) are formed 180 degrees apart extending longitudinally along the inside surface 90 of the socket from the base wall 88 part way toward the open end 64. They are preferably coplanar with one set of connectors 50 to indicate their location, in the present case those for the T5 lamp (see FIGS. 4 and 10). These key surfaces 92 engage and position a lamp adapter, described more fully below. The key surfaces also may be used to help properly position the lamps so that the bi-pins of each lamp end properly engage the appropriate connectors 50 at the base of the socket. Where key surfaces are used, the insulators would also include key ways in order to match the key surfaces formed in the bore of the socket. Key ways are not shown in the insulators (described more fully below) but it should be understood that they would be included where key surfaces are used for alignment or for engagement of parts.

The expansion socket 46, shown in more detail in FIG. 8, accommodates contraction and expansion of the base 38 due to environmental factors as well as accommodates differences in the tolerances of various components and also variations in mounting arrangements for the clips 40. The expansion socket assists in providing a lamp and socket assembly having electrical connections that are relatively independent of the particular mounting arrangement used to support the lamp. The expansion socket 46 is essentially identical to the fixed socket 44 except that first and second mounting grooves 66 and 70, respectively, are replaced by a continuous groove 93 and undivided by any ridge 71. The socket is supported by the clip 40 in such a manner that the expansion socket 46 can still rotate within the clip and also move longitudinally relative to the clip to accommodate expansion and contraction and other effects such as vibration. Aside from the fixed and expansion sockets having different mounting grooves, they are otherwise identical in structure, function and in the preferred embodiment.

Other alternatives are available for attaching the conductors 52 to the socket. For example, the socket can include clips similar to those on tombstone-style sockets for accepting and holding solid wire conductors. These clips are then electrically coupled to the slotted connectors 50. Another alternative includes conductors 52 terminating in a connector 52A (FIG. 1), such as a Molex connector, for connecting the conductors 52 to a mating Molex or other connector from the ballast. Alternatively, the conductors 52 can be connected to the socket through a plug mounted or imbedded in the socket. For example, the plug could be a Molex-type connector in the socket. A Molex-type connector also provides a low impedance, relatively high current density form of connection, thereby ensuring a reduced impedance as seen by the electronic ballast. Using a Molex or comparable connection contributes to the entire lighting circuit having a relatively higher conductivity and one which is believed to be more closely matched to the electronic ballast.

Other alternatives are available for supporting the socket and lamp. For example, the socket can have slots or grooves extending longitudinally along the surface of the body to allow movement of the socket during expansion or contraction, for example. While slots might limit full rotational movement of the socket, the expansion and contraction resulting from environmental conditions occur most noticeably in the longitudinal direction. Slots in a socket would still permit longitudinal movement.

The sockets described herein provide for an independent means of supporting and providing electrical connection for the lamp. The sockets are rotatably and/or longitudinally movable relative to the base or substrate by which the lamp and socket assembly is supported, and they could be movable in other directions as well, while still maintaining the desired electrical connection and the desired protection for the connection. This permits the socket and the electrical connection to move relatively to the mounting substrate so that the socket becomes more a part of the bulb than the mounting structure. The socket also provides for universal positioning of the lamp independent of the lamp length or the center-to-center distances of the sockets. The sockets also provide for lower labor and material costs and permit easier installation and repair and replacement of lighting elements. The light arrangements can be mounted in any physical orientation and can accommodate a number or variety of support hardware, such as clips, hangars and the like. The sockets permit variants in pin alignment, lamp length, pin length and differences in other lighting element features. The sockets described also provide for linear socket and pin electrical contact and for a larger surface area of electrical contact than has existed in some other pre-existing designs.

The sockets described herein also provide protection from the environment such as moisture, especially in cold environments where moisture may condense or freeze on the connection between the lamp and the socket by providing a closed environment about the electrical connection. The sockets also provide thermal insulation for improving the efficiency of the operation of the lamp or other lighting element, and reduces the impact of vibration and other mechanical forces. The sockets float with expansion and contraction of the substrate or base material, thereby reducing the effects of bending or canting occurring in conventional socket designs. The sockets also maximize conductivity and electrical connection between lamp pins and socket connectors, and provide mechanical support for the lamp. They also may include indicators, keys, or other signs to assist in assembling and connecting the various components of the lighting system. The sockets are usable with newer as well as conventional ballasts, lamps, and the like, especially those having higher voltages, frequencies and currents.

A lighting element, in the preferred embodiment shown as a longitudinally extending fluorescent lamp, preferably includes insulators 94 (FIGS. 4, 5, 8 and 10) insulating the conductive pins to minimize the possibility of electric shock if the conductive pins are live. If one end of a lamp is connected to a live wire, the other end could be charged, resulting in electric shock, injury or damage, if the other end comes into contact with a person or hardware. The insulator 94 is intended to minimize the possibility of electric shock or damage. The insulator may also protect the contact pins from the environment and from damage to the contact pins during handling and shipment of the lamps.

In the preferred embodiment, an insulator covers each end of the lamp as well as the conductors on each end. In this way, the pin conductors are recessed in the insulator and so that they are inaccessible except through an appropriate connection, such as that shown in the sockets with the connectors described herein. The insulator is also preferably formed so as to provide an interference fit with the pins on the lamps to inhibit removal of the insulator from the lamp.

The insulator 94 (FIGS. 3, 4, and 8) preferably includes an insulator top surface 96 and an insulator bottom surface 98 to match the relatively flat surface of the lamp end. The height or thickness of the insulator is preferably large enough to cover and recess the lamp pins below the surface of the insulator by at least a sixteenth of an inch. The insulator is preferably cylindrical in cross section to match the outer configuration of the lamp to which it will be attached. The desired diameter of the insulator depends on the particular design and the relative dimensions of the O-ring and the other components forming the socket and lamp combination. The diameter of the insulator is preferably large enough to suitably align the lamp as it is being inserted in the socket, but still permit withdrawal of the lamp with the insulator past the O-ring during lamp exchange without leaving the insulator behind in the bore of the socket. Preferably it is about the same diameter as the metal end cap for the lamp.

The insulator 94 shown in FIGS. 3, 4, and 8 is a configuration intended to be used with a T8 lamp and to be used with sockets suitable for T8 and T5 lamps. However, other configurations are possible to accommodate other lamp configurations. The insulator need not be a dual lamp design. The insulator includes first bores 100 extending entirely through the insulator from the top surface 96 to the bottom surface 98. The diameter of the first bores 100 are preferably less than the outside diameter of the pins on the T8 lamps, and preferably by an amount sufficient to make it difficult to remove the insulator under normal conditions without some effort. For example, for a pin outside diameter on the T8 lamps of 0.090 inches, the inside diameter of the first bores 100 are preferably approximately 0.076 inches or of a sufficient diameter to ensure a reliable interference fit between the insulator and the lamp. The reduced diameter ensures an interference fit between the pins and the insulator to inhibit removal of the insulator from the lamp, and to insure that the pins remain recessed in the insulator and protected from environmental conditions.

The insulator 94 further includes first counter bores 102 (FIGS. 3 and 8) extending almost the entire length of the insulator but not entirely, leaving sufficient material to form a membrane 104 (FIG. 3) which serves to grasp the pins on the lamp. The first counter bores 102 are dimensioned so as to provide sufficient clearance for the slotted connectors 50 when the socket is placed over the lamp while still providing an interference fit sufficient to push the barbs into the insulator material.

The insulator, when used with a socket which accommodates two different sized lamps, may have second bores 106 and second counter bores 108 (FIGS. 3 and 8) providing clearance for inserting the insulator into the socket having four slotted connectors 50. The second counter bores 108 will fit over the slotted connectors 50 included in the preferred embodiment for the T5 lamp so that the slotted connectors 50 for the T8 lamp can engage the pins on the T8 lamp. It should be understood that the second bores 106 need not be formed all the way through the insulator, but may be a blind hole terminating at the membrane, since there are no corresponding pins or projections on the T8 lamp which they need to accommodate. The blind holes would have the same diameter as the second counter bores 108, and would be substituted for the second counter bores 108 to accept the connectors 50B that will not be used when a T8 lamp is in place. Similar configurations can be incorporated into an insulator so that the lamp can be used with a socket that accommodates other lamps, such as T-10 and T-12 lamps.

In the preferred embodiment, the T8 insulator fits down flush against the end face of the T8 lamp, as shown in FIG. 5. Preferably, the membrane 104 fits down over and around the flared base of each pin 54. Additionally, if the socket did not extend over the neck or the glass portions of the lamp, the insulator 94 could include a skirt (not shown) which defines a bore into which the neck portion 110 of the T8 lamp fits into. A skirt on the insulator would fit over the neck portion and could also fit over a portion of the glass surface of the lamp to provide thermal insulation and further electrical isolation of the end of the lamp. The skirt could extend over the glass portion of the lamp to further insulate the end of the lamp, such as for insulating the electrode portions of the lamp. Such a skirt would enhance the operating efficiency of the lamp by thermally insulating the electrodes and keeping the electrodes within a narrower temperature range. If a skirt were included on the insulator extending over a part of the glass of the lamp and the socket were to be coextensive with the skirt, some dimensional changes would be made in adjacent parts of the socket to accommodate the larger outside diameter of the insulator.

The insulator or cover reduces or eliminates the possibility of shock due to a failed or compromised connection by providing means for protecting personnel and equipment from electric shocks in case the contacts happen to become live. The insulator or cover may accomplish one or more of the following: Recess the contact pins of a lamp, cover or encircle the contacts, either individually or as a group, as well as the end face of the lamp, cover and/or protect the ends of the lamp, provide structural support for the lamp end, provide thermal insulation for the electrode area of the lamp, and provide a moisture barrier for the lamp ends. One or more of these elements provide thermal and other environmental protection, mechanical and electrical protection for the lamp as well as structural support for the lamp. The insulator or cover may also provide electrical connection for bare wires, a connector such as a Molex connector, or simply provide an interface for a separate socket. Where the insulator or cover provides the primary structural support and enclosure for the lamp end, the insulator or cover may also provide the means for mounting a clip or other support, for supporting the lamp end.

In the preferred embodiment, the insulator 94 is placed over the ends of the fluorescent lamps prior to shipment. The lamps are then installed on a new or pre-existing fixture having the sockets described herein by removing the sockets from their respective clips. The lamp and insulator are then aligned with a socket, such as by sight or by aligning a mark on the lamp with a suitable indicator mark on the socket so that the pins 54 of the lamp will engage the appropriate slotted connectors 50 in the socket for the particular lamp. The lamp and insulator are then inserted into the bore of the socket past the O-ring seal 60 until the connectors engage the pins 54 and the internal surfaces of the first counter bores 102. The lamp is inserted further into the socket so that the slotted connectors 50 slide over the pins 54, ensuring suitable electrical conduction through a wiping action. When the lamp is fully inserted into the socket, the top surface 96 of the insulator abuts against the base wall 88 of the socket, the pins 54 are fully seated in the slotted connectors 50 and the O-ring seal 60 is slightly compressed to form a suitable seal completely around the glass or other surface of the lamp 42 as part of a closed environment defined by the socket. This procedure is followed for both the fixed socket 44 and the expansion socket 46, after which the two sockets are engaged with the clips 40, which have been suitably positioned on the base 38 so the lamp and socket assembly can be supported on the base 38.

After assembly, the fixed socket 44 (FIG. 5) and the expansion socket 46 (FIG. 8) form a socket and lamp combination wherein the insulator covers the end of the lamp and the conductive pins in such a way that they inhibit the removal of the insulator from the lamp. The socket has a socket body 48 including electrical connectors 50 for contacting the conductors on the lamp. The socket body preferably extends beyond the base of the pins on the lamp to provide thermal and environmental protection for the lamp and for the lamp-socket connection. Also in the preferred embodiment, the socket provides moisture and thermal protection for the lamp, such as through the O-ring seal 60, and also provides protection against vibration and other impact forces. In the embodiment shown in FIGS. 4, 5 and 8, the socket and the O-ring seal provide structural support for the lamp as well. The support grooves 66, 70 and 93 provide expansion and contraction support for the socket and lamp assembly, particularly where the base 38 may undergo significant contraction and expansion due to environmental effects. For example, for a 72-inch lamp, the base 38 may contract or expand several eighths of an inch between the clips holding the socket and lamp assembly, causing conventional sockets to bend and possibly break or compromise the connection between the lamp and socket in such a way that a high open circuit voltage could exist or cause arcing or overheating of the lamp or socket. Any expansion or contraction in the lighting assembly shown in FIG. 1 is accommodated by the expansion socket 46 and the relatively long groove 93 engaged by the clip 40. The fixed socket is preferably positioned in such a way to permit the foreseeable contraction as well as expansion by positioning the clip holding the expansion socket in such a way as to permit both contraction and expansion. The grooves also help to absorb some of the effects of vibration. The O-ring seal and the socket also help to minimize any relative movement between the lamp and the socket.

The lamp and insulator assembly as well as the lamp and socket assembly provide enhanced safety for personnel, customers, and technicians, and is more compatible with electronic ballasts. The assembly is relatively unaffected by longitudinal dimensional changes or variations either in installation, assembly or during operation, maintaining an improved connection between the conductors and the lamp. The assembly is less likely to be affected by contamination accompanying cleaning, moisture from humidity or other environmental elements and temperature changes. The sockets can be mounted on either one or both ends, but it is conceivable that a traditional socket can be used on one end of the lamp while using the expansion socket, for example, on the other end. In many respects, the socket can be considered as part of the lamp, with very little movement, if any, between the socket and lamp under many circumstances. Depending on the methods of attachment of the clips to the base, universal positioning of lamps of many sizes and configurations can be accommodated with the socket and lamp arrangement of the present invention. This assembly can accommodate different center-to-center distances. The design also permits lower labor and material costs and easier repair and replacement less prone to error or damage. The positioning of the sockets need not be on a fixed center dictated by the lamp length, and the sockets can use clips, hangers, or other mounting elements for positioning the sockets on the lamps and supporting them on an appropriate base structure. The sockets also allow for variances in pin alignment or lamp length while providing good electrical contact between the lamp pins and the slotted connectors in the socket. The electrical contact is preferably created by linear sliding contact and pin connection, producing, after complete connection, a good peripheral contact around the pins. Additionally, the use of the linear connection arrangement between the lamp pins and the slotted connectors provides for greater surface area of electrical contact, thereby reducing the current density flowing between the connectors and the lamp pins. Therefore, for longer lamps and higher lamp currents, the connection is less subject to overheating, failure or other effects because of the higher current. The sockets can also accommodate different sized lamps, such as T8, T5 and T3 lamps, as described more fully below, and the same features described with respect to the sockets can be used to make a socket that can accommodate both T-10 and T8 sized lamps, T-10 and T-12 sized lamps, or other combinations of lamp sizes and features. Additionally, the use of the insulators minimizes the possibility of an exposed hot lamp contact, even if the other end of the lamp is connected to a live socket. This minimizes the possibility of electrical shock due to high open circuit voltage.

In an alternative embodiment, the insulator 94 can include metal or other spring-type disks or plates embedded in the membrane 104 to inhibit withdrawal of the insulator from the lamp. The plates include circular walls extending into the first bores 100 in order to contact the lamp pins as they extend into the first counter bores 102. The plates or disks are preferably separated and unconnected as to each other to ensure that no short occurs between the two pins on the lamp. The disks are intended to bite into the metal of the pins as the pins are inserted through the openings in the disks. The inside diameter of the openings in the disks are preferably smaller than the outside diameter of the pins on the lamps so that the material of the disks flare upwardly in the direction of the insertion of the pins. The flared portions will then bite into the material of the pins and substantially inhibit removal of the insulator 94 from the lamp. In one preferred embodiment, each disk in the insulator fully encircles the first bore 100. Alternatively, each plate could be a semicircle or square plate positioned at the outer side of each first bore 100 so that the two plates are spaced as far apart from each other as possible, thereby minimizing any possible shorting between the two plates. The plates could be included in the membranes during molding or other production of the insulator.

The insulator is preferably formed from a suitable plastic insulating material with sufficient structural integrity to withstand the environmental conditions experienced in such lighting fixtures and to withstand the currents and voltages occurring in these fixtures. The insulator may be formed from the same material as the sockets. The sockets are preferably formed from suitable plastics or other materials currently found in conventional sockets, for example those for fluorescent lamps. For example, rigid thermoplastics are preferred for the socket material for the body, particularly for ensuring the strength, dielectric strength and mechanical integrity of the socket and that would take advantage of properties of conventional thermoplastics suitable for socket design. Preferably, the socket is made from a material as rigid as conventional sockets, such as phenolics and urea and engineering thermoplastics capable of withstanding high temperatures, such as for example 600 or 700 degrees F. The material known as Ertalite may be a suitable material for the socket and for the insulator and Lexan 500 and Ultem 1000 are preferred materials as well. The O-rings are preferably selected from a suitable material able to withstand the temperature extremes found in these lighting systems, for example, silicone or Teflon O-rings are available that withstand very wide temperature extremes.

Key ways may also be used, if desired, to assist in inserting the lamp and insulator into the sockets. For example, the internal surface of the wall of the socket can include a key surface and the insulator can include a key groove for mating the insertion of the lamp and insulator within the socket. Indicator marks or lines can also be included on the socket to facilitate proper joinder of the socket and the lamp. The alignment and mating of the various parts may also be made easier by providing draft, sloped or ramped surfaces. For example, the counterbores 102 and 108 may each diverge toward their respective openings to make alignment with the socket connectors easier.

The fixed socket 44 and the expansion socket 46 can accommodate different sized lamps, such as a T5 lamp in addition to a T8 lamp. As shown in FIGS. 9 and 10, the fixed socket accepts an adapter having a cylindrical sleeve 114 and a flanged rim 116 for engaging and seating in the bore of the fixed socket 44. The sleeve includes an inwardly extending rim 118 for guiding and supporting the neck 120 of a T5 lamp (FIGS. 9 and 10). A seal and tight fit are formed on the internal surface of the rim 116, through an O-ring 122, which extends within an O-ring groove 124 to provide support and a seal for the T5 lamp 126. The sleeve 114 and the O-ring seal 122 have functions similar to the wall 58 and O-ring seal 60 relative to the T8 lamp 42 described with respect to FIG. 5. The adapter 112 is reliably held in place by the O-ring seal 60 compressed between the O-ring groove 62 and a complimentary O-ring groove 128 formed in the outer surface of the sleeve 114, below the rim 116.

The adapter 112 also includes one or more key ways 130 for engaging the key surfaces 92 on the inside surface of the bore in the socket. The key ways 130 and the key surfaces 92 ensure proper orientation of the pins on the T5 lamp with the appropriate slotted connectors in the socket. The appropriate slotted connectors in the socket are the second set of two slotted connectors different than the first set of slotted connectors used by the pins on the T8 lamp. The slotted connectors for the T5 lamp are closer together and have a smaller center-to-center distance than the spacing of the slotted connectors for the T8 lamp.

The T5 lamp 126 (FIGS. 9 and 10) is combined with a T5 insulator 132 having a pair of first bores 134 for sliding over and engaging the corresponding pins on the end of the T5 lamp. The internal diameter of the first bore is preferably approximately 0.076 inches for an approximately 0.090 inch pin diameter to ensure a good friction fit. The T5 insulator 132 also includes first counter bores coaxial with the first bores 134 having similar internal diameters and lengths relative to the counter bores in the T8 insulator 96. The counter bores are formed to accommodate the diameter of the slotted connectors in the socket.

The T5 insulator 132 also includes second grooves 136 and second counter grooves 138 to accommodate the slotted connectors corresponding to the T8 lamp connection. The second grooves 136 and second counter grooves 138 are included to permit the T5 lamp 126 and T5 lamp insulator 132 to engage the socket without having the slotted connectors corresponding to the T8 lamps interfere with the connection between the T5 slotted connectors and the T5 pins during seating of the lamp in the socket. The second grooves 136 can be omitted entirely because there is no corresponding pin that will extend along the groove. The dimensions and spacing of the first bores and first counter bores 134 in the T5 insulator are substantially the same as the second bores 106 and second counter bores 108 in the T8 lamp insulator 96. The same comments apply with respect to the grooves 136 and 138 relative to the bores 100 and 102 in the T8 insulator. The overall outside diameter of the T5 insulator 132 is smaller to permit insertion of the insulator and T5 lamp into the adapter 112 to be sealed by the O-ring 122 and to engage the socket as shown in FIG. 10.

The adapter for the T5 lamp can be replaced by the T8 insulator, attached to the T5 lamp to insulate and protect the pins and end of the lamp. The T8 insulator and T5 lamp can then be inserted into the socket and connection made. While the O-ring would not be contacting the lamp and therefore sealing the interior of the socket, the T5 lamp would still have an insulator that would minimize the possibility of open circuit voltage shock and would still permit connection of the T5 lamp to the socket. The other benefits of using the insulator and sockets with a T5 lamp would then be achieved.

Other key way or indicator arrangements may be provided for minimizing any possibility of mismatch between two different lamp designs or two different lighting arrangements. For example, alternative embodiments could include a key mechanism between the internal surface of the socket bore and the outside surface of the T8 lamp pin insulator. Additionally, a similar key arrangement could be provided as described above for the T5 adapter when it is inserted in the bore of the socket. An additional key arrangement can be provided between the insulator for the T5 lamp and the T5 adapter to ensure the reliability of the fit between the T5 adapter and the lamp. An indicator or key can also be provided on the outside of the T5 adapter so that the pins of the T5 lamp can be properly positioned in the socket so that proper electrical connection can be made. For example, an indicator can be placed around the perimeter of the rim 116 on the T5 adapter to match up with an indicator on the end face 64 of the socket.

In a preferred embodiment, the engagement of a lamp pin 54 with a slotted connector 50 expands the diameter of the slotted connector 50 so that the barbs 78 press into and engage the wall of the insulator 94. (See FIG. 11). The engagement of the barbs with the insulator wall enhances the integrity of the electrical connection and the lampsocket connection. The barbs inhibit the withdrawal of the slotted connector from the insulator, and therefore inhibit disconnection of the lamp from the socket. The combination of the barbs and the interference fit between the insulators and the lamp pins provide a further obstacle to disconnecting the lamp from the socket. The barbs inhibit removal of the lamp and insulator from the socket, the wiping action of the pins and the slot connectors inhibit removal of the pins from the slot connectors, and the interference fit inhibits movement between the pins and the insulator. Overall, the use and the dimensions of the insulator, pins and connectors and the use of the barbs all combine to make disconnection more difficult. Moreover, the lateral support provided to the electrical connection by the socket and lamp engagement, and the longitudinal support provided by the pins, split connectors, barbs and the insulator and the O-ring seal all contribute to a stable connection that is more difficult to break or compromise.

It should be noted that other configurations of a lamp insulator and socket are possible. For example, the insulator may be included with a sleeve and an O-ring seal extending over a portion of the glass or other body portion of the lamp to provide the environmental seal for the pins and contact portion of the lamp. Preferably, the lamp pin contacts are still recessed within an insulator to minimize the possibility of electric shock from live contact, for example where the other end is connected to a live socket. A socket having slotted connectors can then be coupled to the insulator portion engaging the contact pins of the lamp, while preferably also forming a moisture seal between the socket and the body of the insulator. For example, the seal can be formed by an O-ring seal or an interference fit between plastic surfaces on the insulator portion and on the mating socket portion. Larger component diameters for the socket and/or insulator may be necessary in a configuration such as that just described.

In another alternative to the insulator and socket arrangement, the insulator may cover the end face and a portion of the sides of the lamp to provide the thermal and moisture barrier described above, while also including an electrical transmission or interface connector between the pins and a socket on the insulator for accepting a mating electrical plug from the conductors 52. In another form of an insulator, for example where it could cover at least the end of the lamp, the insulator could include an electrical connection socket, clamp or receptacle to which is attached the solid wires that are typically used in many lighting systems. With such an arrangement, the lamp can be assembled with the combined insulator receptacle and sold, shipped, and thereafter installed as a unit by simply connecting the solid wires to the appropriate receptacles. This is not as desirable as other configurations because change out of the lamp would require removal of the exposed wires from the receptacles, leaving exposed wires.

Considering the clips 40 in more detail (FIG. 12), the clip includes a mounting surface or clip base 140 for being supported by, engaging or mounting to the base 38, preferably so it is fixed relative to the substrate. The clip further includes a web or bridge 142 extending from the clip base 140 to the socket engagement arms 68 so that the lamp and sockets can be supported spaced from the base 38 while still permitting longitudinal and/or rotational movement of the sockets and lamp together. The bridge 142 can be jointed or rotatable relative to the clip base 140 so that the lamp orientation can be set independent of the positioning of the clip base 140 on the base 38. The clip 40 also preferably includes wings 144 at the terminal ends of the attachment arms 68 to permit grasping and spreading of the arms 68 for insertion or removal of the lamp and socket assembly. The attachment arms may take a number of different orientations, and the opening between them may be aligned with the direction of the bridge 142, or may be directed at an angle thereto. For example, the arms may open at 90° from the direction of the bridge 142 to allow sideways insertion of a lamp and socket assembly.

The clip 40 shown in FIG. 12 can be formed from any suitable material capable of resiliently holding a lamp and socket assembly while still allowing rotational and/or longitudinal movement of the socket/lamp in the environment intended for the lighting system. For example, the material could be a thermoplastic or a metal sufficiently strong but resilient to releasably support the sockets and lamp and other hardware that might be included.

The clip 40 can be mounted to the base 38 in a track such as that shown in FIG. 13, and held in position by suitable clips, fasteners, or blocks to limit movement of the clip within the track during normal operations. Positioning of the clip 40 and the track 146 permits essentially universal adjustment of the clip 40 relative to the base 38 to accommodate different lamp lengths and also to more closely position the light source relative to the item or items being illuminated. The track 146 in a preferred embodiment is a longitudinally extending track mounted to the base 38 and preferably extending in a direction parallel to the direction that the lamp extends. The track can be continuous to run the entire length of the lamp, plus some additional distance for adjustment, or segmented to have two units, a first one for supporting one clip, and a second one to support the other clip. Positioning of the clips in a longitudinally extending track permits almost universal positioning and variation in position of the clips 40. Alternatively, clips 40 can be mounted in one of a plurality of transversely extending tracks (not shown), whose length in the transverse direction is approximately the same as the width of the clip base 140 as shown in FIG. 12. This would allow the clip to be removed laterally along the track and repositioned into an adjacent or other like-oriented track spaced in one direction or another from the original track. The clip would then be moved laterally along the new track and centered on the base 38 so that the clips are again realigned to properly position the socket and lamp assembly. Such a track arrangement would provide for more discrete rather than continuous positioning of the clips.

In a further embodiment of the clip and track combination, FIG. 13, the track 146 preferably extends longitudinally in the same direction as the lamp. The clip 150 is preferably formed from a resilient, relatively strong material such as spring steel and biased in such a way that the base portion 152 engages the track 146 when the lamp and socket assembly are held in place in such a way that the clip 150 remains stationary in the track 146. The base 152 includes a flat portion 154 contacting the base of the track 146 and extending laterally to respective bend portions 156 at the side edges of the track, which then bend backward and inwardly toward the center of the track. Before the bend portions 156 meet, they curve backwardly and outwardly into respective curved portions 158 which engage and curve around the grooves of the socket. The curved portions terminate in circular end portions 160 used to grasp and hold the curved portions 158 so that the socket and lamp assembly can be inserted and removed. The portions 160 also permit repositioning of the clip when the socket and lamp assembly is removed. This clip configuration allows for easy adjustment of the lamp centers. After the socket and lamp assembly is removed, the open ends of the clip are squeezed at the same time as pushing down slightly toward the track. The clip can then be slid along the track to the desired position, after which the socket and lamp assembly is reinstalled. This configuration may be used beneficially as well to optimize the illumination of objects based on lamp position.

The clips 40 and 150 form spring biased holders mountable to a mounting surface, such as the track. The clips permit the socket body and contacts to be aligned with the lamp and hold the sockets through resilient arms engaging the socket bodies, preferably through grooves in the socket bodies.

In the preferred embodiment, the inside diameter of the clip 40 is about one sixteenth of an inch smaller than the outside diameter of the first and second grooves in the fixed socket, to ensure a secure fit. For the expansion socket, the inside diameter of the top clip is preferably sized to allow a slip fit between the groove and the clip, to allow appropriate movement between the expansion socket and its corresponding clip, while still holding the socket securely in place.

It should be understood that the drawings are dimensioned to adequately show the features of the invention. However, the relative dimensions of the parts can be modified without departing from the spirit of the invention. For example, one feature of the invention can be modified or its benefit reduced in order to accommodate another goal or function of another feature of the invention. For example, mechanical support of the bulb by the socket and the O-ring can be reduced somewhat by decreasing the overall length of the socket so that the O-ring seals around the bulb closer to the metal neck portion 110. Preferably, the socket still provides some thermal insulation around the electrode portion of the lamp. Reducing the overall length of the socket would also ensure that the maximum amount of illumination from the lamp is achieved. Preferably, the length of the bore into which the lamp is inserted is sufficient to cover the pins and the end face of the lamp as well as covering part of the electrode area of the lamp for thermal insulation. Additionally, the socket material could be of a type, such as an acrylic, a polycarbonate or a Lexan material, that allows light to pass through from the lamp to the outside, to help illuminate the target surface. Alternatively, only that portion of the socket that covers the illuminated part of the lamp could be made of such a translucent or clear material.

The lamps, sockets, lamp and socket combinations, and the lighting fixtures described herein contribute to reducing or eliminating problems caused by contamination from cleaning procedures, repair, replacement and installation procedures and operations, and environmental conditions during operation. It is believed that the inventions disclosed herein reduce the possibility of high open circuit voltage shock or damage and can be used with equipment having higher operating voltages, higher frequencies and higher currents. It is also believed that the inventions described herein are particularly applicable to extreme environmental conditions, such as outdoors, freezer and storage applications, and the like. The expansion and contraction of hardware and the bending of sockets by thermal expansion and contraction or by damage from installation or repair, or by simple miscalculation in positioning is easily accommodated by the present inventions. Environmental conditions such as high humidity and icing are also minimized by the present inventions. The described inventions also accommodate different lighting elements, different sizes of lighting elements and other variations in lighting systems. They also account for vibration and other mechanical effects, such as may be caused by wind, heavy traffic, repair replacement and cleaning, stocking, and the like, wherein in the past such vibration or mechanical impact may have caused disconnection or withdrawal of lamp pins partially from sockets. It is believed that the present inventions maintain good integrity electrical contact and damp any effects of vibration. As a result, it is believed that the effects of these problems in conventional systems such as arcing, potential electric shock, and the like, is reduced or eliminated.

To assemble a lighting system such as that described herein, mounting clips 40 (or 150) are attached to or mounted on a substrate 38 either fixedly or adjustably, such as in a track 146 such as that shown in FIG. 13. An appropriately sized lamp and corresponding insulator and socket are assembled by placing an insulator over each end of the lamp and ensuring the insulator is relatively fixed on each end of the lamp. A first end of the lamp is then inserted into the bore of a socket, using whatever indicators or guides may be provided until the pins of the lamp engage the slotted connectors in the base of the socket. A good wiping action is achieved as the pins enter the conductors 50 and the barbs 78 are pushed out to engage the material of the insulator, as shown in FIG. 11. Similar steps are followed with respect to the socket and insulator for the other end of the lamp. The socket and lamp assembly is then mounted through engagement with the clips 40 (or 150) in such a way that the expansion socket engaging its clip has sufficient room to move to accommodate any expansion or contraction of the substrate or base material 38. The procedure can be modified accordingly if the insulator is designed to also cover portions of the end of the lamp and a simple connector is to be used to connect the conductors 52 to the pins 54.

To adapt to a lamp of a different or small size, such as a T5 lamp, insulators are placed on or over the ends of the lamp and the respective sockets fitted with appropriate adapters. The fitting of the adapters to the sockets can be made easier by the use of appropriate keys, indicators or other signs for proper alignment. The sockets and bulbs are then assembled and mounted to an appropriate substrate in a manner similar to that previously described. The length of the adapter is preferably sufficient to provide guidance for the T5 lamp as well as the structural support for the end of the lamp.

A lighting system for a refrigeration unit is one application of the embodiments of the present inventions, and while it is representative of the extreme conditions in which a lighting system is often operated, it is not the exclusive application for the present invention. The present inventions may find application in lighting systems for outdoor illumination, storage boxes, underground lighting systems, as well as cold storage rooms and other refrigeration units. However, the description herein will be directed primarily to refrigeration units. While the lighting system is not limited in its use to refrigerated display cases, the discussion herein will be directed to lighting circuits in such cases because of the many considerations relevant to lighting circuits that are demonstrated by reference to such cases. Simply by way of illustration, these considerations include low temperature, use of fluorescent lamps, use of electronic ballasts, humid enviroments, vibration, impact and jarring, as well as others. It should also be noted that, as mentioned above, the inventions can be combined together or be used separately to achieve their respective results. Many if not all are independently useful and do not necessarily depend for their usefulness and value on other aspects of the inventions, but they are also combinable to provide results having greater benefit than any one alone. However, combining several of the inventions has particular application to the area of refrigerated cases.

Figure 15:
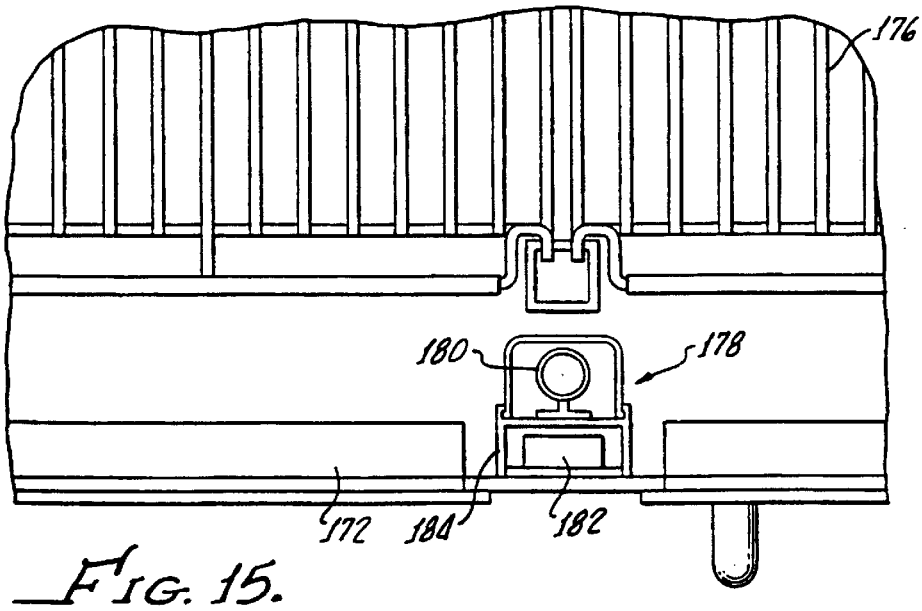
FIG. 15 is a partial schematic and partial horizontal sectional view of part of a refrigerated case showing a lighting system mounted therein.

Thus, in accordance with one aspect of the present invention, the lighting system can be used in a refrigerated display case 170, typically including doors 172 set in a surrounding frame 174 for enclosing product (not shown) displayed on shelves 176. Such display cases are commonly found in grocery stores, convenience markets, and the like. As shown in FIG. 15, the display case would include a lighting system 178 for illuminating product stored on the shelves 176 for display. Customers can access and remove product through the doors 172 (shown schematically in FIG. 15). The lighting system typically includes a light source 180, such as a fluorescent lamp having a cathode and anode and a discharge gas contained in the tube between the cathode and the anode. A ballast 182 may be positioned inside a mullion 184 or elsewhere in the case to drive the fluorescent lamps. The ballast can be wired in the conventional manner, as known to those skilled in the art. In one form of the invention, the lighting system would include a socket and an insulator to help protect the lamp and socket connection over the life of the fixture. In a further preferred form of the invention, the invention would include components and structure selected in such a way that they were relatively matched with the ballast characteristics, and/or components which meet or exceed the operating levels of the circuit.

Figure 14:
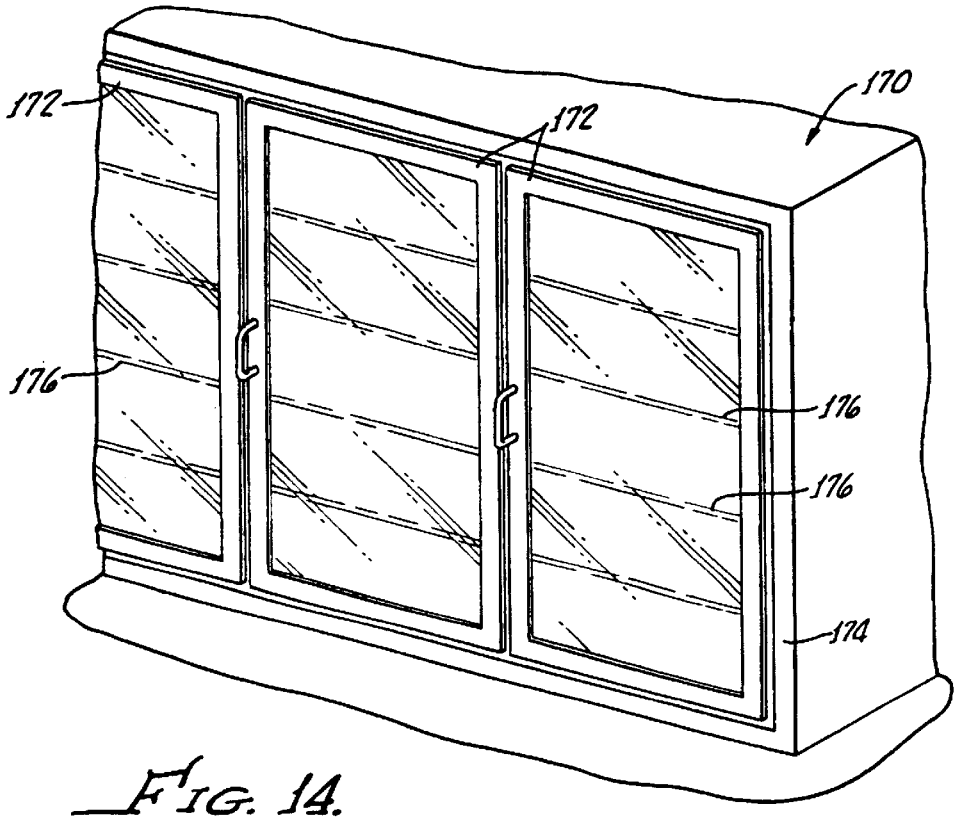
FIG. 14 is perspective view of a refrigeration case as one example of an application for a lighting system, and one which is subject to environmental extremes and vibration and other effects.
Figure 16:
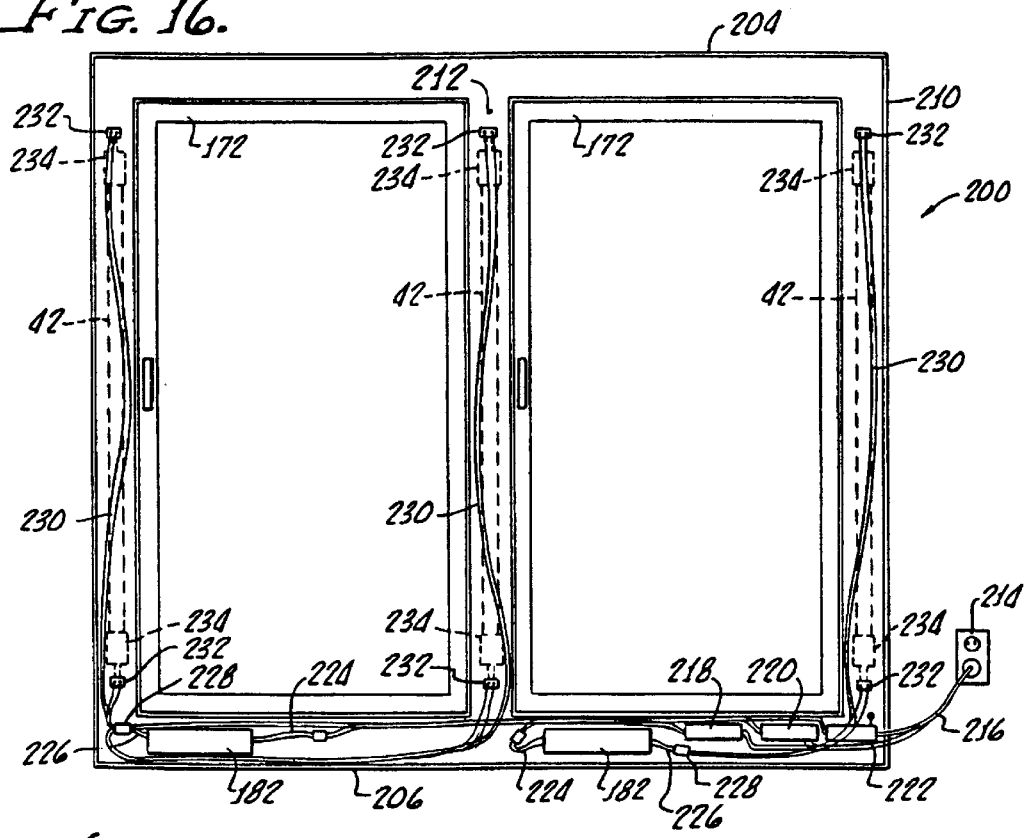
FIG. 16 is a partial schematic and front plan view of an uncovered frame assembly showing an electrical circuit for driving lights (not shown) in one application of aspects of the present inventions.

More specifically, a lighting system can be incorporated into a display case 200 (FIG. 16) to illuminate an area, such as a refrigerated display case including shelves or other product display areas. The case 200 could be identical or similar to the case 170 shown in FIG. 14 with any number of applications, or could have any number of different configurations. The case 200 shown in FIG. 16 shows the metal or other flame elements 202 which would be set into a net opening or into a case structure. The frame may include an upper horizontal frame member 204, a lower horizontal frame member 206, a left vertical frame member 208 and a right vertical frame member 210. The frame shown in FIG. 16 corresponds to a two-door frame and includes a mullion 212, providing a portion of the frame for the doors and providing a support for a portion of a lighting circuit. The number of doors in a case is generally determined by the size of the case and, likewise, the number of lamps is also determined by the size of the case. However, a given lighting circuit could have as few as one lamp or two or more lamps, depending on the circuit configuration. In addition, each lighting circuit has its associated components, the number of which will depend on the circuit and the design. For purposes of the present discussion, the description herein will be directed to a lighting circuit having three lamps.

The lighting circuit is powered typically from line voltage provided by a standard electrical source represented by socket 214 from which electrical energy is obtained by a conventional cord or cable 216. The line source voltage may be 120 volts or 240 volts, depending on the local standard, operating at 60 or 50 Hz, respectively, and drawing conventional currents. The frame on the case may include a positive bus bar 218 to which is connected the hot cable from the power supply and a negative bus bar 220 to which is coupled the neutral cable. A ground strip 222 is also included for connecting to earth ground. The bus bars and the ground strip can be placed at any conventional location on the frame or elsewhere in the case. In addition to supplying electrical energy to other components in the case, the bus bars are the source of electrical energy for the one or more ballasts 182 mounted in a case. In the frame shown in FIG. 16, the ballasts are mounted in a recessed cavity in the lower horizontal frame member 206 with incoming conductors 224 connecting the ballasts to the respective bus bars 218 and 220.

The ballast or ballasts are preferably electronic ballasts such as those for driving T8 and T5 fluorescent lamps. These ballasts typically operate by producing a high voltage and high frequency output from the line voltage at the input. For example, the ballast can produce an oscillating output signal as high as 60 or 160 kHz or more with an open circuit voltage as high as 600 or 800 volts. The current draw from the bus bars could be as high as one or two amps, and the output current depends upon ballast design, which is a function of the wattage of the lamp and the number of lamps to be powered by the ballast. It should be understood that other ballasts, including electromagnetic ballasts, can be used in these lighting circuits, but their use is typically limited to T10 and T12 lamps.

In the case of electronic ballasts, the ballast operates as a constant current component for driving the fluorescent lamps in order to maintain a constant current through the lamp under a variety of operating conditions. For example, in low temperature applications, the lamp exhibits a higher impedance, requiring a higher voltage to drive a current through the lamp to produce the desired amount of light. Additionally, as time passes, the light output gradually decreases and the impedance of the lamp may increase in such a way that the ballast tries to maintain the same current flow, thereby resulting in an increased voltage on the output of the ballast. Consequently, it is believed to be important to reduce other possible sources of variation of the circuit in such a way that the lamp is the only component changing over time. Additionally, it is also believed to be important to match as closely as possible the components in the circuit to the ballast design so that the ballast does not overwork in trying to drive the lamp. Additionally, because some ballasts operate at relatively high voltages under some circumstances, it is desirable to ensure that the components of the lighting circuit are properly rated.

Each ballast includes a plurality of output conductors, preferably 16 or 14 gauge solid wire or better, at least one of which is a hot conductor and one of which is a neutral conductor. The output conductors are generally designated 226. The ballast wires 226 preferably terminate at one or more Molex-type connectors 228 for providing a reliable, high conductivity, low impedance, low resistance and high current density-capable connection for supplying electrical energy to the rest of the lighting circuit. Molex-type connectors are preferred for their improved electrical connection. However, other connections can be made for supplying electrical energy to the remainder of the lighting circuit. The Molex-type or other connectors are preferably rated for the desired voltage, current and impedance or resistance to best match the circuit for the ballast and also to minimize any adverse electrical effect on the lighting circuit due to these components.

One mating half of the Molex connector 228 is coupled to the ballast conductors 226 and the other mating half is coupled to mullion or frame conductors 230 forming part of the lighting circuit and for carrying electrical energy between the respective ballast and a respective lamp, described more fully below. The conductors are preferably rated for the desired voltage, current and resistance. The frame conductors 230 are in turn connected, in the preferred embodiment, to respective Molex-type connectors 232, preferably having the same electrical characteristics as the connectors 228. While it is not necessary, each lamp preferably includes a panel-mounted connector 232 adjacent each end of the lamp (see FIG. 18) to facilitate installation and removal of the lamp and socket assembly. As shown in FIG. 18, one half of the connector or junction 232 is mounted through an opening 234 formed in a wall or panel 236 to which it is relatively rigidly mounted, fastened or otherwise secured. Alternatively, the connector 232 may be free-floating. The socket clips 40 are also preferably mounted to the wall 236. The connectors 232 form an electrical bridge between the frame conductors, ballast conductors, and the contacts in the lamp sockets. The connectors 232 preferably have the same electrical and physical characteristics as the connectors 228. The stationery part of the connector 232 is identified as 232A. The other half of the connector, identified as 232B, is coupled to the conductors 52 so that electrical energy can be supplied to the socket 234 for energizing the lamp 42.

The ballast 182, ballast conductor 226, ballast connector 228, frame conductor 230, frame connector 232, socket conductor 52, socket 234 and lamp 42, along with the complimentary components starting at the other end of the lamp form a lighting circuit for driving and illuminating the lamp. While two connectors 228 and 232 are included on each side of the circuit, it is conceivable and possible to eliminate one or more of the connectors and still have an operating circuit. However, if all of the connectors are eliminated, the lighting circuit would be essentially permanently wired and ballast failure or lamp socket failure in a theoretical circuit without any connectors would require complete replacement of the entire circuit or installation of appropriate connectors upon replacement of a ballast or a socket. The ballast connector is preferred so that ballasts can be exchanged or replaced, and the frame connector 232 is preferred so that the lamp assembly of lamp 42 and socket 234 can be easily installed, removed and replaced or modified without affecting the balance of the lighting circuit. The fewer the additional components, the more likely it is that the circuit functions as intended and without adverse electrical effects on the operation of the ballast or lamp, but where additional components are added, they are preferably configured and designed so as to add as much conductivity and as little impedance, resistance and voltage drop to the circuit as possible. The result would be a circuit that has improved ballast performance, lamp performance, longer ballast life, longer lamp life, lower component temperatures (such as for the ballast), and/or a better matched circuit. It is also possible that any number of connectors can be used in the lighting circuit, but they preferably do not affect appreciably the impedance of the circuit as seen by the ballast, result in minimal voltage drop and are reliable circuit components. It should also be noted that the terminology used for these components and parts of the circuit, such as "ballast" conductor and "frame" conductor are chosen for ease of description and clarity, but do not indicate any functional or design requirement or restriction.

Figure 17:
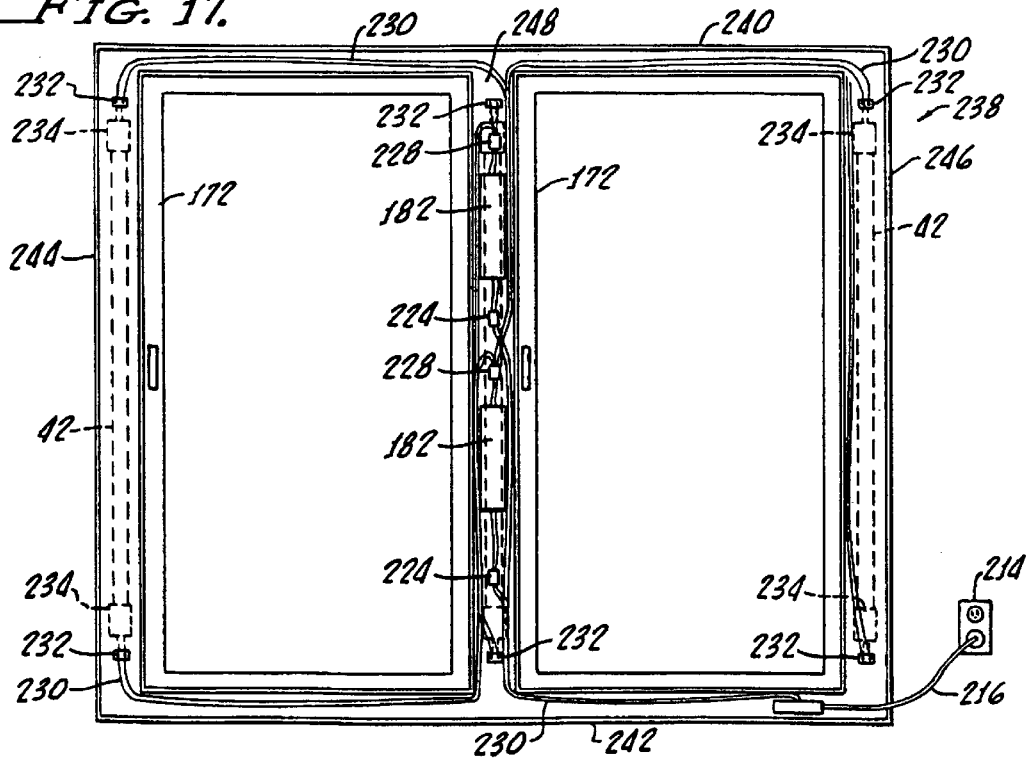
FIG. 17 is a partial schematic and front plan view of an uncovered frame assembly showing a lighting circuit for providing electrical energy to lights (not shown) in accordance with an application of the inventions similar to that of FIG. 16.

The sockets 234 and the lamps 42 are shown in phantom FIGS. 16 and 17 since they are on the interior sides of the frames. The frames shown in FIGS. 16 and 17 are schematic, as are the doors 172, and are intended to show the environment in which the lighting circuits are placed and operated. Typical frames have additional hardware, surfaces and the like for being retained in an opening of a case and for other purposes.

Figure 16C:
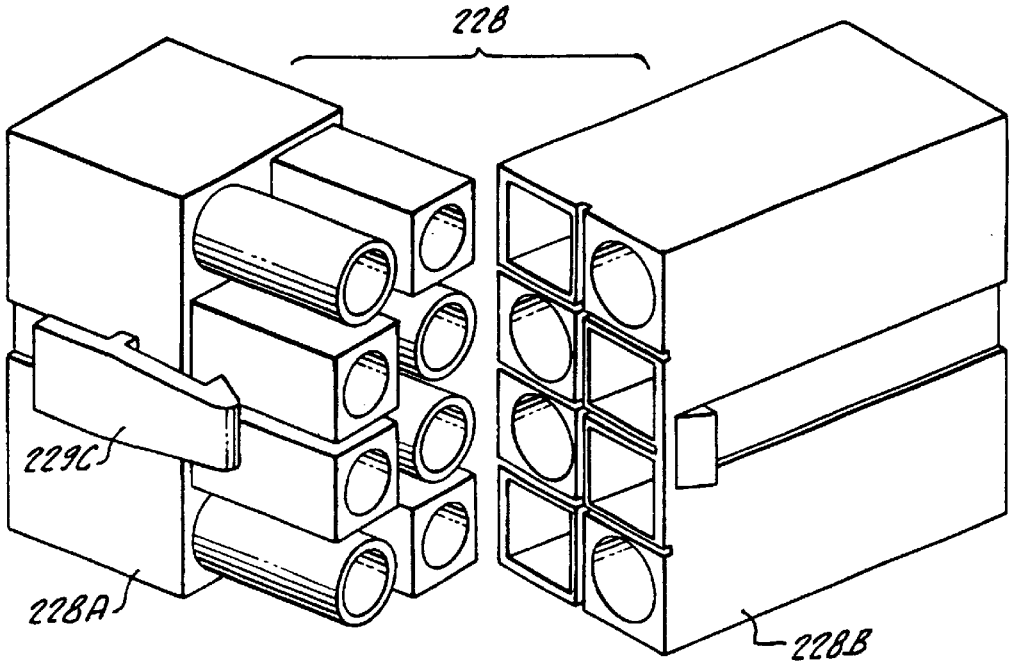
FIG. 16C is a perspective view of a connector assembly used for connecting ballast conductors to lamp conductors.

The connector 228 (FIGS. 16A–16C) connect ballast conductors 226 to frame conductors 230 and include a ballast plug 228A for coupling with a ballast receptacle 228B. The conductors 226 are crimped or otherwise fixed or soldered to a sleeve connector 229A, which connects to a pin connector 229B in the ballast receptacle 228B. The connector 229A and pin 229B can include prongs or barbs for holding the sleeve and pin in place. A latch 229C holds the plug and receptacle in electrical connection during normal operation. The contact sleeves 229A are preferably fixed inside of round and/or square-shaped sleeves to isolate the connectors 229A. The receptacle 228B preferably includes corresponding square or round internally-shaped sleeves to accept the correspondingly shaped sleeves on the plug. The pin contacts 229B (FIG. 16B) are preferably recessed within the corresponding sleeves in the receptacle 228B.

Figure 16D:
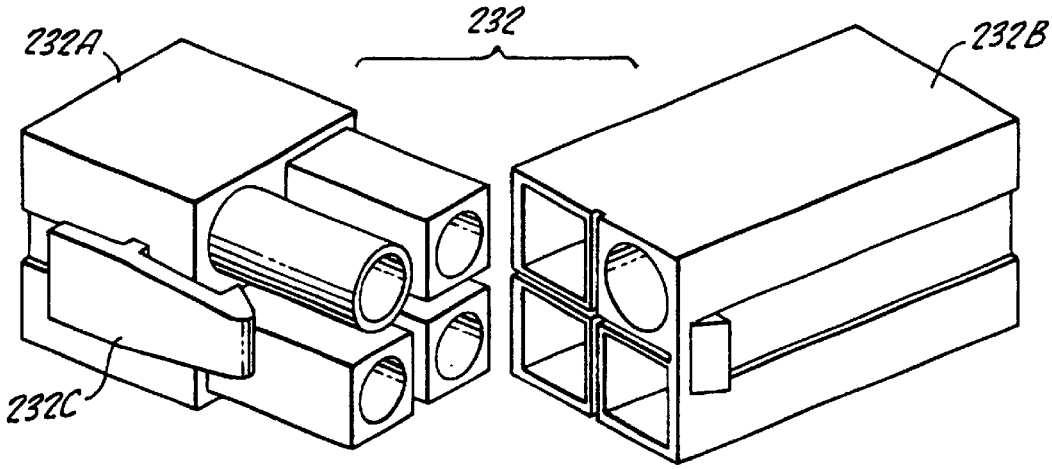
FIG. 16D is a perspective view of a ballast connector for use with a single lamp ballast.

FIG. 16D shows a ballast connector for a single lamp ballast having four ballast conductors for coupling to four frame conductors.

In addition to the sockets 234, described more fully below, the circuit between the respective ballast and its lamp, preferably has a low impedance, low voltage drop and relatively high conductivity and current density capability. Any number of means can be used to accomplish this purpose in the conductors and connectors between the ballast and the lamp. As to the conductors, 16 gauge solid wire is suitable and acceptable for this purpose.

The frame assembly schematically shown in FIG. 17 includes an upper horizontal frame member 240, lower horizontal frame member 242 and a left vertical frame member 244 and right vertical frame member 246. The ballasts 182 are mounted on the mullion member 248 and supply electrical energy to the lamps 42 on the frame end portions and on the mullion 248.

In order to improve the conductivity and electrical characteristics of the connection between the ballast circuit and the lamp, the conductors 52 (FIGS. 21 and 22) are electrically coupled to lamp connectors with a high contact surface area, low impedance and low resistance coupling, so that the ballast does not see an appreciable impedance relative to the lamp. To that end, conductors 52 are preferably coupled to intermediate conductors 250 and 252 in FIG. 21 and 254 and 256 in FIG. 22 through preferably mechanical contact and/or through solder 258/259. While the electrical coupling can be made in other ways, this configuration of the conductors and solder is believed to provide a relatively high conductivity and current density capability, low impedance and low voltage drop between the conductors 52 and the lamp. The higher conductivity reduces the likelihood of socket heating, and ballast problems. In one preferred embodiment, the conductors 52 extend downwardly through the opening in the end cap 80, and one conductor 52A is bent to extend into and rest in one of the wireways 76 (see FIG. 7) and the other conductor 52B is also bent to extend into and rest in the other wireway 76. The conductor 250 is also bent, and one leg of the conductor 250 preferably contacts and extends alongside the exposed metal conductor of conductor 52A, both of which are surrounded by solder 258. The other leg of the conductor 250 extends into and is clamped or otherwise crimped or contacted by a contact 260 for maximizing the surface area of contact and the conductivity of the connection. The exposed conductor 52A also preferably contacts and is electrically coupled to the conductor 254, which is bent and has one leg which rests in and extends along the same wireway as conductor 250. The first leg of conductor 254 also preferably contacts the conductor 52A and is surrounded by the solder 258.

The exposed conductor of 52B also is bent and extends into and rests in the opposite wireway 76. The conductor 252 is preferably bent into two legs, one of which extends into the other wireway 76 (FIG. 20) contacting and electrically coupling with the exposed conductor of 52B as well as being surrounded by solder 259. Likewise, conductor 256 is bent into a first leg portion which extends into and along the same wireway as conductor 252 and preferably contacts and electrically couples with the exposed conductor 52B and is surrounded by the solder 259. The second leg of conductor 252 preferably contacts and is clamped, crimped, or otherwise held in the connector 262 for maximizing the surface area of contact between conductor 252 and the contact 262 for maximizing the surface area of contact between the elements and the conductivity of the connection. The second leg of conductor 254 is also crimped, or otherwise held in the contact 264 also to maximize the surface area of contact and conductivity. The second leg of conductor 256 is also clamped, crimped or otherwise held in contact 266, also to maximize the surface area of contact and conductivity. It is desired to maximize the surface area of contact between the conductors 52 and their respective contacts in order to increase conductivity in the connection and to minimize any impedance that may arise due to low surface area of contact, to maximize the current density capability of the connection and to provide a more reliable electrical connection between the conductors 52 and the socket 234. It is believed that the higher surface area of contact between the conductors and the socket contributes to a lower temperature of the socket during operation and a lower ballast temperature as well. It is believed that a better electrical connection between the conductors and the socket reduces any apparent impedance as seen by the ballast, either as occurs at initial startup or after extended operation. The conductors 250 and 254 and the conductors 252 and 256, respectively, may be the same conductors bent into a square-shaped U configuration, the legs of which extend into the respective contacts and the bases of which rest in the respective wireways.

An alternative connection arrangement for the conductors 52 may include the exposed conductive portion of the conductor 52A extending into one of the contacts, such as contact 260, and being crimped. The conductor 254 in the other like-polarity portion of the socket would be crimped in contact 264 and have its leg extend outwardly into and along the wireway 76. Preferably the leg of conductor 254 would contact the exposed conductor of 52A and be surrounded by the solder 258 to ensure adequate electrical coupling between the conductor 52A and conductor 254. For the opposite polarity, the exposed conductor of 52B extends into and is crimped by the contact 262. The conductor 256 extends into and is crimped by contact 266, the other leg of the contact extending into and along the other wireway 76, preferably contacting the exposed conductor 52B and being surrounded by the solder 259. Other electrical coupling arrangements between the conductors 52 and socket 234 are possible for increasing the surface area of contact and the conductivity but extended longitudinal and circumferential or arcuate electrical contact is preferred.

To maintain the higher conductivity in the socket conductors between conductors 52 and the lamp pins 54, the contacts 260, 262, 264 and 266 extend to longitudinally and circumferentially contact respective lamp pin extensions 268, 270, 272 and 274. The contacts 260, 262, 264 and 266 are preferably identical to the contacts 50 of the FIGS. 2, 4–6, 10 and 11, except for possibly the length thereof. Where the connectors 260–266 are cylindrical but split connectors, the contact is not a full 360° around the circumference of the pin extensions. However, it is preferred that the maximum surface area of contact be achieved to increase the conductivity and current density capability of the connection, to minimize any contribution of the socket to any impedance as seen by the ballast, and to provide an acceptable linear wiping action as the connection is made between the lamp assembly and the socket. It should be noted that similar benefits can be achieved by omitting the pin extensions 268–274 and connecting the lamp pins 54 directly to the contacts 260–266, as represented by the connections shown in FIGS. 5, 10 and 11. However, use of the pin extensions provides for components and an assembly with a higher voltage rating, as discussed more fully below.

In the preferred embodiment, the pin extensions 268–274 are mounted on and fully enclose the pins 54 on the lamp. As with the connection between the contacts 260–266 and the pin extensions 268–274, the surface area of contact and the tightness of the contact between the pin extensions and the lamp pins are preferably maximized in order to maximize the conductivity, current density capability, reduce any impedance as seen by the ballast, and enhance the ability of the connection to be maintained under operating conditions. Preferably, electrical coupling between the conductors 52 and the lamp pins 54 is accomplished in such a way that the surface area of contact, conductivity and current density capability are maximized, the voltage drop is minimized and/or the resistance across the socket is minimized, preferably resulting in a minimal impedance attributable to the socket as seen by the ballast. For example, the pin extensions can be formed on a progressive die and the material could have a thickness of about 0.0143 inch for preferred conductivity.

It is believed that one or more of these functions and purposes are achieved in the sockets 44 and 234. In the socket 234, the contacts 260, 262, 264 and 266 are preferably comparable to the contacts 50A and 50B in the socket 44, having a substantial crimp area shown at 276 in FIG. 1 for ensuring a relatively high surface area of contact extending both circumferentially and longitudinally. The contacts 260–266 are positioned in the base 56 of the socket and extend outwardly past the end wall 88 in the embodiment shown in FIGS. 21 and 22. Whether or not the contacts extend outwardly of the end wall 88 will depend upon the dimensions of the base 56, the lengths of the contacts, and the relative dimensions of the pins 54, the pin extensions 268, the lamp insulator, described more fully below, and the existence or non-existence of contact barriers, also described more fully below.

The pin extensions 268, 270, 272 and 274 are included in order to ensure good electrical contact between the socket and the lamp pins 54 when a higher voltage rating is desired. The pin extensions accomplish this electrical coupling by forming a circumferential and longitudinally extending surface area of contact between the pin extensions and the respective contacts 260–266, as well as a similar form of contact between the pin extensions and the lamp pins 54. It is believed that it is the material of the contacts and pins as well as the extent of the contact surface area that will determine the quality of the contact, the conductivity and the voltage drop across the connection, and the impedance as seen by the ballast attributable to the connection. It should be understood, however, that the pin extensions can be eliminated or reduced in size while the socket can still have an electrical connection having the desired characteristics, for example by increasing the length of the lamp pins, or somewhat increasing the length of the contacts 260–266. Additionally, the pin extensions can be eliminated, while leaving the lengths of the lamp pins and the contacts 260–266 substantially unchanged and still achieve electrical contact which is improved over conventional lamp contacts.

Figure 21:
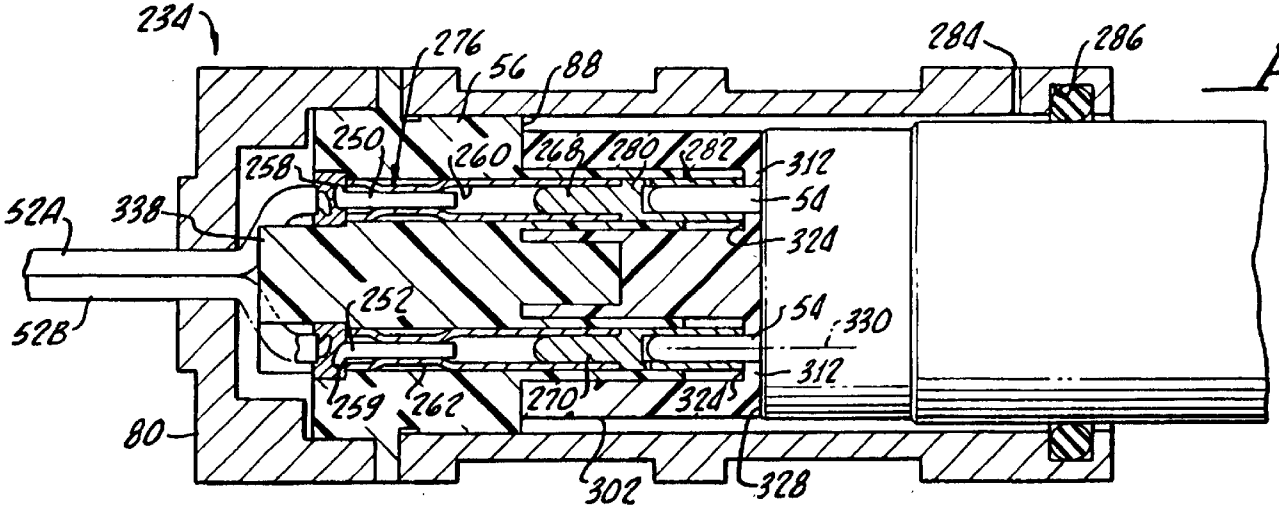
FIG. 21 is a perspective view of a socket in accordance with another aspect of one of the present inventions.
Figure 22:
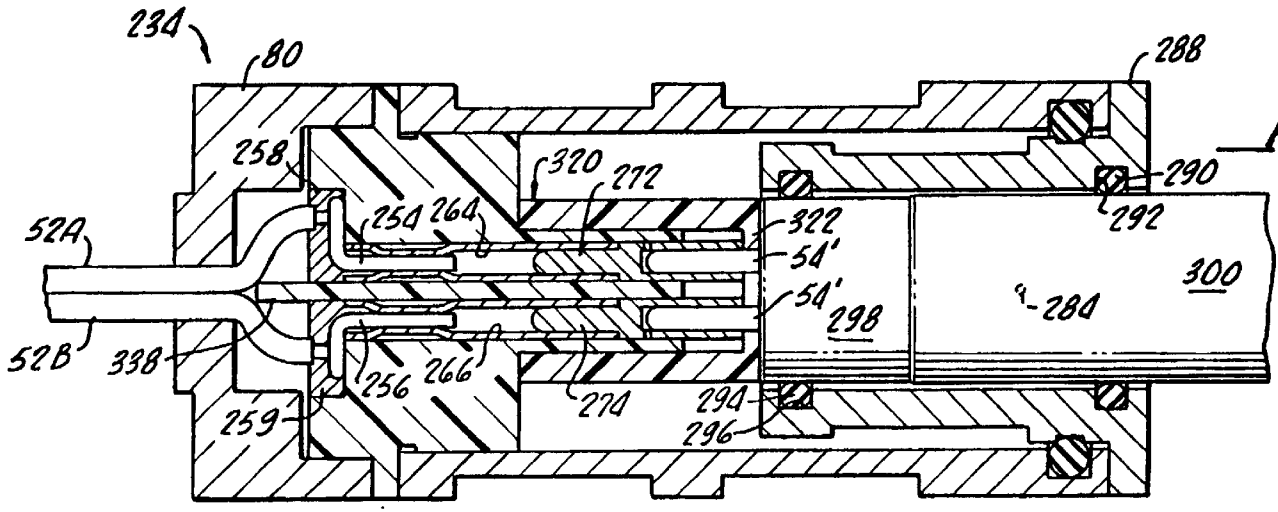
FIG. 22 is an enlarged cross-sectional view of a socket in accordance with further aspects of some of the present inventions.

As seen in FIGS. 19, 21, and 22, the pin extenders preferably have a bullet-shaped portion 278 for engaging the internal surface area of the respective contact, such as contact 260. The forward portion of the pin extension preferably includes a rounded tip for facilitating engagement between the pin extension and the corresponding contact 260. The forward section terminates in the other direction in a base section 280 (FIG. 21) from the bottom of which extends a cylindrical sleeve 282 for encircling and contacting a respective lamp pin, such as lamp pin 54 (FIG. 21) on the larger-sized lamp. The cylindrical portion 282 preferably extends entirely around and contacts the entire circumferential surface of the pin 54 for as much of the longitudinal length of the pin contacted by the pin extension. It is believed that the high surface area of contact achieved by the circumferential or at least extended or substantial arcuate contact between the pin extensions and the lamp pins, as well as between the arcuate surfaces of the pin extensions and the contacts 260–266, increase the conductivity and the current density capability of the socket, reduce the voltage drop across and resistance of the socket as well as the impedance of the socket as seen by the ballast. The arcuate contact between the crimp portions 276 of the contacts and the conductors 250–256 also contribute to this result.

Other configurations of the contacts between the conductors 52 and the pins 54 are possible in order to achieve the high conductivity, contact surface area, and current density capability, and low resistance, low voltage drop and low impedance. For example, the pin extensions can take the form of a two-ended cylindrical sleeve, one end to engage the lamp pin and the other cylindrical sleeve to engage a complimentarily-shaped pin electrically coupled to a respective conductor 52. Preferably, however, one or more of the benefits is achieved in order to provide a more reliable socket for fluorescent lamps, especially those used with electronic ballasts.

In the preferred embodiment, the socket 234 also includes a small pin hole 284 preferably only large enough to permit passage of air out of the interior of the socket barrel as the lamp is being inserted into the barrel. The socket housing is sealed sufficiently well, and the O-ring seal is close enough to limit or entirely preclude air passage out of the socket. Upon lamp insertion, sufficient pressure could build up inside the socket to inhibit complete connection or which may bias the lamp outwardly of the socket. The pin hole 284 can be placed in a number of different locations, and may be placed in one of the grooves 66 or 70 so that the clip covers up the hole after the socket is inserted in the clip. Additionally, the pin hole can be placed in the O-ring groove so that the O-ring can serve as a slight impediment to passage of particulates and moisture. The pin hole may be placed adjacent the corner 286 of the groove farthest from the rim of the socket.

The socket 234 shown in FIG. 21 is connected to a larger-sized lamp, such as a T8 lamp discussed previously. The socket 234 is shown in FIG. 22 as connecting to a smaller lamp, such as a T5 lamp using an adapter 288. The embodiment of the adapter 288 shown in FIG. 22 includes a first outer O-ring 290 in an O-ring groove 292 and a second O-ring 294 in a respective O-ring groove 296. The dimensions of the O-rings and the O-ring grooves can be identical, or the second O-ring groove 296 can be slightly shallower where the lamp end cap 298 has an outside diameter slightly less than the outside diameter of the glass envelope 300 of the lamp.

As with the socket 44, the socket 234 shown in FIGS. 19, 21 and 22 can be formed or assembled in a number of ways. The socket can be molded or machined in three parts, as shown in FIGS. 19, 21 and 22, or the base and barrel can be molded or machined as one piece and the end cap mounted, fastened or adhered onto the remainder of the socket in another step. The entire socket can also be molded as a single part, and the adapter molded separately. As with the socket 44, the socket 234 can also have a number of shapes while still achieving one or more of the intended results.

The lamp pins 54 are protected by an insulator 302 having generally the same characteristics as the insulator 94 shown in FIG. 4, but having slightly longer dimensions as discussed more fully below. The insulator includes a first opening 304 (FIG. 19) and a second opening 306 for accepting the pins 54 on a larger lamp, such as a T8 lamp. The insulator also includes opening 308 and opening 310 for accepting the pins 54' of a smaller lamp such as a T5 lamp. See FIGS. 21 and 22. The openings 304–310 pass through a membrane 312 (FIG. 21) to counterbores 314 and 316 for accepting the contacts 260 and 262, and their respective protectors (described more fully below) from the socket. The openings 308 and 310 extend to an oval-shaped counterbore 318 (FIG. 20) for accepting the contacts 264 and 266 and their respective protector (described more fully below) from the socket. The openings 304–310 are preferably sized to form an interference fit around the respective lamp pins. Where an adapter such as 288 is used with a T5 lamp, the openings 308 and 310 can be omitted since the insulator 302 would not be used with a T5 lamp. Instead, a smaller insulator 320 (FIG. 22) would be used to protect the pins 54' of the T5 lamp. The respective openings in the membrane 322 of the T5 lamp protector 320 are also preferably sized so as to provide an interference fit with the lamp pins 54'. The external shape of the T5 insulator 320 is approximately the same as that for the T5 insulator 132 shown in FIG. 9, but somewhat longer.

The bases 324 (FIG. 19) of the pin extenders 278 preferably bottom out and seat against the membrane 312 in order to hold the insulator 302 in place on the T8 lamp. The frictional engagement between the sleeves 282 of the pin extenders about the pins 54 help to hold the lamp protector 302 in place. The bases 326 of the pin extenders for the T5 lamp bottom out and seat against the membrane 322 of the T5 lamp protector 320 to hold the lamp protector 320 in place on the T5 lamp. The frictional engagement between the sleeve portions 228 of the T5 lamp pin extenders help to hold the T5 lamp protector in place.

In one preferred embodiment, a lamp and a contact protector such as protector 302 or 320, form a lamp assembly. The lamp includes a surface, such as surface 328 (FIG. 21) from which the pins 54 extend. As in conventional bi-pin lamps, the pin surface for electrical contact extends substantially completely around an axis 330, thereby providing a large surface area for electrical contact. The contact protector 302 shown in FIG. 21 and protector 320 shown in FIG. 22 extend completely around the pins 54 and 54', respectively, and extend from the base of the lamp. The contact protectors extend a distance from the base parallel to the axis 330, preferably, and in such a way that the contact is accessible for electrical coupling substantially completely around the entire circumference of the contact. For the protector 302, such as shown in FIG. 20, the internal diameters of the counterbores 314 and 316 are preferably sufficiently large to accommodate both the contacts 260 and 262, and also their respective protectors, described more fully below. Preferably, the pins 54 are circular cylindrical and the portions of the contacts 260 and 262 which engage the pin extenders are also circular cylindrical. While, other shapes and configurations are possible, complimentary mating shapes are preferred.

In order to improve a lighting circuit, such as may be used in a refrigerated display case, especially those for use with fluorescent lamps and/or electronic ballasts, components in the circuit are preferably designed to operate under the extremes of foreseeable circuit conditions to be expected for the circuit. Preferably, the components such as sockets 44 and 234 are capable of operating at the currents, voltages and frequencies of the circuits in which they are placed. In ordinary electromagnetic ballast and fluorescent lamp circuits, currents are in the milliamp and amp range, voltages in the 120 or 240 range and frequencies are line frequencies such as 60 or 50 Hz. With fluorescent lamps using electronic ballasts, the circuit connected to the ballast output sees voltages as high as 600 and 800 volts, currents as high as one or more amps, and frequencies as high as 130 or 160 kHz (kiloHertz).

The protectors 302 and 320 are preferably formed and dimensioned to be rated for 1,000 volts. Additionally, the pins 54 and 54' and/or the pin extensions 268–274, to the extent they are used, are recessed a sufficient amount to protect personnel from shock or other injury if a lamp end is live. Therefore, the length of each protector 302 and 320, along the longitudinal axis, is preferably sufficient to have the pin extenders recessed by approximately 0.246 inches below the respective surfaces of the insulators. The contacts are recessed in amounts sufficient to prevent contact by a probe 0.205 inches in diameter. The protectors are preferably molded of an insulating material, and may be the same material as that from which the socket is formed. The pin extenders in FIGS. 19, 21, and 22 are preferably recessed the 0.246 inches below the surface of the protector for both the T8 and T5 pin extenders. If the lamp pins were longer, so that pin extenders can be eliminated, the same recessed distance is preferably incorporated into the dimensions of the protector. The amount of the recess is determined by the desired depth-over-surface distance (at least 0.50 inch for a 1000 volt rating) that an electric arc would have to travel to reach an opposite terminal. In the socket described, the shortest distance will be between the tips of the T5 contacts in the socket and across the surface of the material of the protector between them.

The pin protectors 302 and 320 shown in the drawings are relatively substantial cylindrical masses. However, the protector or insulator for each pin can be separate insulators such as sleeves positioned or formed around the pins. Additionally, other configurations of protectors can be considered, but it is still preferred to provide full circumferential contact around the lamp pins in order to have a relatively large surface area of contact between the pins and the socket. The pin protector can be a plastic sleeve, shaft, tube or other shape, and can be circular cylindrical, oval or have other shapes.

The 0.246 inch recess of the pins below the surface of the protector provides, especially for the T5 lamp pin spacing, the minimum distance which an arc would have to travel in order to go from one T5 lamp pin to the other. That distance is preferably large to minimize the possibility of arcing. For the T5 lamp and protector assembly, the distance would extend from the tip of one pin or pin extender, if used, to the surface of the insulator, across the surface of the insulator to the counterbore for the other pin or pin extender and then down to the tip of the pin or pin extender, if used. This distance would be the shortest distance between the contacts on the T5 lamp. The same path would also define the shortest distance between the pins or pin extenders for a T8 lamp, but the shortest distance to a pin of opposite polarity would be to the nearest adjacent T5 pin of opposite polarity. The preferred distance of 0.5 inch total surface distance and 0.246 inch recess apply to a 1,000 volt rating, and other distances may apply for ratings for different voltages.

The socket 234 also preferably includes contact protectors to reduce the possibility of electric shock or other injury to personnel or property. As shown in FIGS. 19, 21, and 22, the base 56 includes a contact sleeve 332 for surrounding and extending beyond the respective contact 260, and a protector, sleeve, tube or other enclosure 334 for protecting the respective contact 262. Where the respective contacts 260 and 262 are split sleeve hollow contacts, the protectors preferably fit snugly around the outside surfaces of the contacts, since no clearance is necessary between the contacts and the protectors. In the case where the socket is designed to accommodate different sized lamps, or in any case where other contacts are included, additional protectors are included as needed. In the socket 234, designed to accommodate two different sized lamps, an additional protector 336 extends around and beyond the ends of the contacts 264 and 266. The socket contact protectors can take any number of shapes and configurations, but preferably accommodate the shapes of the contacts within and accommodate the shapes of the equipment or components they engage. For example, as shown in FIGS. 19 and 20, the outer configurations of the protectors 332, 334 and 336 compliment the shapes of the counterbores 314, 316 and 318 in the insulator 302. The protectors 332–336 extend from the surface 88 of the base, a distance sufficient to provide the desired recess for the contacts. Where the desired recess is 0.246, in the configuration of the sockets shown in FIGS. 19, 21 and 22, the amount of recess is determined by the spacing between the two T5 contacts. Since the T5 contacts are closest together, compared to the T8 contacts, the desired voltage rating will determine the amount of recess of the T5 contacts. The amount of recess of the T8 contacts is preferably the same so that the amount of electrical contact between the contacts 260 and 262 with the pins or pin extenders on the lamp is the same as the amount of electrical contact surface area for the T5 connectors and pins. The protectors provide a barrier between the contacts so that they are separated by an unobstructed path no less than the defined arc path length.

The socket 234 also preferably includes a barrier wall 338 (FIGS. 19–22) for increasing the arc path length between opposite conductors in the base 56. The wall preferably includes a plurality of channels 340 to accommodate the dimensions of the insulated conductors 52, on each side of the wall 338. The wall preferably extends a distance above the wireway 76 to define the minimum arc path length desired for the given voltage rating. An opening 342 in the end cap 80 is sized and shaped sufficient to accommodate the barrier wall 338 and the conductors 52, while still maintaining strain relief for the conductors 52 and while still permitting a sufficient seal or closure for the end of the socket.

Each of these barriers contribute to a more reliable and longer life component when used in the environment for which it is designed. For a 1,000 volt rating, where the lighting and ballast circuit does not exceed 1,000 volts, there is less likelihood that the socket would arc or short out because of high voltage potential between relatively closely adjacent contacts. While the barriers around the contacts in the socket are preferably cylindrical, they could also be semicylindrical or have other shapes where the shortest path length for an arc is still maintained according to requirements. For example, the protectors 332 and 334 could be formed each as half cylinders facing each other with the open sides facing away from each other, as long as the shortest arc path length is still maintained, depending upon the voltage rating.

The socket and protector material, including for the lamp, may be made from the same material as the socket 44 and protectors described with respect to FIGS. 1–10, one example being Ertalyte. The material could also be Hytrel, Ultem-GE such as Ultem 1000, a polycarbonate, Lexan such as Lexan 500, urea, or other materials preferably having the same rate and tooling capability for molding. The contacts and other metal components are preferably formed from a suitable material to have the desired conductivity, current density and low impedance such as gold plated bronze phosphate or the like. The Molex-type connectors are commercially available, and high quality conductive materials are commercially available as well. The surface area of contact for the connectors could be in the range of 0.09 square inches for each pin, but the actual surface area of contact may vary according to the lengths and diameters of the pins, contacts, and other components.

The barrier wall 338 is preferably approximately ¼ inch high and approximately 1/16 inch thick. For a 1,000 volt rating, the barrier wall should be a minimum of 0.246 inch above the level of the solder.

Figure 25:
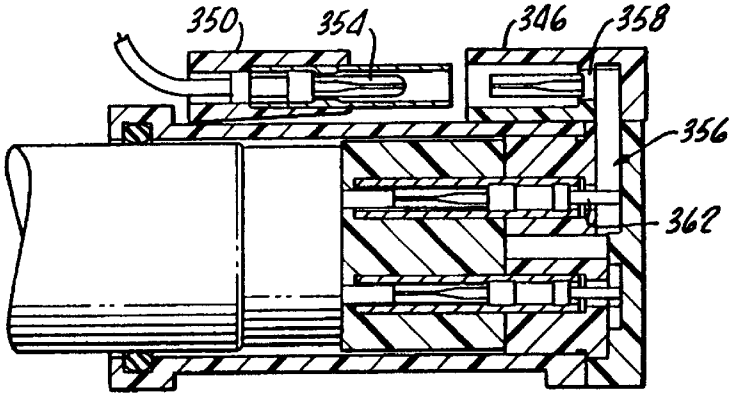
FIG. 25 is a cross sectional view of a further alternative form of socket and lamp connection for a lighting system.
Figure 24:
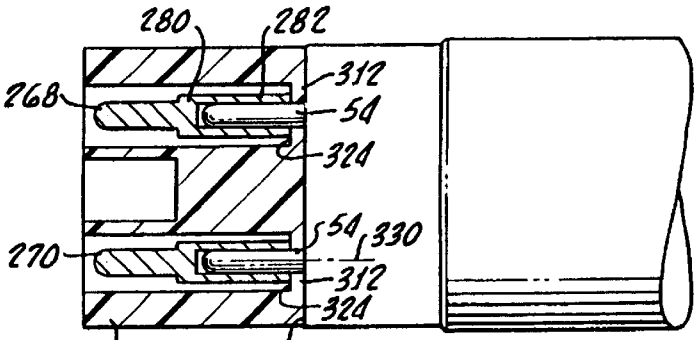
FIG. 24 is a cross-sectional view of a lamp and lamp protector in accordance with further aspects of several of the present inventions.
Figure 26:
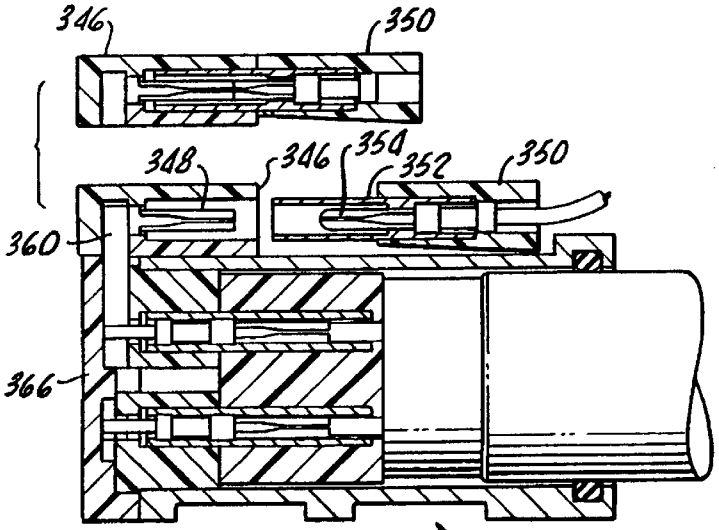
FIG. 26 is a cross sectional view of a fabricated receptacle and plug for connecting electrical energy to a lamp.
Figure 33:
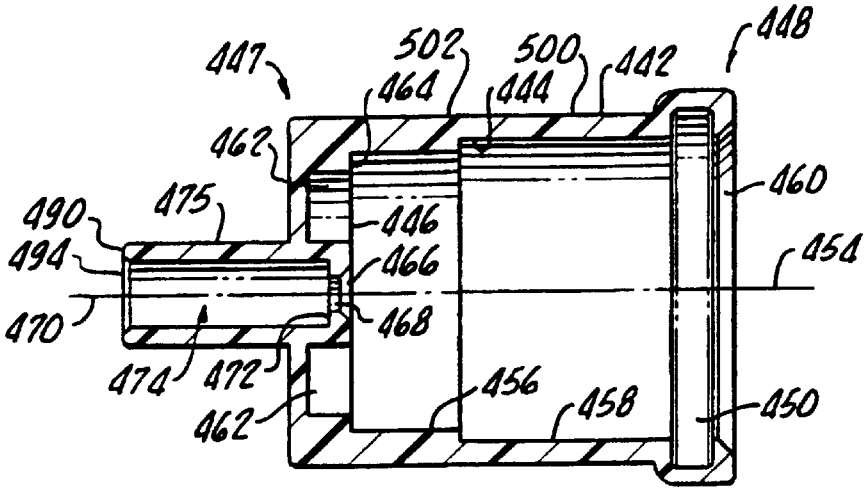
FIG. 33 is a side elevation view and partial cut-away of a lamp adapter in accordance with a further aspect of the present invention.

FIG. 25 shows an alternative socket configuration having many of the same characteristics as the sockets 44 and 234 described previously, but having a shorter profile and having a bus bar arrangement for supplying electrical energy to the cylindrical connectors. The socket 344 includes a laterally extended receptacle housing 346 extending to one side of the socket 344 for housing and covering a pair of cylindrical contacts 348. Only one contact 348 is shown in FIG. 25. The housing 346 is mounted to, formed integrally with or otherwise positioned adjacent the external surface of the socket barrel so that the cylindrical contacts 348 extend longitudinally of the socket, thereby providing a relatively low profile connection for a complimentary mating plug 350 for coupling electrical energy from the ballast to the socket through receptacle 346.

The housing 346 is preferably formed from the same material as the socket body and accepts a cylindrical shield 352 on the plug 350 while the cylindrical contact 348 accepts the corresponding connector pin 354. The protector 352 and the plug 350 may be formed from the same material as the socket.

Figure 27:
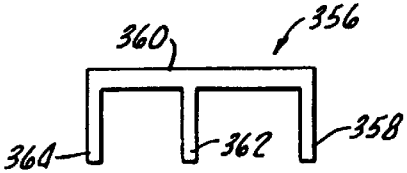
FIG. 27 is a plan view of a conductor for a socket such as that of FIG. 25 for connecting contacts of the receptacle to the contacts of the socket.

Electrical energy is provided to the socket connectors by a bus bar 356 (FIG. 27) having a first arm 358 coupled to the cylindrical connector 348, a common arm 360 for transferring energy from the arm 358 to a second arm 362 for one of the T8 and T5 contacts in the socket, and a third arm 364 for contacting the other of the T5 or T8 contacts having the same polarity. A comparable bus bar 356 is also used to connect the remaining contacts of the T8 and T5 contacts of the other polarity to its respective contacts. Preferably, the contacts are mounted to the respective arms of the bus bar 356 by suitable crimping, bonding or other reliable contact for maximum conductivity. The contacts and the bus bar are preferably metallic, with the bus bar preferably roll formed from bronze phosphate and gold plated at a thickness of about 0.0143 inch but it could be less and still conduct current. The socket, including the receptacle and plug may be formed from the same material as the sockets described previously.

Because the sockets are no longer radially symmetrical, due to the laterally extended receptacle 346, sockets for opposite ends of the lamps are preferably mirror images of each other so that the connectors line up with the pin positions on the lamp. The sockets can be molded, fabricated or formed in any other conventional way. The sockets 344, as well as the sockets 44 and 234 are preferably formed to be substantially and relatively rigid and non-resilient, except to the extent of the use of a resilient O-ring for sealing, in order to ensure that the sockets remain positioned on the lamp as originally placed. A relatively rigid and non-resilient structure also reduces the possibility of misalignment between the lamp and socket, incomplete lamp pin connection and the like.

In order to provide adequate spacing for a 1,000 volt rating, the ends of the common element 360 of the bus bar adjacent the first arm 358 is preferably bent outwardly relative to the adjacent bus bar so that the adjacent ends of the bus bars diverge relative to each other. The common arm of the bus bar 360 is accommodated in the socket in a fabricated part by grooves formed in the cap 366 and in the end of the socket.

The ballast circuit, the components of the ballast circuit, the lamp assembly and its components described herein include elements, one or more of which contribute to improved components and systems. The socket reduces the effects of vibration during shipment, use and servicing, reduces the possibility of inadvertent disconnect or incomplete connection, as well as the effects of differences in manufacturing tolerances and dimensions in components such as lamp length, lamp pin alignment, socket mounting arrangement, and the like. As a result, lamps from different manufacturers having different dimensions or tolerances may be used interchangeably. The effects of different installation procedures from one technician to another is also reduced and the effects of changes in the connection and in the circuit over the lifetime of a lamp are also reduced. The impedance of the circuit as seen by the ballast is reduced and the operating temperatures of one or more components, such as the ballast, is reduced. Lamp output is increased as well. Higher conductivity and current densities can be achieved, and the circuit and components are more reliable and easier to use. The components maintain good electrical contact and are safer and easier to manufacture. It is believed that component life and lamp life may be extended, including ballast lifetime.

In accordance with several further aspects of the present inventions, a lamp 430, lamp adapter 432, and connector 434 (FIG. 28) are shown which enhance the protection of the lamp connection from the environment and which provide a reliable electrical connection between wiring in the lighting system and the lamp 430 for adequately illuminating the lamp. The combination is very suitable for fluorescent or other electric discharge lamps known to those skilled in the art. Such lamps typically have a glass envelope 436 capped at an end or at each end by a metallic or other end cap 438 for sealing the envelope to keep the inner gases and other elements inside the lamp at the proper concentration. The end cap typically includes an electrically insulating plate or disk (not shown) extending across each end surface of the lamp. The end plate may form a base for supporting and separating one or more pins 440 well known to those skilled in the art. The one or more pins are electrically coupled through the glass envelope to a filament (not shown) for producing electrons to produce light within the lamp. While the end of the lamp is shown slightly spaced from the base wall for simplicity of presentaton, it should be understood that the lamp preferably abuts the base wall of the adapter.

The lamp adapter 432 (FIGS. 29–33) adapts the electrical connection portion of the lamp so that the lamp can be supported by a bracket, clip or other surface mount or surface support that can absorb or accommodate variances in lamp length, pin orientation and other tolerances. The adapter also makes it easier for the lamp to continue operating under normal conditions even in the presence of environmental extremes of high and low temperature and the like. The adapter 432 may also protect personnel and equipment from high voltages, the potential for shock, and the like. (It should be understood that the use of the term "adapter" is used in the context of adapting or modifying conventional lamps. However, it should be understood that lamps such as fluorescent lamps by way of example, can be manufactured so as to already incorporate the structures and functions achieved by the use of an adapter placed on the lamp after the lamp is manufactured.)

Part of the adapter 432 which provides the environmental protection includes a plastic or other suitable housing or barrel 442 having an internal wall 444 for encircling and protecting the end portion of the lamp 430 and an internal base wall 446 for closing off the first end 447 of the housing. The second end 448 of the housing preferably includes an internal U-shaped wall 450, or a wall having any other suitable shape, for accepting, supporting or otherwise positioning a sealing element such as an O-ring 452 at the second end 448 of the housing 442. The O-ring 452 preferably extends sufficiently toward the center line 454 of the housing 442 so as to engage and seal with the glass body of the lamp 430, thereby providing an environmental seal for the lamp end at the O-ring 452. The surface 450 can be replaced by suitable grooves or other surfaces and the O-ring 452 can be replaced by other suitable sealing elements such as a washer shape 452A, a chevron configuration 452B and inwardly or outwardly oriented skirts 452C and 452D, respectively, for forming a seal with the glass envelope of the lamp 430.

The interior wall 444 may be configured as a first counterbore 456 positioned and configured to encircle the cap 438 of the lamp. A second counterbore 458 has an inside diameter larger than the first counterbore 456 and is configured to cover and extend around part of the glass envelope of the lamp, and extends from the first counterbore 456 to the wall 450. In the preferred embodiment, the length of the second counterbore 458 is sized so as to extend over the filament of the lamp.

The opening at the second end 448 preferably includes an angled or ramped surface 460 to help in guiding the lamp end into the adapter 432. The surface 460 can take any number of configurations, but preferably terminates adjacent the O-ring 452 so as to have the same internal diameter as the second counterbore 458, and so that the slanted surface does not interfere with the formation of the seal through O-ring 452.

Where the adapter is a molded part, pockets 462 may be formed internally at the first end 447 of the adapter to reduce the weight of and the amount of material in the adapter. Depending on the size of the adapter, the pockets 462 preferably have a maximum inside diameter less than the inside diameter of the first counterbore 456. A ledge 464 formed by the first counterbore 456 and the pockets 462 provide a stop for contacting the end cap 438 on the lamp so that the adapter and the lamp are properly positioned with respect to each other.

The adapter also preferably includes a countersink surface 466 leading into a first bore 468 for accepting a first pin contact on the lamp and for encircling part of the pin. In the preferred embodiment, the first bore 468 is sized in diameter and length so as to provide a snug fit around the base of the lamp pin. The countersink surface 466 is preferably sized and dimensioned so as to permit easy placement of the adapter over the lamp end and to permit the adapter to be fully seated against the lamp end. The first bore 468 is preferably coaxial with an axis 470 The bore 468 is preferably formed in the base 472 of a cavity 474 formed by a sleeve, receptacle, jacket or housing, hereafter termed sleeve 475, extending circumferentially around and longitudinally along the axis 470 so as to protect and insulate the pin contact on the lamp, while still permitting preferably full, 360° electrical contact around the circumference of the pin contact. The inside diameter of the cavity 474 is preferably sufficiently large to permit necessary access to the pin contact by a suitable mating contact, and in the preferred embodiment, it is sufficiently sized to accept an insulator or other housing surrounding the mating contact. The inside wall 476 of the cavity 474 is preferably right circular cylindrical to suitably engage the housing of a mating connector, or may be flared so as to more easily receive the mating connector.

A second countersunk surface 478 and second bore 480 are formed about an axis 482 in a second base wall 484 at the base of a second cavity 486 defined by a second sleeve 487. The second cavity 486 also includes a second wall 488, and the dimensions of these walls and surfaces are preferably the same as the corresponding dimensions of the walls and surfaces of the first cavity 474. The lengths of the cavities 474 and 486 are preferably sufficient to extend beyond the lamp contacts, or to position the lamp contacts or extensions thereof below the end walls 490 and 492, respectively, of the cavities to minimize the possibility of electric shock or touching of the contacts inside the cavities. The lamp contacts, or extensions thereof, are preferably recessed about 0.246 inch below the respective sleeve ends. The end walls 490 and 492 may also include countersink surfaces 494 and 496, respectively, to make easier the connection between the adapter and the connector.

A bridge 498 may, though not necessarily, extend between the end walls 490 and 492 of the cavities to provide stability and help properly position the openings to the cavities. In the preferred embodiment, the cavities are sufficiently long so that the over-surface distance between the tip of one lamp pin contact and the other lamp pin contact is to minimize any electrical arcing or discharge between the pin contacts under the expected operating conditions.

The sleeve 475 and cavity wall 476 define a jacket, insulation, housing, or cylinder around the contact for isolating the contact and for controlling, limiting, or defining the form of electrical contact that can be used with the connector. The end wall 490 and the end wall 492 define an opening into the jacket for permitting access to the contact. The sleeve extends from the base for encircling or enclosing and isolating the contact on the lamp.

A lamp sleeve extends over part of the lamp for holding, surrounding, insulating or encircling part of the lamp. The lamp sleeve may also be adhered or otherwise fixed to the lamp to minimize or prevent removal of the lamp sleeve from the lamp, thereby ensuring some measure of protection for the lamp contact and for personnel if personnel might otherwise come into contact with the lamp pin contacts. The outer surfaces of the adapter may include a first circumferential surface 500 and a second circumferential surface 502 for accommodating one or more spring clips or other mounting apparatus for supporting the adapter and thereby the lamp relative to a base surface (not shown). The base surface could be a wall, beam, mullion or other frame element in a refrigeration unit, or any other support surface to which a fluorescent or other lamp might be mounted or supported. The first and second surfaces 500 and 502 may be coextensive with each other in one embodiment of an adjustable adapter (FIG. 33) which would permit longitudinal movement or expansion of the lamp assembly. In another embodiment of the adapter, the first and second surfaces 500 and 502 may be separated by a wall or other surface 504 extending circumferentially around the adapter to provide a fixed or stationary adapter on the lamp (FIG. 29). The adjustable adapter would not have the wall 504, thereby permitting expansion and contraction of the assembly without affecting the mounting of the assembly relative to the wall or base surface to which the lamp assembly is mounted. Where the clips are horseshoe or U-shaped clips, one or more surfaces 500 and 502 may include a pair of spaced apart and longitudinally extending ridges or bumps 506 suitably positioned circumferentially about one or both of the surfaces 500 and 502 so as to limit or prohibit any axial rotation of the adapter within the mounting clip. The ridges or bumps 506 may be separate discreet bumps or may be connected to each other by a raised surface (not shown). Having a single raised surface, the ends of which define the spaced apart ridges, reduces the likelihood that an adapter will be inserted backward into the clip.

The outside diameter of the adapter may be somewhat larger at the second end 448 because of the material used to form the O-ring groove 450. The wall 508 may also serve as one edge of the adapter for being supported by a spring clip or other mounting element. The first end of the adapter 447 may also include a raised circumferential wall 510 also for forming a stop or other engagement surface for a mounting clip.

Figure 41:
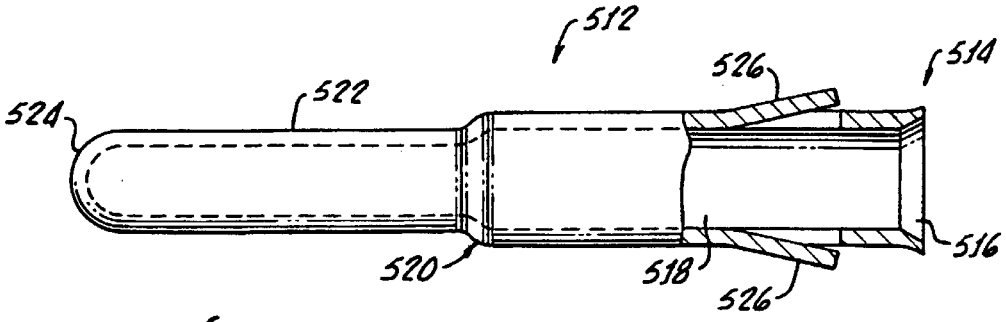
FIG. 41 is a side elevation and partial cut-away view of a pin extension in accordance with a further aspect of the present inventions.
Figure 41A:
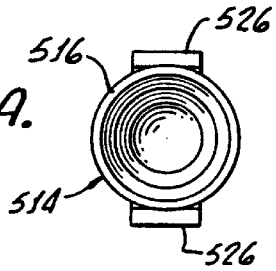
Figures 42, 43, 44, 45:
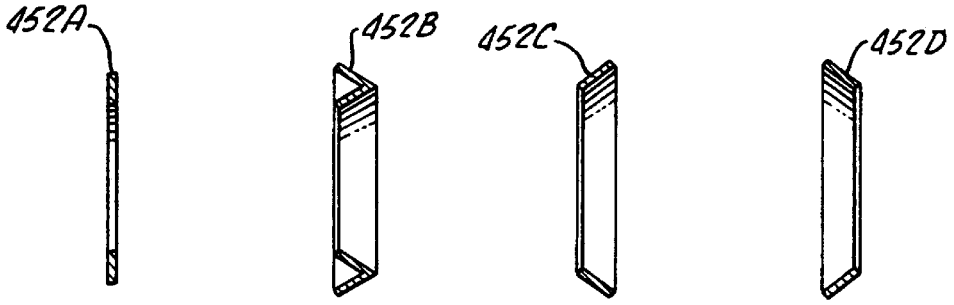
FIG. 42 is a cross-sectional view of a washer-type seal for use with the adapters of the present inventions.
FIG. 43 is a cross-sectional view of a chevron-type seal for use with the present inventions.
FIG. 44 is a cross-sectional view of a skirt for use with the present inventions with the skirt configured to extend to the interior of the adapter.
FIG. 45 is a cross-sectional view of a seal in the form of a skirt with the skirt oriented so as to extend outwardly of the adapter.

If desired, pin extenders (FIG. 41) may be mounted to or used in place of conventional pin contacts on conventional fluorescent lamps so as to increase the amount of electrical surface area available for contact by a connector. The pin extender 512 may include a flared base 514 with a slanted surface 516 to facilitate mounting the pin extension onto a conventional pin contact of a fluorescent lamp. The flared base fits into the countersink surface 466 in the base 464. The pin extender 512 preferably includes a barrel 518 for sliding over and electrically contacting the circumferential surface of the lamp pin and for providing maximum surface area of contact between the internal surface of the pin extender and the external circumferential surface of the lamp pin. The barrel 518 necks down at a shoulder 520 to form a complimentary external pin surface 522 for accepting and electrically engaging a corresponding mating contact or connector surface on a connector. The length and external diameter of the contact surface 522 are preferably such as to ensure maximum electrical contact over a maximum surface area. The tip 524 is preferably rounded so as to permit making the contact easier. One or more barbs or extensions 526 may be included to contribute to the holding of the lamp sleeve or adapter on the lamp. The ends of the barbs 526 may engage the bases 472 and 484 of the cavities on the adapter. The spacing on the pin extender between the barbs 526 and the flared base 514 is preferably slightly larger than the thickness of the base wall between them, by about 10% to 25%. The spacing difference allows the pin extender to snap into the base, permits the pin extender to float in the bore, and makes easier insertion of the lamp pins into the pin extenders. After the lamp pins are inserted, the pin extenders float very little, and preferably not at all. The overall length of the pin extenders may be in the range of 0.580 to 0.693 inch, or greater or less than that range depending on other dimensions. The preferred length may depend on the shape of the contact surface.

With the use of pin extenders, the diameters of the bores 468 and 480 are preferably sufficiently large to permit insertion of the extensions 512 through respective bores up to the flared portions 514. Consequently, the bases 472 and 484 are sandwiched between the barbs 526 and the flared portion 514, which helps to position the pin extensions and also to hold the lamp adapter on the lamp once assembled on the lamp.

Figure 34:
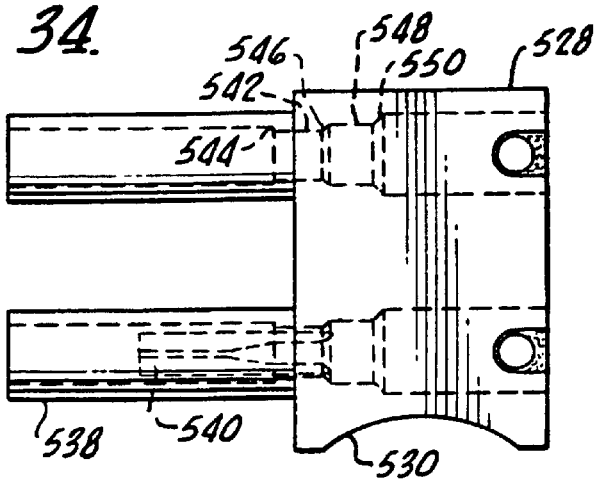
FIG. 34 is a side elevation view of a connector in accordance with a further aspect of the present inventions.
Figure 35:
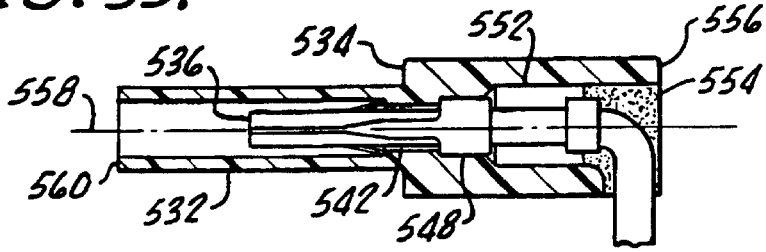
FIG. 35 is a longitudinal cross-sectional view of the connector of FIG. 34.

A lamp connector 434 (FIGS. 34–35) provides electrical energy to the lamp. It includes a base 528 for receiving suitable conductors, such as conductors from a ballast or ballast connector, for providing electrical current to connector pins or connector contacts in the connector. The base supports or holds the electrical contacts or connector pins for engaging corresponding contacts on the lamp. Those contacts may be the lamp pins or lamp pin extensions. Alternatively, the connector contacts can be used to contact and provide electrical energy to lamp pins without pin extensions.

The base 528 is dimensioned and sized sufficiently to provide the desired support for any electrical conductors bringing electrical energy into the connector and any electrical contacts or contact pins that provide electrical energy to the lamp. In the configuration shown in FIG. 34, the base 528 is substantially rectangular in each cross section with an arcuate grip surface 530 on one or more sides to facilitate gripping of the base of the contact.

The base also preferably includes one or more contact sleeves, jackets, protectors, housings, or insulators 532 for isolating the connector contacts. The sleeves also limit access to the contacts to ensure proper electrical connection and to protect personnel. The sleeves are preferably formed as right circular cylinders extending from a first surface 534 on the base 528. The sleeve 532 extends from the first surface 534 on the base for receiving and encircling part of a connector contact 536 for contacting and supplying electrical energy to mating contacts on a lamp or lamp adapter.

The connector sleeves 532 are preferably dimensioned on the outside so as to easily slide into the cavities 474 or 486 to allow mutual engagement of the electrical contacts on the lamp and in the connector 434. Preferably, the connector 434 includes as many sleeves and respective connector contacts as are necessary to correspond to the contacts on the lamp. Specifically, for a bi-pin lamp, a second sleeve 538 houses, isolates, and protects a corresponding connector contact 540 and has the same structure and function, preferably, as the first sleeve 532 and first contact 536. If any orientation or directional characteristic is desired for the connector and/or the lamp, the internal or external shapes of the sleeves 532 and 538 can be configured differently to prevent improper orientation upon connection.

For each connector contact, the base and sleeve 532 preferably include a first bore 542 bridging the base 528 and the sleeve 532. The bore 542 and the cavity in the sleeve 532 meet at a base surface 544 at the end of the bore 542 opposite wall 544. The base includes a countersink wall 546 joining the bore 542 to a first counterbore 548, which terminates at its opposite end at a second countersink surface 550. The second countersink surface 550 joins the first counterbore 548 to a second counterbore 552 which extends to a rim 554 on the end surface 556 of the base 528. The inside surfaces of the sleeve 532 and the openings through the base 528 are preferably formed and centered around an axis 558.

The connector contacts may take any number of forms, but preferably are selected so as to provide a maximum surface area for electrical contact with the corresponding contact on the lamp. Where the lamp pins are cylindrical pins for external electrical contact, the connector contacts 536 are preferably hollow sleeve or split sleeve contacts formed as hollow substantially right circular cylinders and extending longitudinally relative to the axis 558 a distance sufficient to achieve the desired electrical contact with the corresponding lamp pin. The contact 536 in one embodiment is preferably dimensioned so as to stop or end slightly below the end surface 560 of the sleeve 532 so as to minimize the possibility of the contact being touched by personnel. The end of the contact 536 may be positioned significantly below the surface 560 in order to increase the over-surface distance between the end of one contact 536 and the end of the adjacent contact 540. In any case, the dimensions of the contacts and the dimensions of the sleeves 532 and 538 can be selected as desired to achieve the desired functions and results. For example, in another preferred embodiment, the pin is recessed below the surface 560, a distance greater than the length of a conventional lamp pin, such as greater than 5/16 inch, in order to minimize the possibility of energizing the lamp without appropriate protection, such as an adapter.

The lamp adapter and the lamp connector are described above in the context of a T8-sized lamp having conventional dimensions. The pin spacing on such lamps is such as to permit cavity walls on the adapter sufficient to encircle the lamp pins and withstand normal expected use. The connector and the corresponding sleeves 532 are also sized sufficiently to permit separate sleeves 532 and 538 for the connector contacts to provide a reliable assembly. Adapters and connectors for larger-sized lamps can have similar configurations as described above with respect to FIGS. 29–33. For smaller lamp sizes, some materials used in the lamp adapter and the connector may not permit use of the same configurations. For example, the configuration of a lamp adapter and connector for a T5-sized lamp may be different.

As shown in FIGS. 36–40, an adapter 562 for a smaller lamp may have a sleeve 564 having a single wall 566 for encircling, enclosing and isolating both pins of the lamp in such a way that electrical contact is still permitted over any part of the 360° circumference of the lamp pins. The wall 566 is preferably formed substantially as an oval in cross-section transverse to the center axis 568 of the adapter 562.

The adapter preferably includes first and second bores 570 and 572 and corresponding countersink surfaces 574 and 576. The countersink surfaces 574 and 576 open into a first counterbore 578 which extends longitudinally to a second counterbore 580. The first counterbore 578 terminates at a base wall 582 and the second counterbore 580 terminates at a shoulder 584 at one end and at a third countersink surface 586 at the other. An O-ring or other seal groove 588 extends internally around a surface of the counterbore 580.

The bores 570 and 572 open into a third counterbore 590 for enclosing, isolating and protecting, while permitting access to, the lamp pins. The wall 566 of the counterbore 590 is preferably spaced from the lamp pin surfaces a distance sufficient to permit suitable access to the pins for electrical contact by a connector. The third counterbore 590 terminates at a base wall 592 at one end and a countersink surface 594 at the other.

The lamp adapter 562 also includes clip support surfaces 596 for permitting a spring clip or other support to hold the lamp adapter, and therefore the lamp, relative to a base or support surface. The support surface 596 may also include one or more bridges or bumps 598 to limit rotation of the lamp adapter in the support clips. The bumps 598 may be hemispherical or may extend longitudinally of the support surface 596. The support surface 596 may be bounded by a first ridge or ring 600 and a second ridge or ring 602 for limiting longitudinal movement of the adapter within the support clips.

A connector 604 (FIG. 37) for a T5-sized lamp may include a base 606 and connector contact sleeves 608 and 610. The base may include a bore 612 about a center axis 614 of the bore 612 and a first countersink surface 616 and a first counterbore 618. The first counterbore 618 extends between the first countersink surface 616 and a second countersink surface 620. The second countersink surface 620 joins the first counterbore 618 with a second counterbore 622, which in turn terminates at an end wall 624 in the base 606. The base is preferably rectangular in cross-section and may include a grip surface 626.

Figure 36:
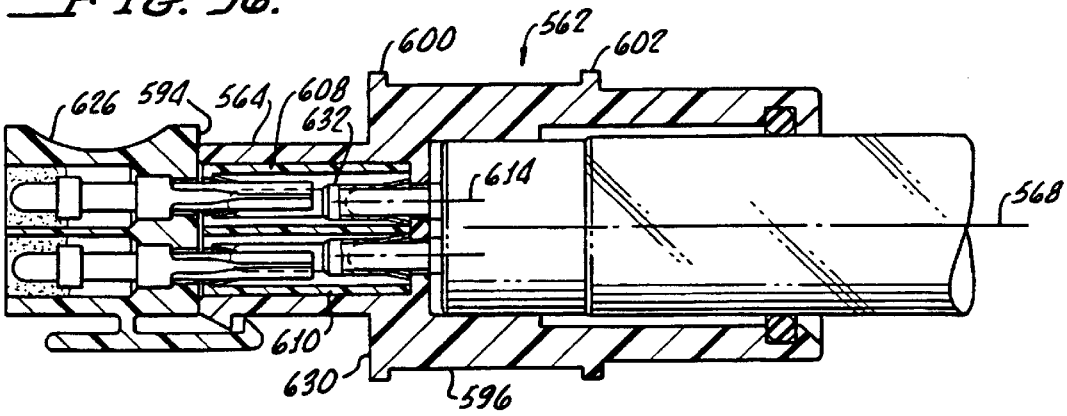
FIG. 36 is a cross-sectional view of an assembly of a lamp, adapter and connector in accordance with a further aspect of the present inventions.
Figure 37:
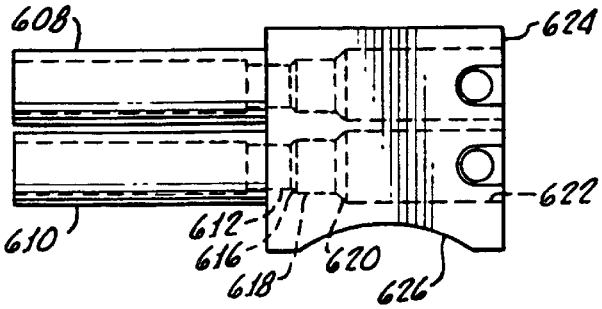
FIG. 37 is a side elevation of a connector of the assembly of FIG. 36.
Figure 38:
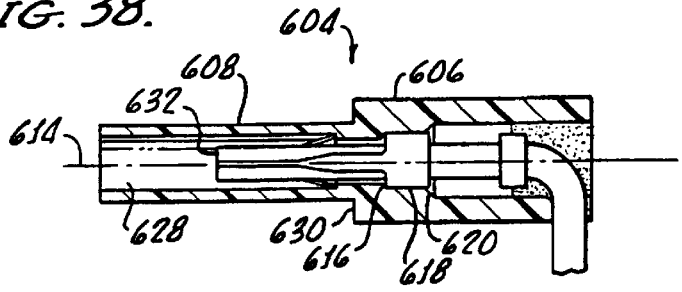
FIG. 38 is a longitudinal cross-sectional view of the connector of FIG. 37.
Figure 39:
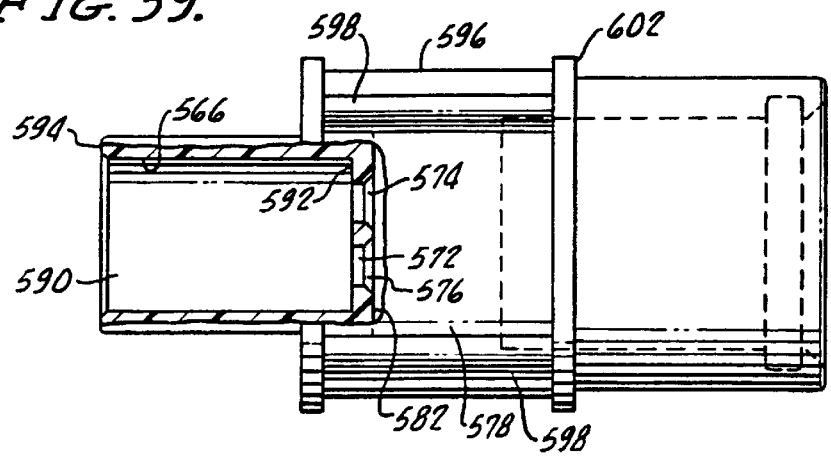
FIG. 39 is a side elevation and partial cut-away view of the adapter of FIG. 36.
Figure 39A:
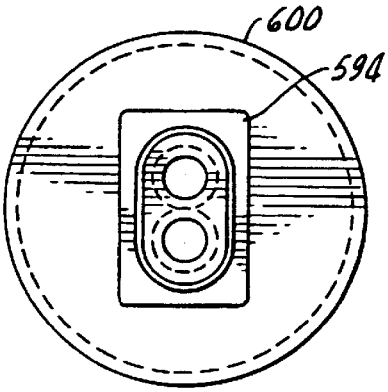
Figure 39B:
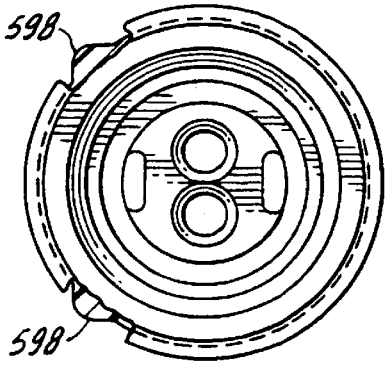
Figure 40:
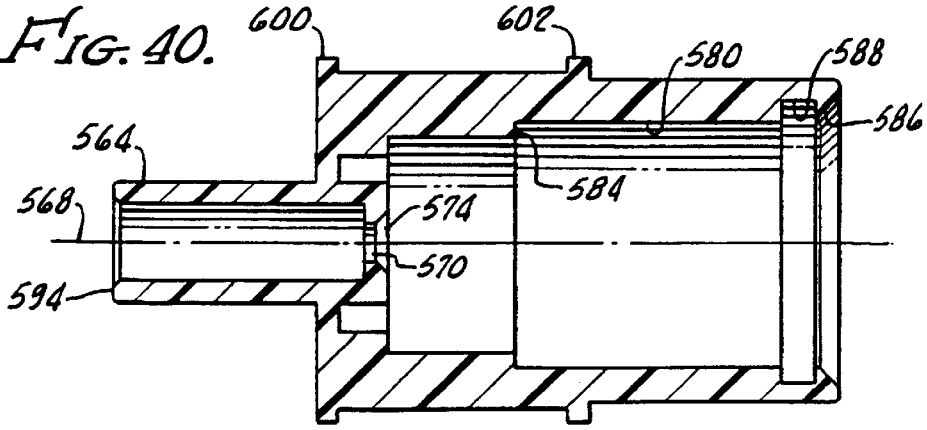
FIG. 40 is a cross-sectional view of the adapter of FIG. 39.

The bore 612 opens into a third counterbore or cavity 628 formed by a sleeve, jacket, housing, insulator or cylinder extending from a second wall 630 in the base 606 for encircling, isolating, insulating or accepting a connector contact 632 for electrically contacting and providing electrical energy to corresponding mating contacts on a lamp. As with the connector previously described, the connector 628 is configured and positioned with respect to the corresponding sleeve 608 so as to provide the desired electrical connection with the corresponding mating contact from the lamp and to minimize to the extent desired the possibility of inadvertent contact by personnel of the connector contact 632. As can be seen in FIG. 36, the connector contacts do not align exactly with the pin extenders. The centers of the connector contacts are preferably wider apart than the pin extender centers, so that the lengths of the sleeves 608 and 610 do not have to be as great while still providing the desired sleeve thickness and the over-surface distance to minimize arcing.

Electrical energy can be supplied to the contacts 632 by appropriate conductors, leads or otherwise. Those conductors can be sealed, bonded or otherwise secured in the base 606 and may exit the base at 90° to the base to permit more flexibility in lamp length.

The connector material and the lamp sleeves are preferably formed from a suitable plastic which can be used with electrical connectors and the like. Ultem is such a plastic. The entire lamp adapter material can be Ultem 1000, or a combination of materials, the lamp sleeve possibly being made from a material other than Ultem or the like. The O-ring or other seal element is preferably formed from a high temperature material such as silicone or the like.

The connector and lamp adapter may include a locking or latch arrangement so as to reduce the possibility of disengagement of the connector and lamp from each other under normal operating conditions. The base of the connector can include a cantilever clip having a clip arm and an actuator tip. The actuator tip may be depressed in order to raise the clip arm to disengage the clip arm from a latch or catch on the lamp adapter. The clip arm may include a boss, catch or other engagement surface for engaging a complimentary surface on the lamp adapter. In the preferred embodiment, the latch on the base is positioned opposite the arcuate grab surface. More than one latch or locking element can be included on the connector and lamp adapter combination.

The grab surface can include a roughened surface such as knurling to facilitate grasping the connector.

The conductors and the connector contact may be molded into the base and sleeve elements in a single operation. Alternatively, the conductors and the connector contacts to which they are electrically coupled may be crimped and inserted into the base and sleeves during one or more assembly steps. Preferably, the connector is impervious to moisture, air and other gases entering from the conductor side of the base. Additionally, while the sleeves are intended to be open so that electrical connection can be made between the connector contacts and pins on the lamp, the tolerances and fit between the sleeves on the connector and sleeves on the lamp adapter are such as to minimize entry of moisture and other gases to the electrical contact area during normal operation. Sealants such as silicone (shown shaded in the drawings) may be used on the base to seal the conductors relative to the base.

All or part of the lamp adapter barrel or sleeve may be separate or separable from the base wall 464 and 446 so that the clip support surface 500 and 502 can be positioned anywhere on the lamp and therefore supported at any point along the length of the lamp. The pin sleeves and the base wall 446 and 464 can then be placed separately on the lamp for protecting and insulating while allowing electrical contact with the lamp pins once an appropriate connector is attached. In the preferred embodiment, where the fluorescent lamp may be vertically oriented, the bottom clip support surface on the adapter is preferably formed integral or attached to the bottom of the lamp, such as through a base wall 446 and/or 464 so as to limit any downward movement of the lamp relative to the wall or base support for the lamp.

A key way, arrow or other indicator not shown, either internally or externally of the adapter barrel, can be used to indicate suitable alignment between the adapter and a lamp. For a material such as Ultem, the portion of the lamp interior to the lamp adapter is not visible. Therefore, the indicator may be used to suitably position the lamp relative to the adapter and ensure proper positioning of the adapter relative to the lamp and the lamp pins.

Where the lamp adapter is glued or adhered to the lamp, such as by adhesive between the perimeter surface of the lamp end cap and the first counterbore surface 456, the bond achieved is preferably strong enough to withstand a 30 pound pull force between the lamp and the lamp adapter.

The base wall 446 (FIG. 32) of the adapter 432 may include a boss 634 having a first outer diameter 636 at least as large as the spacing between the outer surfaces of the lamp pins so that misalignment of the lamp pins relative to the pins extenders 512 followed by rotation of the lamp to achieve alignment does not bend or break the lamp pins. Preferably, the flat, outwardly facing surface of the boss 634 extends radially outwardly to surround and be flush with the openings for the pin extenders 512. The boss preferably has a second diameter 638 greater than the first diameter 636 to provide a buffer zone around the openings for the pin extenders 512. In this configuration, the boss 634 helps to guide in the lamp pins into the pin extenders 512 without having the lamp pins push or press against an exposed edge and possibly bend or break. The boss 634 may also serve as a stop for the lamp and adapter when the adapter is fully seated on the lamp.

Figure 47:
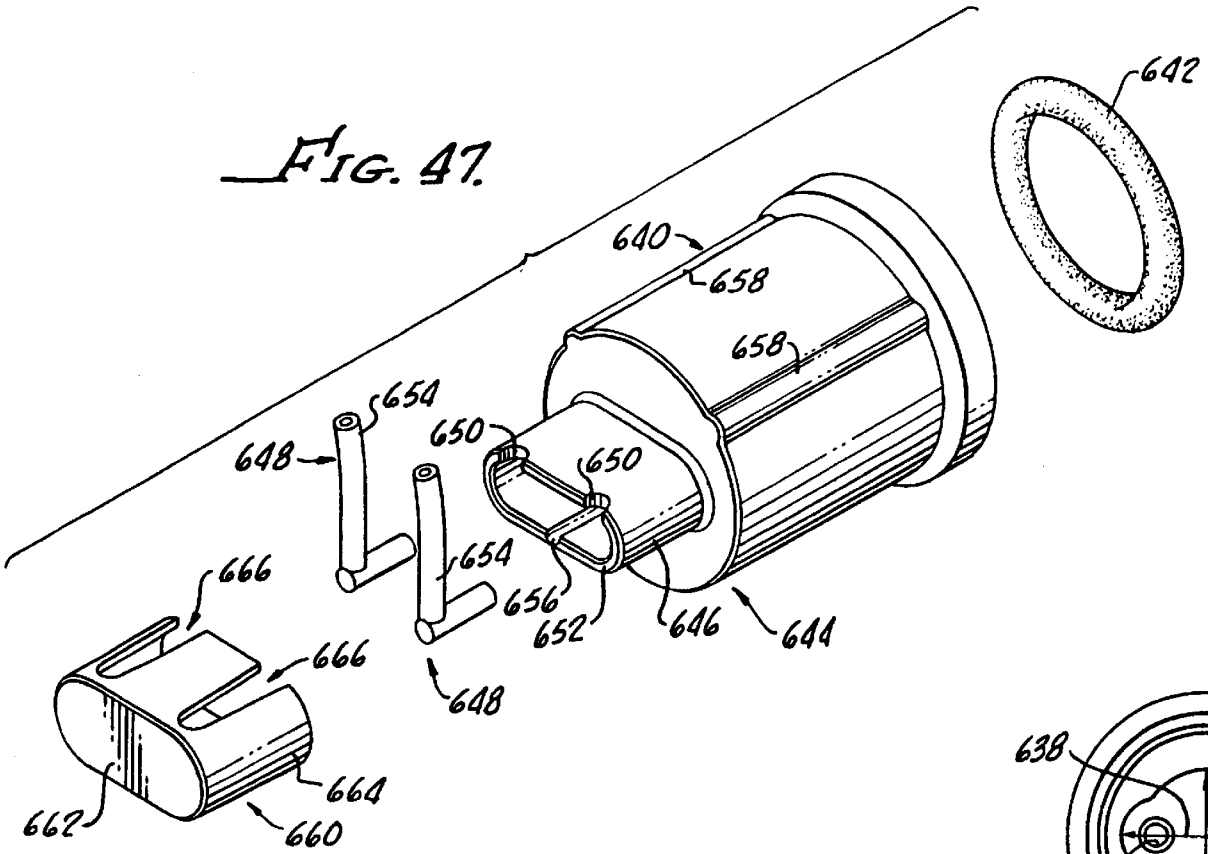
FIG. 47 is a perspective view of a further form of a lamp adapter in accordance with a further embodiment of the present inventions.
Figure 46:
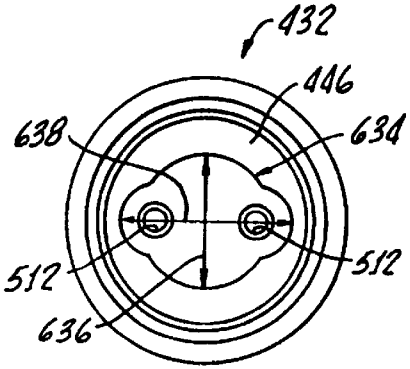
FIG. 46 is an end view similar to that of FIG. 32 showing an alternative embodiment of a lamp adapter in accordance with a further aspect of the present inventions.

In a further form of the inventions herein, and in a variation of the adapter 432 of FIG. 28 and the socket of FIGS. 1–10, a modified socket or adapter 640 (FIG. 47) is configured to be mounted over the end of a conventional fluorescent lamp and includes a connector extending away from a base surface and away from the lamp. In one preferred embodiment, the adapter 640 includes an O-ring or other sealing element 642 for helping to seal around the lamp, in a manner similar to that described above. The closed end 644 of the adapter includes a sleeve or other post or barrier 646 for protecting or encircling the pin extenders (not shown) of the adapter 640 extending from the base wall. The protection can be by one or more of the following, for example: by way of sealing, by way-of preventing impact from external forces such as from tools and the like, or by way of electrical insulation. The pin extenders preferably have a configuration similar or identical to the pin extenders 512 shown in FIG. 28 and are seated in the base wall in the same way.

In the preferred embodiment, the sleeve 646 extends a distance from the end 644 sufficient to extend to or slightly past the ends of the pin extenders, while still permitting sufficient access for conductors 648 for supplying current to the lamp. The sleeve 646 includes respective semi-circular grooves 650 in the rim 652 to receive insulated wires 654 so as to reduce the overall length of the adapter. (If the adapter 640 was to be used to accept a connector such as connector 434 (FIG. 28) for supplying electrical energy to lamp, the sleeve may include a groove or other key way 656 for engaging a complementary key surface on the connector 434. Such a key arrangement helps to properly position and align the connector 434 with the adapter 640.)

The grooves 650 may be formed in the side of the rim on the same side of the adapter as the ridges 658. Alternatively, they may be formed in the rim or elsewhere on the sleeve so that the wires exit in other directions. For example, the wires may exit from the side of the sleeve in the direction opposite the ridges 658. This orientation may provide for more effective positioning or manipulation of the wires within the lighting system.

The conductors 648 are preferably configured to maximize the electrical connection between the conductors and the pin extenders. In the configuration shown in FIG. 47, the wires 654 are coupled to respective sleeves or other electrical contact elements for maximizing the electrical engagement with the pin extenders. The wires 654 may be crimped or soldered or otherwise electrically engaged with the pin extenders. The other ends of the wires 654 are preferably joined to a suitable connector for receiving current from a ballast or other electrical supply. The connector may be similar to those described above, such as connector 434 in FIG. 28, for example.

A cap, cover or other junction protector 660 may be mounted over, around or across the open end of the sleeve 646 so as to protect the junction within the sleeve 646 from the elements, and also to help insure a closed environment for the junction between the lamp pins and the adapter. The cap 660 may include an end cover 662 for covering the open end of the sleeve 646 and a skirt 664 for enclosing and/or sealing with portions of the sleeve 646. The use of and the extent of any skirt 664 on the cap 660 will affect how well the end of the adapter is sealed. The cap 660 preferably includes slots 666 to allow the cap to fit over the wires 654. The cap 660 is preferably bonded or otherwise sealed to the adapter by sealant, adhesive or some other bonding agent applied around the exposed rim of the skirt 664, so that the cap 660 bonds to the adapter about the junction between the sleeve 646 and the end 644 of the adapter. Sealant, potting or other compounds may be placed within the sleeve 646 to further protect and seal the area around the pin extenders and the sleeve 646. It should be noted that the cap 660 can be formed with little or no skirt 664 and still provide a suitable seal. For example, the grooves 650 can be sized so that mounting of the cap 660 over the end of the sleeve 646 compresses the insulation on wires 654 so that a reliable seal is formed around the entire rim 652.

In an alternative embodiment of the adapter shown in FIG. 28, a cap with or without a skirt may be placed over the exposed end of the connector 434 so as to provide more of a seal for the adapter end. Where the connector 434 has an outer surface that is co-extensive with the outer surface of the sleeve, except for any clip arrangement, a cap may also extend down over any junction between the connector and the sleeve. Additionally, a seal or other barrier may be placed between the connector and the rim of the sleeve to provide an additional moisture barrier. For example, the seal may be formed by an O-ring placed against the surface 534 on the connector.

A connector for a lamp has been described which includes a base and a contact element extending from the base for supplying electrical energy to the lamp. In the preferred embodiment, the contact element includes a complimentary surface for the surface of the lamp contact to maximize the surface area of contact between the lamp contact and the connector contact. A sleeve, jacket or cylindrical wall extends around the contact for isolating the contact and for controlling, determining or defining the form of electrical contact that can occur with the connector, and the sleeve preferably includes a wall defining an opening into the sleeve for permitting access to the sleeve. The sleeve is preferably spaced radially from the connector contact element so as to permit electrical contact about all or any part of the 360° circumference of the connector electrical contact. Such a connector is particularly suitable for fluorescent lamps such as bi-pin lamps. In the example of a lamp and a lamp adapter limiting contact with or access to the lamp pins, the lamp connector can provide suitable electrical connection to provide the appropriate amount and form of electrical energy to the lamp for proper operation. Where the electrical energy may reach as high as 600–800 volts, the connector and/or adapter lamp combination is believed to minimize the possibility of accidental contact with the lamp pins and/or the connector contacts, thereby minimizing the possibility of inadvertent shock.

Where normal operating voltages are lower, the portion of the lamp adapter isolating the lamp pins can be omitted, and suitable connection can be made with the connector, while the lamp is supported by an appropriate support. For example, the adapter sleeve or support surface may be placed anywhere longitudinally along the length of a conventional fluorescent lamp while electrical connection can be made with the connector and the bi-pin contacts on the lamp.

A lamp element or partial lamp cover is also shown which includes a base element for covering part of a lamp, and a sleeve, barrel, housing, or cylindrical wall extending from the base for encircling, enclosing, receiving or protecting a contact on the lamp. In the preferred embodiment, the cover is configured to be used on a lamp having bi-pin contacts so that the sleeve extends from the base for isolating a respective contact on the lamp. Preferably, the sleeve permits access to the contact so that electrical contact can be made with the lamp contact over all or any part of the 360° circumference of the lamp pin. The lamp cover also preferably includes a lamp barrel or other housing extending from the base for encircling, enclosing or extending over part of the lamp for holding or fixing the adapter to part of the lamp.

Although the present inventions have been described in terms of the preferred embodiments above, the described embodiments of the invention are only considered to be preferred and illustrative of the inventive concept; the scope of the invention is not to be limited or restricted to such embodiments. Various and other numerous arrangements and modifications may be devised without departing from the spirit and scope of the inventions. Accordingly, the present invention is not limited to those embodiments precisely shown and described in the specification. It is intended that the scope of the present inventions extends to all such modifications and/or additions and that the scope of the present inventions is limited solely by the claims set forth below.

What is claimed is:

1. A socket for a lighting assembly, the socket comprising:

a rigid socket body with a base wall and a second wall unitary with the base wall and extending a first distance from the base wall for defining an enclosure and a rim at an end of the second wall such that a lighting element with a pin contact can extend past the rim into the enclosure and wherein the second wall includes a seal element for sealing between the second wall and a lamp; and first and second cylindrical electrical connectors each having a first end in the base wall and extending away from the rim in a second direction; and the rigid socket body further including at least one third wall extending in the second direction from a point adjacent the base wall past the first and second cylindrical electrical connectors and having at least a portion spaced from the cylindrical electrical connectors to allow access to the cylindrical electrical connectors from the second direction between the at least one third wall and the cylindrical electrical connectors, and further including a wall between the first and second cylindrical electrical connectors extending in the second direction past the first and second cylindrical electrical connectors.

2. The socket of claim 1 wherein the first end of each connector is flush with the base wall.

3. The socket of claim 1 wherein the seal is an O-ring seal element positioned adjacent the rim.

4. The socket of claim 3 wherein the second wall includes an interior surface and wherein the O-ring seal is positioned on the interior surface of the wall.

5. The socket of claim 3 further including a lamp having a lamp body, a lamp end at an end of the body having a base and at least one pin connector extending away from the lamp base and wherein the lighting element extends into the socket such that the O-ring seal engages and seals between the second wall and the lamp body.

6. The socket of claim 5 wherein the base wall is a substantially flat wall and wherein the O-ring seal is positioned on the second wall between the base wall and the rim.

7. The socket of claim 1 wherein the second wall includes an outer surface and wherein the outer surface includes at least one engagement surface for accepting a support for supporting the socket.

8. The socket of claim 7 wherein the engagement surface is a groove extending about a circumference of the second wall.

9. The socket of claim 8 wherein the groove has a longitudinal width and wherein the socket further includes a support for supporting the socket including a support element having a longitudinal width approximately the same as the longitudinal width of the groove.

10. The socket of claim 8 wherein the groove has a longitudinal width and wherein the socket further includes a support for supporting the socket including a support element having a longitudinal width smaller than the longitudinal width of the groove.

11. The socket of claim 8 wherein the groove on the socket has a shape and wherein the socket further includes a support for supporting the socket including a support element having a configuration at least in part conforming to the shape of the groove.

12. The socket of claim 7 wherein the engagement surface is at least two grooves spaced longitudinally relative to each other.

13. A socket for a lighting assembly, the socket comprising:

a socket body with a base wall and a housing wall extending a first distance from the base wall for defining an enclosure for receiving an end of a lighting element and a rim at an end of the enclosure such that a lighting element having a pin contact can extend past the rim into the enclosure;

at least one cylindrical electrical connector extending from the base wall away from the rim; and a second wall around the connector and a cap covering the wall and a conductor coupled to the at least one cylindrical electrical connector and crossing the wall sideways from under the cap.

14. The socket of claim 13 wherein the housing is at least twice length of the connector so that the enclosure surrounds at least part of the lighting element in addition to the pin contact.

15. The socket of claim 13 wherein the at least one cylindrical connector includes two cylindrical connectors spaced apart from each other and extending from the base wall of the socket a second distance, wherein the second wall defines an interior surface which is substantially circular to accept a lighting element and the second wall extends from the base wall a distance at least twice the second distance and further including a lamp having a lamp body, a lamp end at an end of the body having a base and two pin connectors extending away from the lamp base and wherein the lighting element extends into the socket such that the pin connectors electrically contact the cylindrical connectors and wherein the second wall extends around part of the pin connectors on the lamp and past the base of the lamp to enclose the base and at least part of the lamp body.

16. The socket and lamp of claim 15 wherein the socket is a rigid socket and wherein the cylindrical connectors are aligned substantially parallel to an axis of the body of the socket.

17. The socket and lamp of claim 16 further comprising a seal for sealing around the lamp.

18. The socket and lamp of claim 17 wherein the second wall includes an O-ring groove adjacent the rim for sealing between the lamp and the socket wall.

19. The socket and lamp of claim 18 wherein the socket further includes conductors for supplying current to the connectors and a wall defining an opening for the conductors and further comprising a seal for the conductors so that the socket connection is sealed inside the socket.

20. The socket of claim 13 wherein the housing wall includes a seal element for sealing between the housing wall and a lamp.

21. The socket of claim 20 wherein the seal element includes an O-ring seal positioned in the second wall.

22. A socket for a lighting assembly, the socket comprising:

a socket body with a base wall and a second wall unitary with the base wall and extending a first distance from the base wall for defining an enclosure and a rim at an end of the enclosure such that a lighting element with a pin contact can extend past the rim into the enclosure;

first and second cylindrical electrical connectors each having a first end in the base wall and each extending in a direction from the base wall away from the rim for contacting respective connectors on a lighting element;

a third wall extending from the base wall away from the rim and past the first and second cylindrical electrical connectors and an insulator between the first and second cylindrical electrical connectors; and a holder for the socket body and movable at least one of rotatably and slidably relative to the socket body and the holder further including a mounting element for mounting the holder to a mounting surface.

23. The socket of claim 22 wherein the socket further includes a groove extending about a circumference of the second wall for accepting the holder.

24. The socket of claim 23 wherein the holder includes a socket engagement element having a length and wherein the groove on the socket is sized to have a longitudinal length greater than the length of the socket engagement element.

25. The socket of claim 23 further comprising a second groove spaced from the first groove for accepting the holder.

26. The socket of claim 22 wherein the socket is separable from the holder.

27. The socket of claim 21 wherein the holder includes a resilient holding element for engaging and releasably holding the socket.

28. The socket of claim 27 further including a mounting surface to which the holder is mounted and positioned for supporting the socket, wherein the holder is movable to another position relative to the mounting surface.

29. The socket of claim 28 wherein the holder mounting element is a spring biased mounting element.

30. The socket of claim 28 wherein the mounting surface includes a track.

31. The socket of claim 28 wherein the holder mounting element is a spring biased mounting element and wherein the mounting surface includes a track and the spring biased mounting element engages the track.

32. A socket for a lighting assembly, the socket comprising:

a socket body with a base wall having a center, and a second wall extending a first distance from the base wall for defining an enclosure and a rim at an end of the enclosure such that a lighting element with a pin contact can extend past the rim into the enclosure; and at least two pair of cylindrical electrical connectors, at least one connector having an end at the base wall and each connector extending away from the rim wherein each connector in each pair is positioned approximately equidistant from a center of the base wall relative to the other connector in the pair and wherein the spacing between the connectors in one pair is different than the spacing between the connectors in the other pair.

33. The socket of claim 32 wherein the at least two pair of connectors are oriented in an approximate crisscross pattern.

34. The socket of claim 33 wherein the first pair of connectors accept pins from a T8 sized fluorescent lamp and wherein the second pair of connectors accept pins from a T5 sized fluorescent lamp.

35. The socket of claim 34 further comprising an indicator on the socket indicating the relative position in the socket of at least one of the cylindrical connectors.

36. The socket of claim 32 wherein the connectors have a first end in the base wall and a second end extending away from the rim.

37. A socket and lamp combination for a lighting assembly, the combination comprising:

a socket body including a base and at least one split-sleeve electrical connector extending from the base for contacting a connector on a lighting element and a housing wall;

a lamp having an end extending within the housing and a contact on the end and a body for passing light out of the lamp; and a wall on the socket body extending around part of the electrical connector and wherein the wall includes a wall portion for permitting a conductor electrically coupled to the lamp contact to cross the wall to the side.

38. The socket and lamp of claim 37 wherein the wall portion includes a groove in a rim for allowing a conductor to rest in the groove.

39. The socket and lamp of claim 38 wherein the socket includes four connectors, each of which includes a barb.

40. The socket and lamp of claim 38 wherein the socket further includes alignment indicators for indicating the location of the connectors.

41. A socket for a lighting assembly, the socket comprising:

a rigid socket body with a base wall and a housing wall unitary with the base wall and extending from the base wall to a rim and defining an enclosure such that a lighting element with a pin contact can extend past the rim into the enclosure and wherein the second wall includes a seal wall and a seal element in the seal wall for sealing between the housing wall and a lamp;

first and second cylindrical electrical connectors each having respective ends at the base wall and extending from the base wall and away from the rim for contacting a respective connector on a lighting element; and a third wall extending from the base wall away from the rim and past the first and second cylindrical electrical connectors and spaced from each of the first and second cylindrical electrical connectors to allow access to the first and second cylindrical electrical connectors and a fourth wall extending between the first and second cylindrical electrical connectors and from the base wall past the first and second cylindrical electrical connectors.

42. The socket of claim 41 wherein the seal element in the wall is compressible against the wall of the socket.

43. The socket of claim 41 wherein the seal is substantially circular.

44. The socket of claim 41 wherein the cylindrical connector extends substantially parallel to the axis of the housing wall.

45. A method for creating a seal around a lamp between the lamp and a socket, the method comprising the steps of:

providing a socket with a base and a housing wall extending from the base to a rim and having a sealing element in the housing wall and a connector extending longitudinally in the base and extending from the base and away from the rim and connecting an electrical conductor to the connector in the base so that the electrical connector can extend sideways in a direction other than longitudinally from the connector;

providing a lamp having a connector on an end thereof;

inserting the lamp into the housing so that the connector on the lamp engages the connector on the socket and so that the sealing element seals between the socket and the lamp as the lamp is being pushed into the housing; and sealing around the connector and placing a cap over the connector so that the electrical conductor extends sideways out a side of the cap.

46. The method of claim 45 wherein the step of providing the socket with the sealing element includes the step of placing an O-ring seal in a groove in the wall of the socket.

47. The method of claim 45 further comprising the step of placing an insulator on the end of the lamp.

* * * * *